United States Patent [19]

Collins et al.

[11] Patent Number: 4,926,344

[45] Date of Patent: May 15, 1990

[54] DATA STORAGE STRUCTURE OF GARMENT PATTERNS TO ENABLE SUBSEQUENT COMPUTERIZED PREALTERATION

[75] Inventors: John E. Collins; Mitchell B. Grunes; Darryn J. Kozak, all of Minneapolis, Minn.

[73] Assignee: Minnesota Mining and Manufacturing Company, St. Paul, Minn.

[21] Appl. No.: 168,648

[22] Filed: Mar. 16, 1988

[51] Int. Cl.[5] ..... G06F 15/46

[52] U.S. Cl. ..... 364/513; 364/470

[58] Field of Search ..... 364/300, 470, 513, 468

[56] References Cited

U.S. PATENT DOCUMENTS

| | | | |
|---|---|---|---|
| 3,391,392 | 10/1965 | Doyle | 340/172.5 |
| 3,887,903 | 6/1975 | Martell | 364/200 |
| 4,149,246 | 4/1979 | Goldman | 364/200 |
| 4,546,434 | 10/1985 | Gioello | 364/300 |
| 4,598,376 | 7/1986 | Burton et al. | 364/470 |
| 4,675,253 | 6/1987 | Bowditch | 428/542.8 |
| 4,677,564 | 6/1987 | Paly et al. | 364/468 |
| 4,758,960 | 7/1988 | Jung | 364/470 |
| 4,807,143 | 2/1989 | Matsuura | 364/468 |

OTHER PUBLICATIONS

Jan Minott, "Pants and Skirts Fit for Your Shape", Burgess Publishing, Minneapolis, Minn., 1974.

Francesann Heisey, "A Quantitative Methodology for Generating Specifically Fitted Garment Patterns", PhD. Thesis, University of Minnesota, 1984.

Fact sheet from Digital Systems, P.O. Box 24246, Seattle, Wash., 98124, entitled "Computer and Communications Systems".

Fact sheet from Microdynamics Incorporated, 10461 Brockwood Rd., Dallas, Tex., entitled "GMS Grading Marking Station".

Advertisement of Clothing Design Concepts, Inc., May/Jun. 1985 issue of Vogue Patterns.

*Primary Examiner*—Allen MacDonald

*Attorney, Agent, or Firm*—Merchant, Gould, Smith, Edell, Welter & Schmidt

[57] ABSTRACT

A computerized data storage structure for storing garment pattern data in machine-readable form for use in connection with a computerized structure for manipulating the garment pattern data. The structure comprises coordinate data storage for storing points and lines depicting parts of a garment. The structure further comprises garment description storage for storing a description of the garment. The garment description storage comprises geometric constraint storage for storing constraint descriptions that specify limits on relationships among the points and lines that depict the garment. The garment description storage further comprises measurement storage for storing one or more measurement constraints that map the physical dimensions of the garment onto the points and lines and specify relationships between the physical dimensions of the garment and standard or individual body measurements.

15 Claims, 34 Drawing Sheets

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

© 1988 3M COMPANY

| | |
|---|---|
| COMMENT 222 | 220 |
| FEATURES 224 | |
| OPERATION 226 | |
| PARAMETERS 228 | |
| PREDICATE 230 | |
© 1988 3M COMPANY
*Fig. 45*
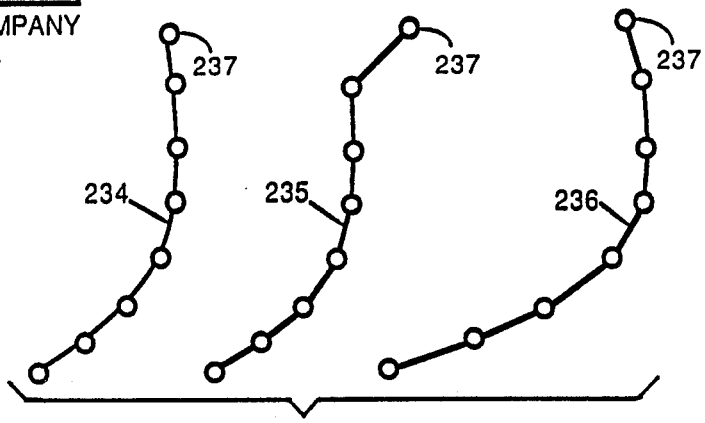
*Fig. 46*
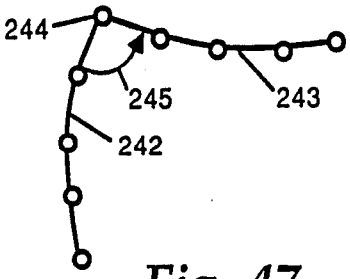
*Fig. 47*
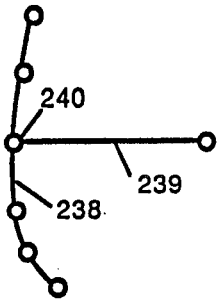
*Fig. 48*
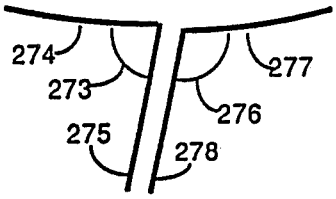
*Fig. 49*

DATA STORAGE STRUCTURE OF GARMENT PATTERNS TO ENABLE SUBSEQUENT COMPUTERIZED PREALTERATION

TECHNICAL FIELD

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

The present invention relates to a computerized system for producing pre-altered garments and the patterns (electronic or paper) used in the construction of garments, which relate to a set of standard or individual body measurements.

BACKGROUND ART

The problem of getting clothing to fit well without requiring custom tailoring has been an elusive goal in the garment and clothing pattern industries for many years. Many strategies have been developed for dealing with this problem. Creating and selling loose-fitting styles makes the problem less evident. Many companies take pains to identify the body characteristics of a "target market", a subset of the general population with identifiable body proportions. Many sizing schemes have been developed, particularly for women's clothing, including Misses, Womens, Half-sizes, Juniors, Petites, Junior Misses, etc. The proliferation of sizes makes it uneconomic for a manufacturer to produce and a retailer to stock all styles in all sizes. Extensive statistical studies have been undertaken with the aim of developing sets of standard sizes that will fit the majority of the population.

Typically, a prior art pattern used in the construction of clothing is generated as follows:

1. A skilled designer sketches a new design. After approval these sketches are sent to a pattern making department.

2. A pattern maker drafts a standard size (typically size Misses 10 for women's garments) flat-paper realization of the design using a set of generic parts called slopers as a starting point. This realization is then implemented in muslin and other fabrics and tested on mannequins and models. Once the designer approves the final realization of the design, the pattern pieces are sent to the grading department.

3. A grader generates a set of garment part outlines for each of the standard sizes in which it is desired to produce the design (e.g. Misses 6, 8, 10, 12, 14, 16, 18, 20, 22). This may be done by hand or with the use of a computerized grading system. The hand method involves tracing the original, moving the important points in or out as needed, and then redrawing the lines. If grading is being done with a computerized grading system, the grader assigns grading rules to each important point of each pattern piece, and the computer generates the outlines and draws the results. A grading rule is typically a set of (x, y) offsets, one per size, that specify how a given point is to be moved to represent a particular grade. Steps 2 and 3 are typically repeated for each size range (e.g. Misses, Juniors, Petites, Womens, etc.) because of the difficulty in expressing the more complex changes required to move between ranges with current systems.

4. If the pattern is intended for the home sewing market, the pattern pieces are labeled and laid out for printing on tissues; if the pattern is for a manufacturing operation, a manual or computerized marker-making system lays out the pattern pieces on the fabric, and either the markers are printed, for a manual cutting operation, or the computer drives an automated fabric cutter.

There are a number of inefficiencies with these processes. They affect manufacturers, retailers, and home sewers. These include but are not limited to high labor costs, printing costs, reorder and handling costs, inventory costs, space costs, stock shortages on popular items, and poor fit.

Many tailors and seamstresses spend their time hand-altering commercially manufactured garments. Many people are simply unable to find a ready-to-wear garment that fits in a desired style either because the garment is not manufactured in their size or because the standard sizes produced by a particular manufacturer do not match well with a particular customer's body measurements.

Fit problems for the pattern industry have been addressed by a number of approaches. The pattern houses often include alteration lines for lengthening and shortening sleeves and legs. Even so, home sewer typically modifies a pattern before sewing the garment, and then disassembles, alters, and re-sews the garment repeatedly in an attempt to achieve satisfactory fit. Several companies host traveling seminars designed to teach pattern modification techniques, and there have been previous attempts to produce computer-altered garments and garment patterns (a description of pattern modification techniques is in Jan Minott, *Pants and Skirts Fit for Your Shape*, Burgess Publishing, Minneapolis, Minn., 1974). None of these approaches adequately addresses the range of alterations necessary on the wide selection of garments and garment patterns that are available today.

Computerized fitting systems have been developed in the past; examples include systems used commercially by Clothing Design Concepts, Box 1188, Manhattan, Kans., and by Richman Brothers Company, Cleveland, Ohio, also described in U.S. Pat. No. 4,598,376. An analytic approach to producing custom-fitted patterns may be found in Francesann Heisey, *A Quantitative Methodology for Generating Specifically Fitted Garment Patterns*, PhD. Thesis, University of Minn., 1984. These systems have been limited to specific garment patterns, because of the difficulty involved in encoding a garment pattern with detailed fitting information.

Computerized grading systems, which have been in use in the industry for several years, do not have the ability to relate generic garment knowledge to garment pattern data; therefore, a grader is responsible for providing this knowledge through a process of manually assigning grading rules to patterns.

The present invention addresses the major problem that has existed to date in the use of a computerized fitting or grading system, which is the time consuming and error prone process of preparing new patterns as input to the system. This is accomplished by applying knowledge about generic garment types to each new pattern, and by extensive automatic analysis of new patterns based on that knowledge. Once this knowledge has been applied to a new pattern, it may be used to eliminate manual grading operations through a process of the present invention called "knowledge-based grading". The present invention also offers prealteration of garment patterns yielding a high quality fit for a wide range of standard or individual body measurements. As used here, the term "prealteration" refers to automatically applying alterations to a garment pattern, as needed to fit a set of body measurements, before the garment is constructed or the pattern printed. This effectively eliminates the current labor-intensive grading and alteration processes.

The system of the present invention contains knowledge about generic garment styles, including landmarks and other garment features that are expected to be found in garments representative of a garment style and generic constraints that describe detailed relationships between garments and body measurements in terms of the landmarks and other garment features. This knowledge may be applied to raw pattern data by identifying a generic garment style of a garment depicted by the raw pattern data, identifying the expected landmarks and other garment features in the raw pattern data, and then applying the generic constraints to the new pattern. The result is prepared pattern data that includes the knowledge necessary to fit the garment to a set of body measurements. A fitting system is also described that operates by satisfying constraints in a prepared pattern. Such a fitting system need not contain specific knowledge about particular garments.

A prior art system disclosed in U.S. Pat. No. 4,149,246 describes storing information on limitations for a garment (ref. column 7, line 39–40). These limitations refer only to limited choices such as whether a particular type of pocket is appropriate for a particular body type. It is assumed that these limitations have been entered into the prior art system by a system user, such as a designer, for each particular garment or pattern to be processed by the prior art system. Although in column 2, lines 52–54, there is a reference to using nineteen special body measurements for "highly accurate fitting (optional)", there is no disclosure for accomplishing such fitting in the patent, there being reference only to prior art grading systems, such as U.S. Pat. No. 3,391,392 (see column 5 line 49). Further, there is no disclosure of any type of generic knowledge of garment styles, or of the application of generic knowledge to specific garment patterns, as in the present system.

Another prior art system, described in U.S. Pat. No. 4,598,376, operates by modifying reference or pattern points that are stored in a pattern file (ref. column 7, lines 37–39). However, this system includes no storage of generic knowledge of garment styles. Nor is there any disclosure to teach or suggest a data storage structure for the pattern file or a pattern preparation process for identifying the reference or pattern points stored in the pattern file of the system. In contrast to the present system, in which a fitting system need not contain specific knowledge about particular garments, there is no disclosure in U.S. Pat. No. 4,598,376 to suggest that this is possible.

DISCLOSURE OF INVENTION

The present invention is a computerized data storage structure for storing garment pattern data in machine-readable form for use in connection with a computerized structure for manipulating the garment pattern data. The structure comprises coordinate data means for storing points and lines depicting parts of a garment. The structure further comprises garment description means for storing a description of the garment. The garment description means comprises geometric constraint means for storing constraint descriptions that specify limits on relationships among the points and lines that depict the garment. The garment description means further comprises measurement means for storing one or more measurement constraints that map the physical dimensions of the garment onto the points and lines and specify relationships between the physical dimensions of the garment and standard or individual body measurements.

BREIF DESCRIPTION OF DRAWINGS

FIG. 1A represents a preferred flow of data and user interaction through pattern preparation and fitting.

FIG. 1B schematically represents a hardware embodiment of the preferred system.

FIG. 2 describes an object oriented model for representation of a system.

FIG. 3 depicts a preferred hierarchical relationship among the instances in a project KB and the relationships of these instances to templates.

FIG. 4 details the elements of a preferred project instance.

FIG. 5 details the elements of a preferred garment instance for a garment that belongs to a project.

FIG. 6 details the elements of a preferred part instance for a part that belongs to a garment.

FIG. 7 details the elements of a preferred feature instance for a feature that belongs to a part or to a garment.

FIG. 8 details the elements of a preferred subclass of feature, called a line.

FIG. 9 details the elements of a preferred subclass of feature, called a point.

FIG. 10 details the elements of a preferred garment template.

FIG. 11 details the elements of a preferred garment measurement.

FIG. 12 details the elements of a preferred part template.

FIG. 13 details the elements of a preferred subclass of a feature, called an alignment guide.

FIG. 14 details the elements of a preferred subclass of a feature, called a dart.

FIG. 15 details the elements of a preferred set of standard or individual body measurements.

Figure 18:
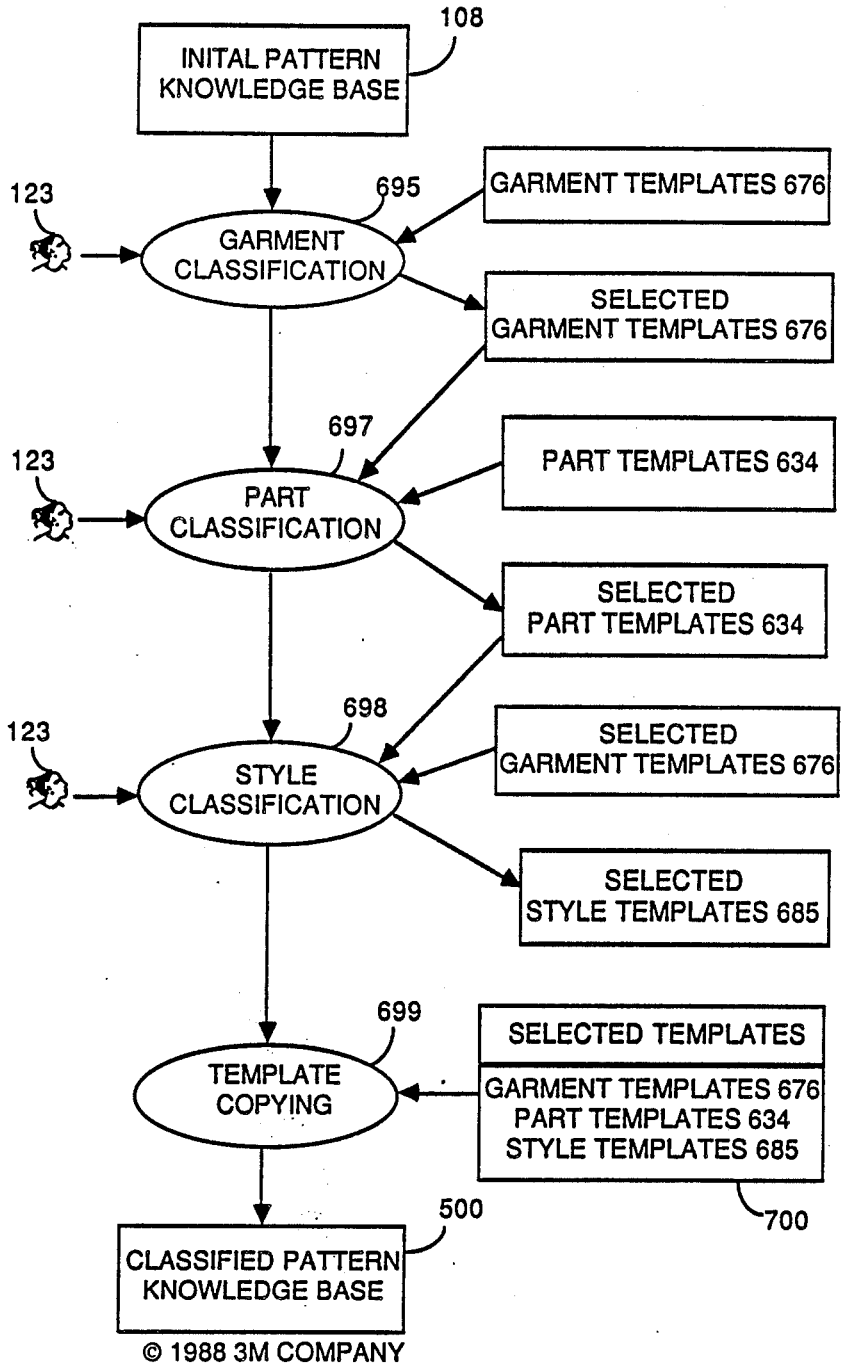

FIG. 18 schematically shows the steps of a preferred classification process.

Figure 19:
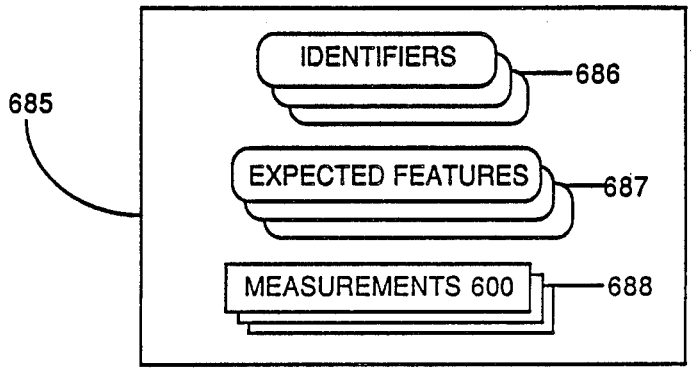

FIG. 19 details the elements of a preferred style template.

Figure 20:
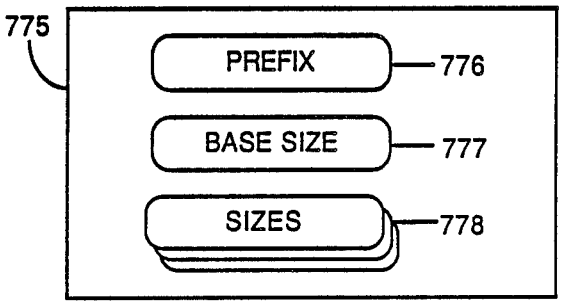

FIG. 20 details the elements of a preferred grade set.

Figure 21:
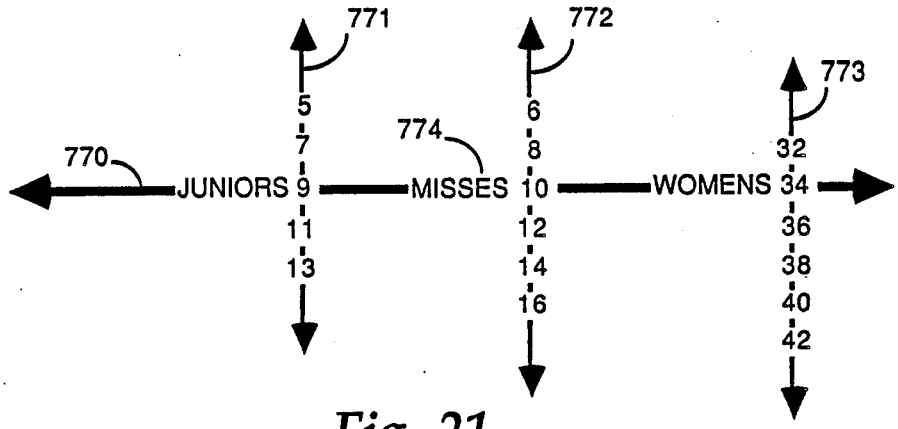

FIG. 21 illustrates conceptual relationships among standard sizes.

Figure 22:
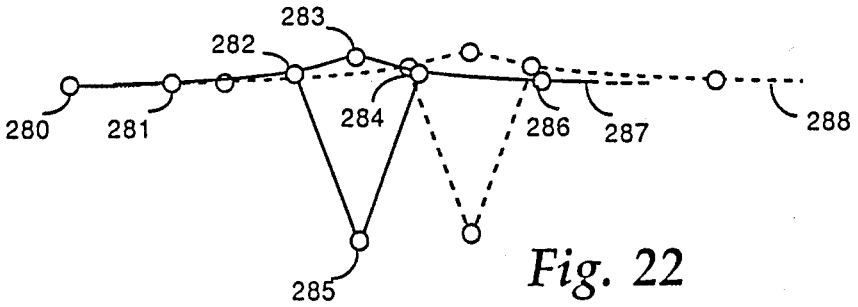

FIG. 22 illustrates an example of a knot scaling problem.

Figure 23:
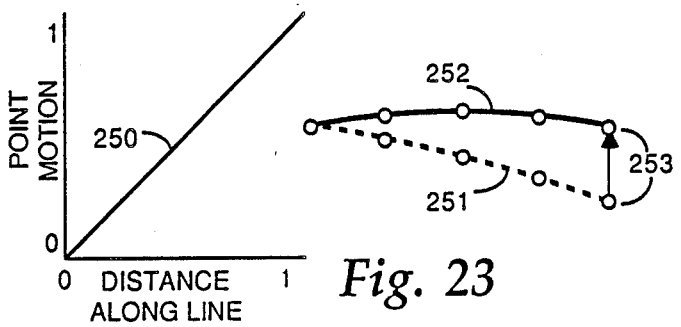

FIG. 23 illustrates an example of isomorphic curve reshaping.

Figure 24:
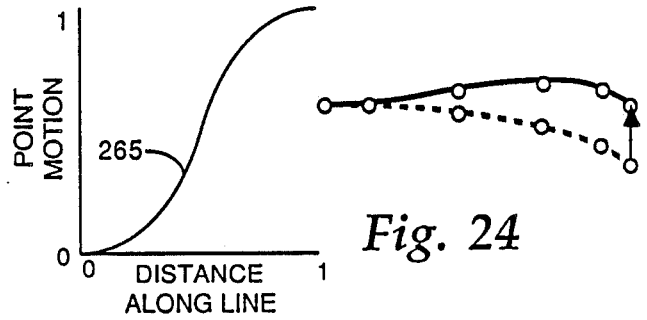

FIG. 24 illustrates an example of sinusoidal curve reshaping.

Figure 25:
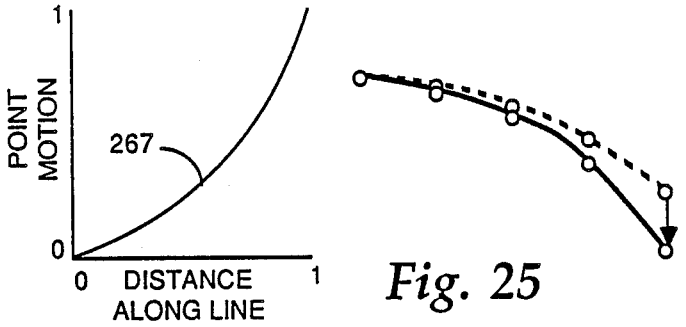

FIG. 25 illustrates an example of cubic curve reshaping.

Figure 26:
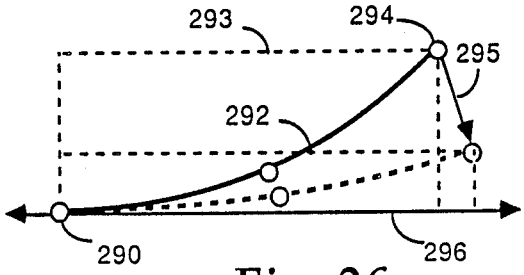

FIG. 26 illustrates an example of linear curve reshaping.

Figure 27:
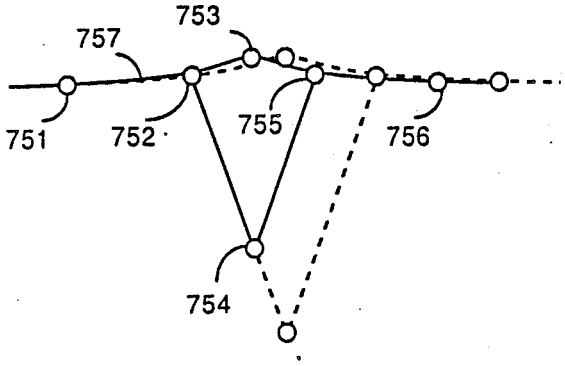

FIG. 27 illustrates a preferred dart lengthening process.

Figure 28:
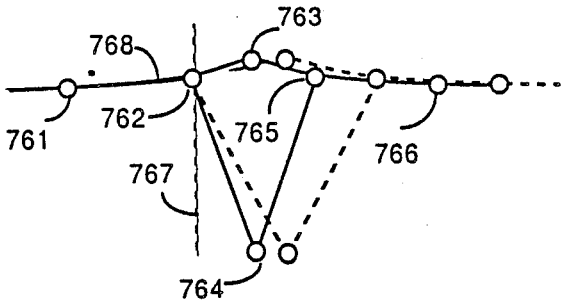

FIG. 28 illustrates a preferred dart widening process.

Figure 29:
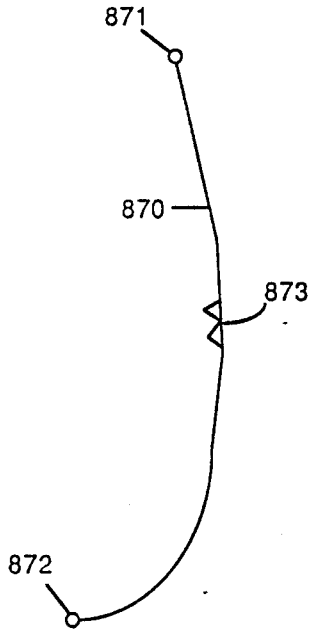

FIG. 29 illustrates the graphic elements of a preferred pattern part instance.

Figure 30:
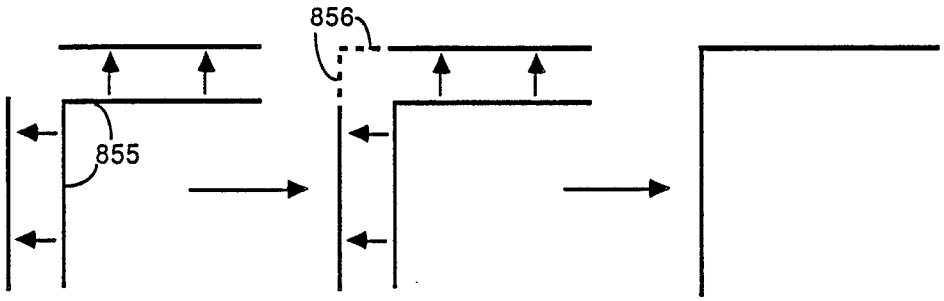

FIG. 30 illustrates a preferred process of seam allowance replacement at a corner.

Figure 31:
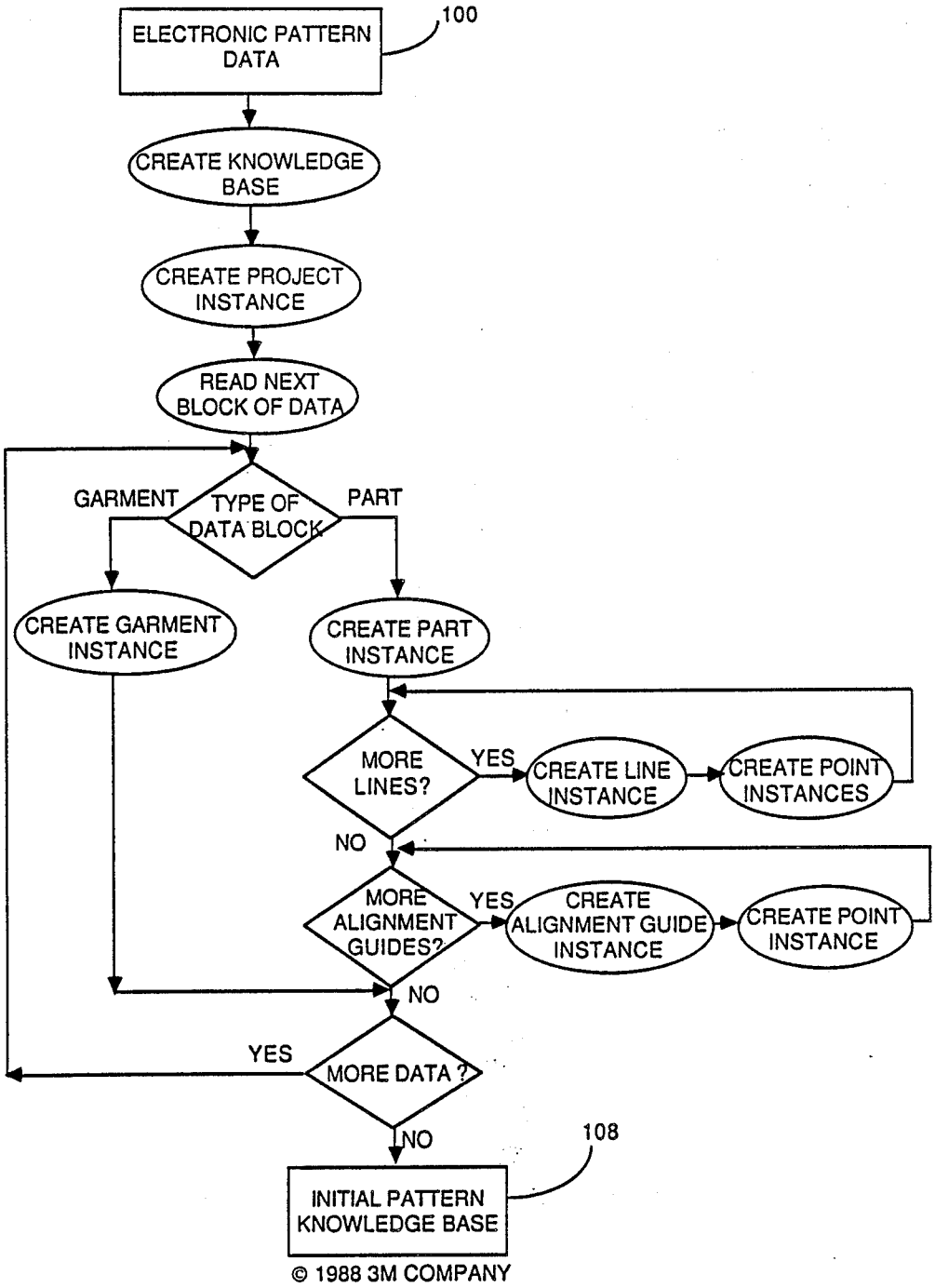

FIG. 31 schematically shows the steps of a preferred data conversion process.

Figure 32A:
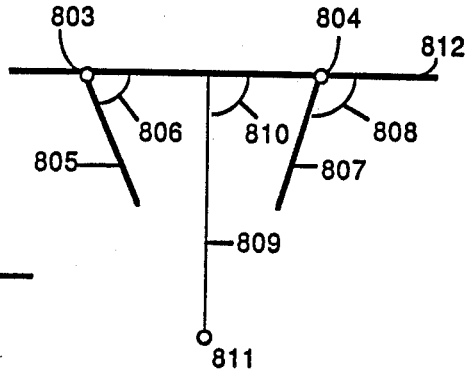

FIG. 32A illustrates a preferred process of computing to-close information for darts and pleats.

Figure 32B:
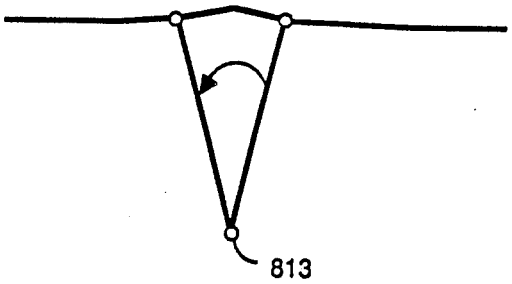

FIG. 32B illustrates a preferred process of computing to-close information for a symmetrical dart.

Figure 32C:
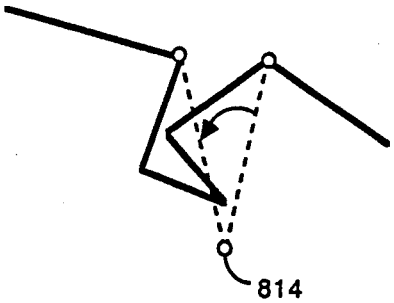

FIG. 32C illustrates a preferred process of computing to-close information for an asymmetrical dart.

Figure 32D:
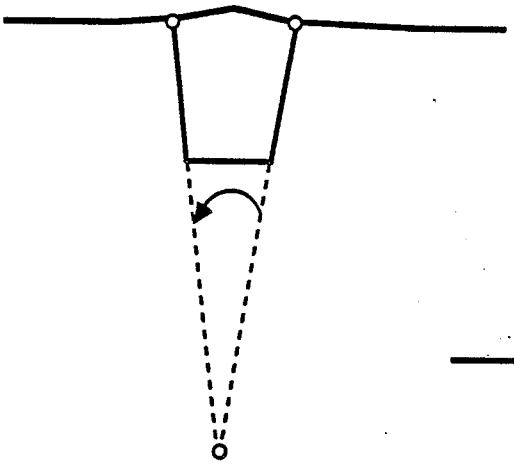

FIG. 32D illustrates a preferred process of computing to-close information for a converging pleat.

Figure 32E:
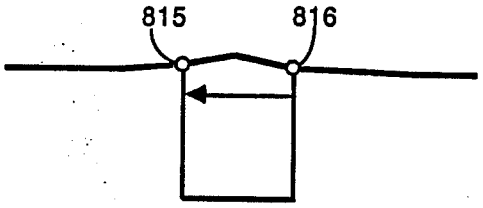

FIG. 32E illustrates a preferred process of computing to-close information for a parallel pleat.

Figure 33:
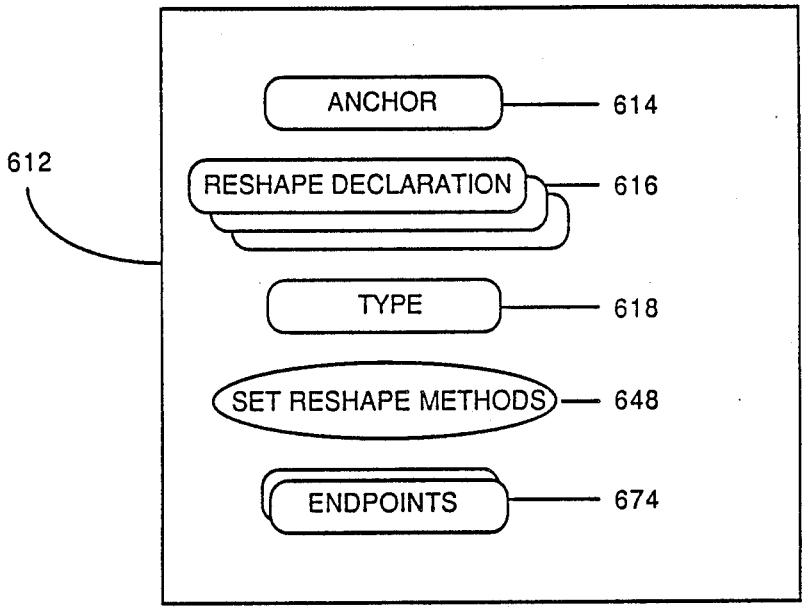

FIG. 33 details the elements of a preferred line template.

Figure 34:
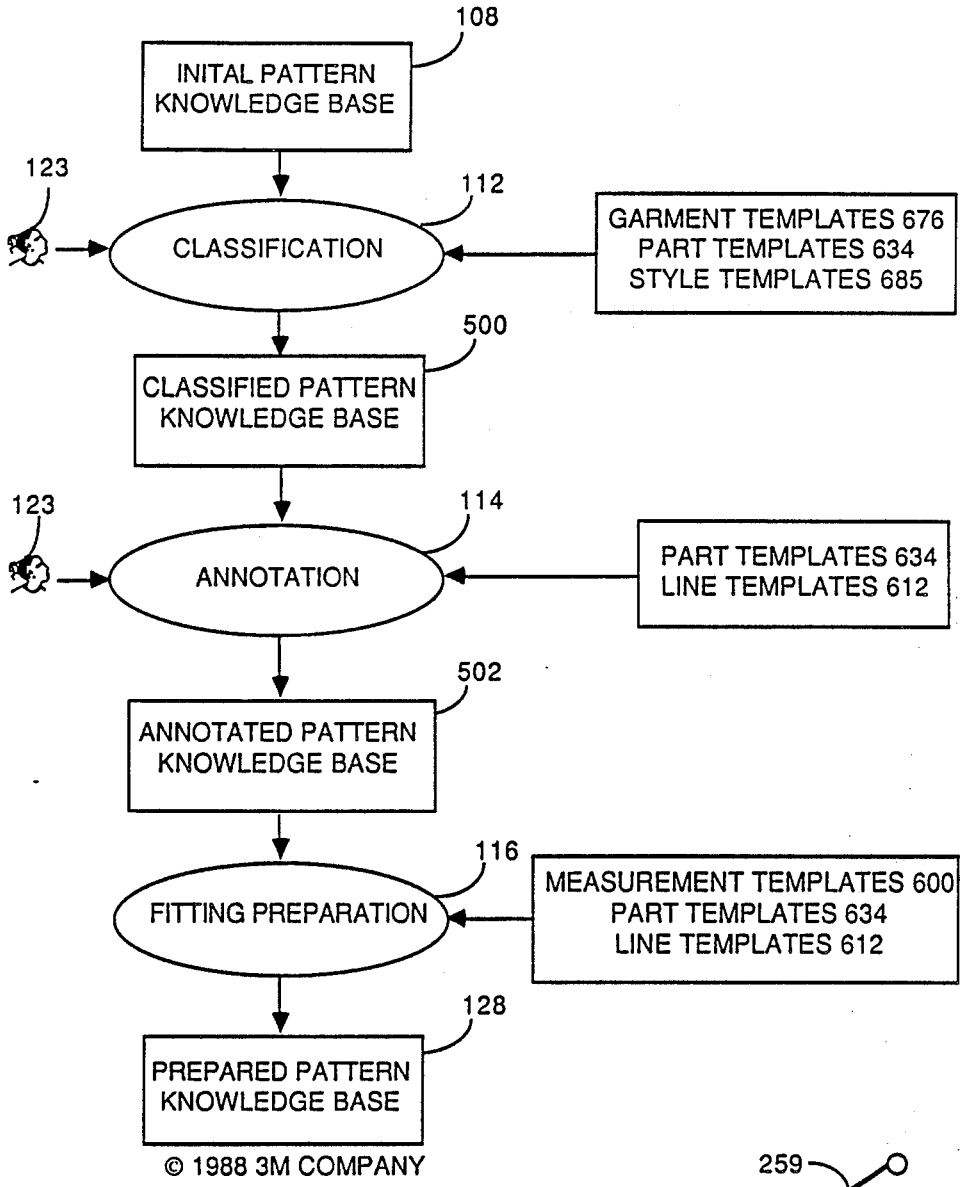

FIG. 34 schematically shows the steps of a preferred pattern preparation process.

Figure 35:
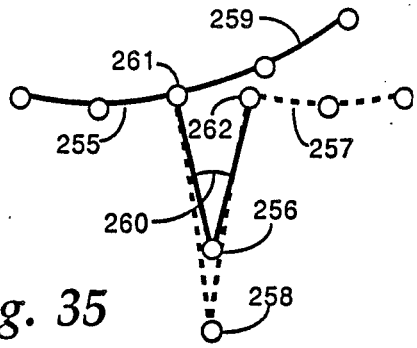

FIG. 35 illustrates a preferred process of closing darts.

Figure 36:
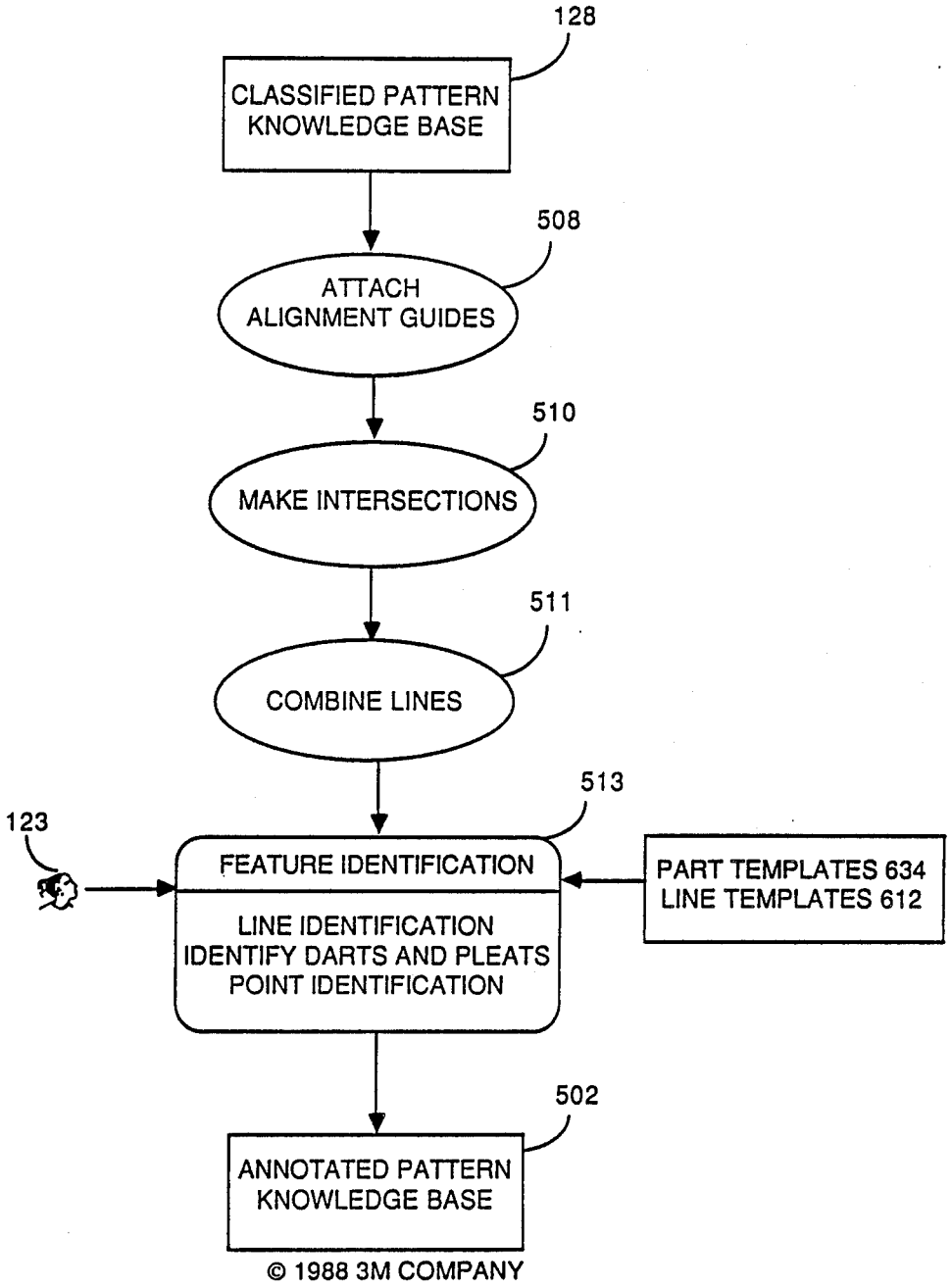

FIG. 36 schematically shows the steps of a preferred annotation process.

Figure 37:
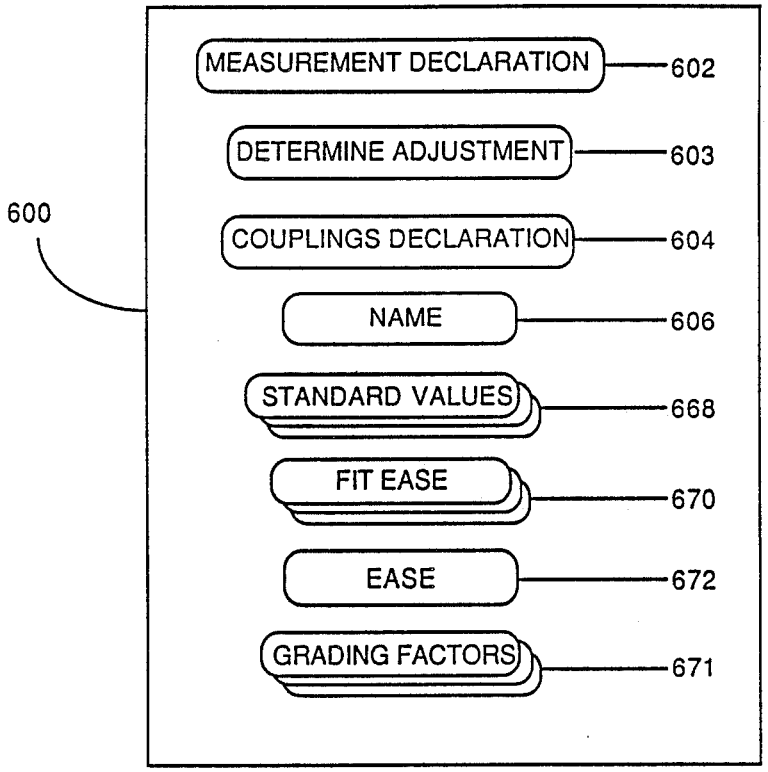

FIG. 37 details the elements of a preferred measurement template.

Figure 38:
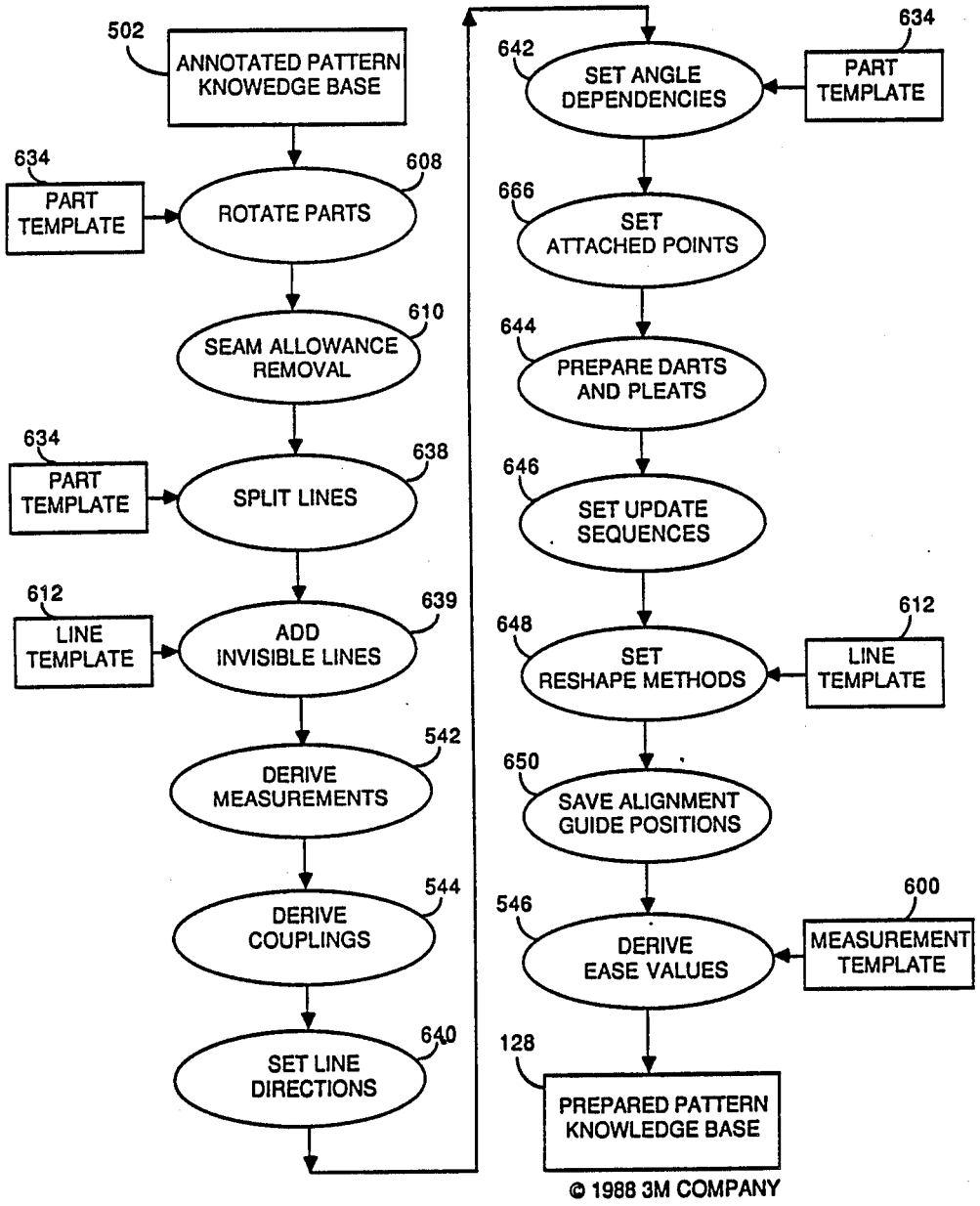

FIG. 38 schematically shows the steps of a preferred fitting preparation process.

Figure 39A:
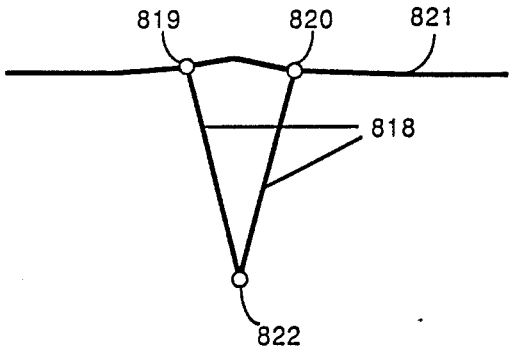
Figure 39B:
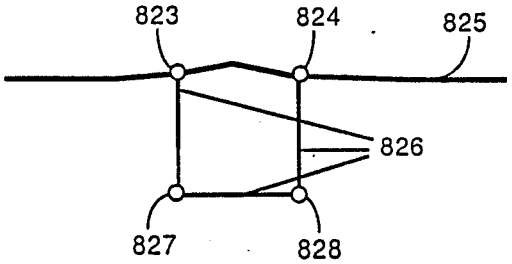

FIGS. 39*a* and 39*b* illustrate darts and pleats.

Figure 40A:
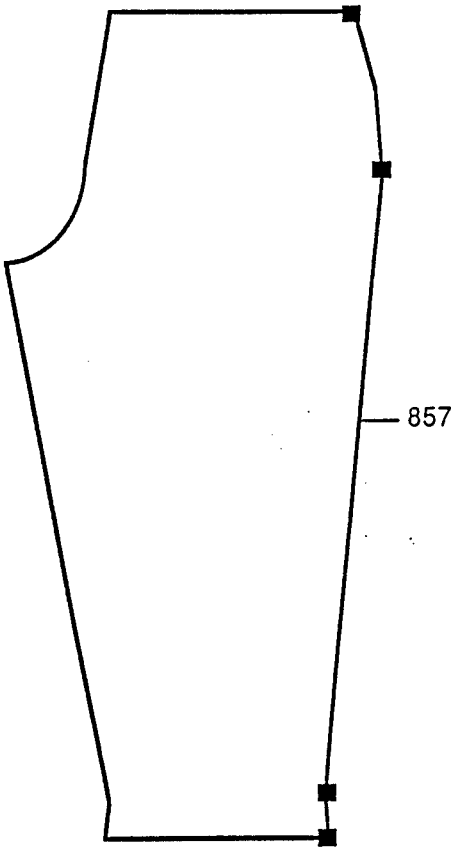

FIGS. 40*a* and *b* illustrates a preferred process of splitting lines.

Figure 41A:
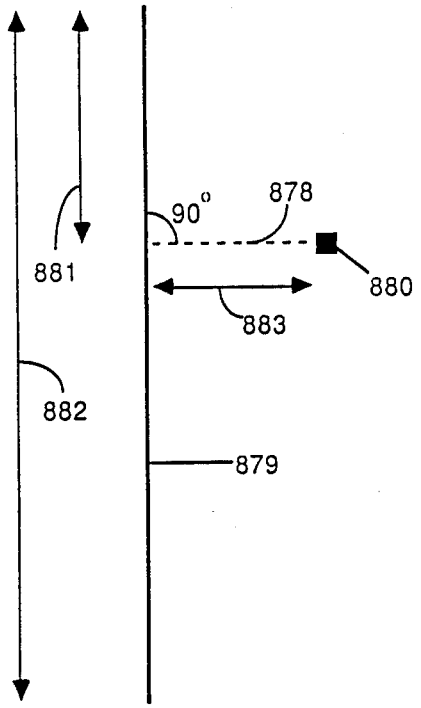

FIGS. 41*a* and *b* illustrate a preferred process of saving alignment guide positions.

Figure 42A:
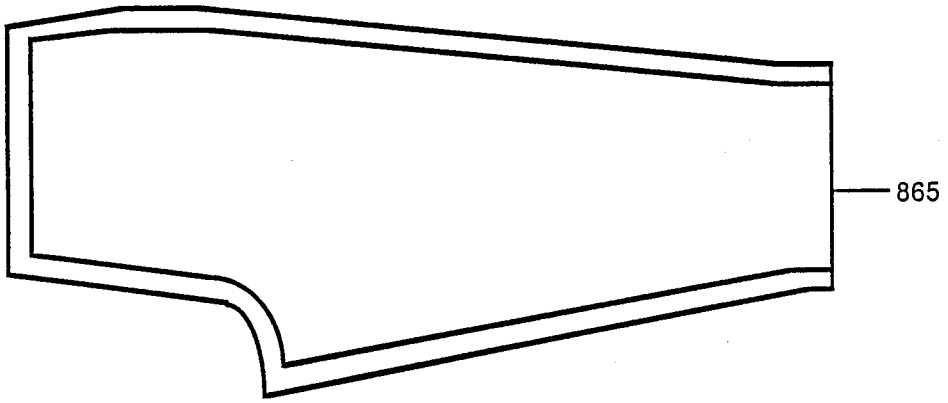
Figure 42B:
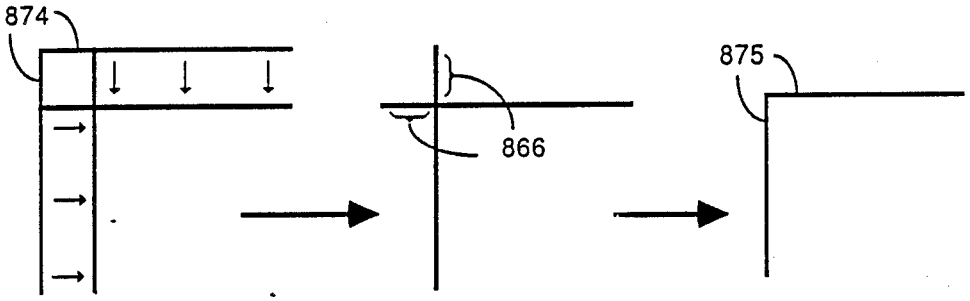
Figure 42C:
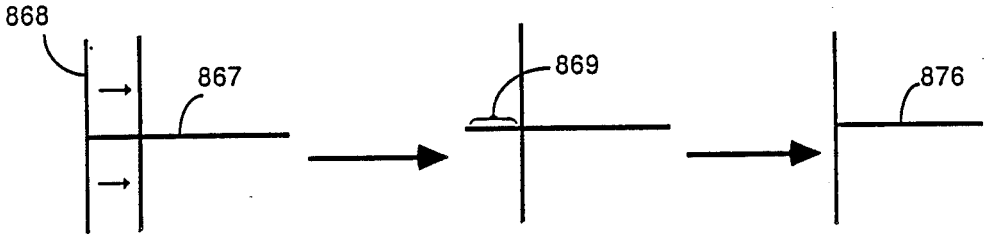

FIGS. 42*a*–42*c* illustrate a preferred process of seam allowance removal.

Figure 43A:
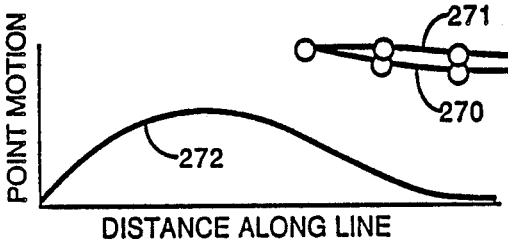

FIG. 43A illustrates a preferred angle restoration function.

Figure 43B:
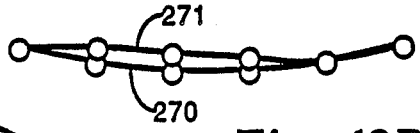

FIG. 43B illustrates a line segment before and after a preferred angle restoration process.

Figure 44A:
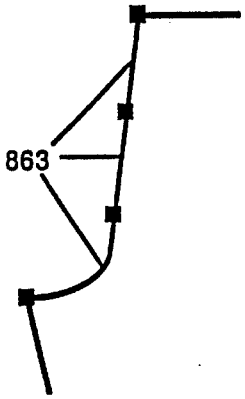

FIGS. 44*a* and *b* illustrate a preferred process of combining lines.

FIG. 45 shows a preferred coupling data structure.

FIG. 46 illustrates a preferred process of adjustment and redrawing steps on a single line.

FIG. 47 illustrates an angle dependency.

FIG. 48 illustrates a midpoint-endpoint dependency.

FIG. 49 illustrates a pair of angle dependencies.

DETAILED DESCRIPTION

General Introduction

Figure 1A:
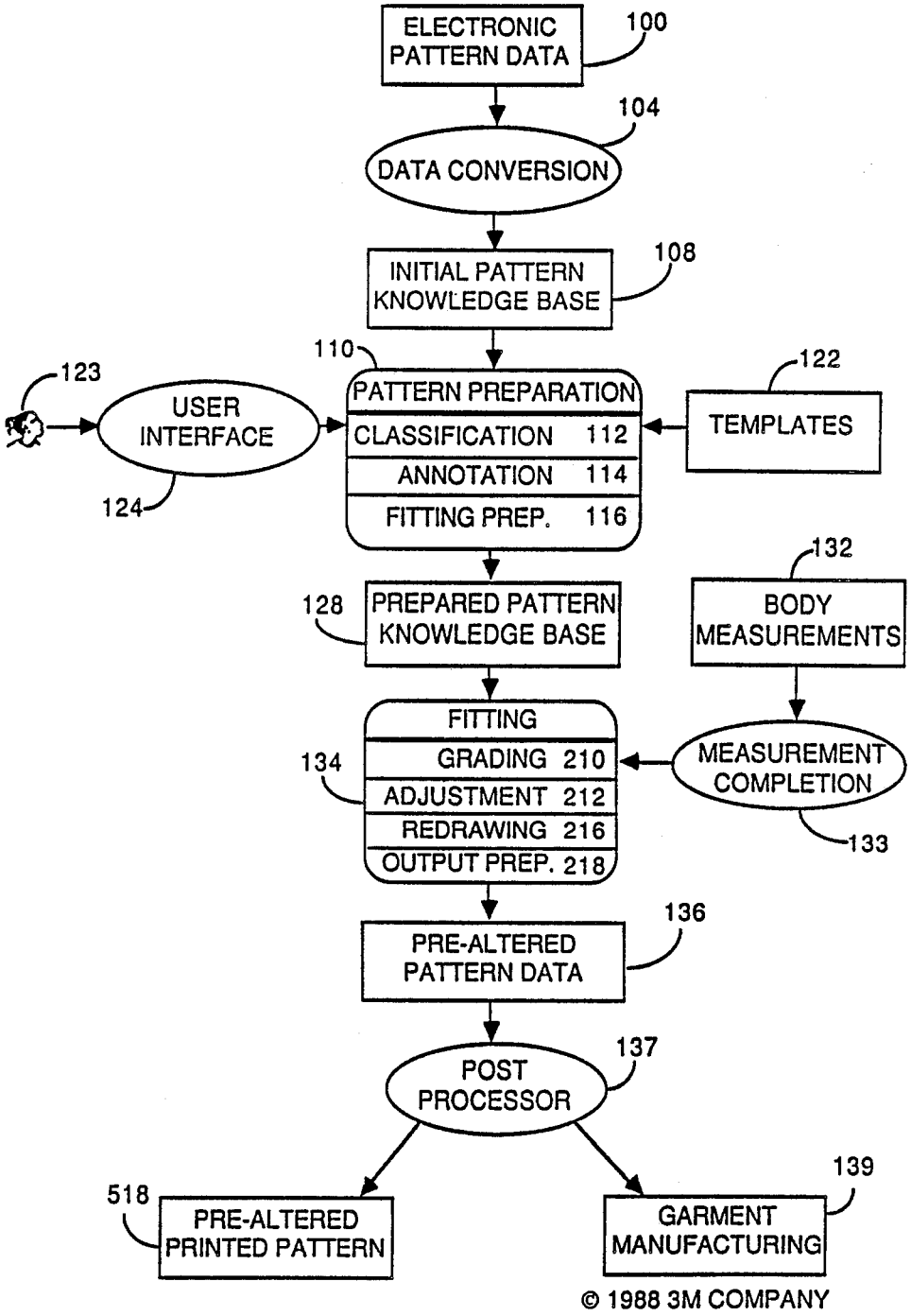

Referring to FIG. 1A, in the preferred embodiment of the present invention data may enter the system in digital electronic form 100. After patterns 100 have been converted to an internal format by a data conversion process 104, a pattern preparation process 110 analyzes, identifies, measures, and prepares them for fitting, and produces a prepared pattern knowledge base 128. This process makes use of a set of templates 122, which contain generic knowledge about typical garments in a variety of styles, and knowledge about components of those garments. Although a major portion of pattern preparation 110 is automatic, certain steps preferably involve human interaction 123; therefore, a user interface 124 is provided. A fitting process 134 may then make use of a prepared pattern knowledge base 128 together with a set of measurements 132 corresponding to an individual person or a standard size to produce pre-altered pattern data 136, a version of the original pattern data which has been altered to fit the body measurements 132 that were used to drive the fitting process 134. This data may then be plotted to produce a printed pattern 518 or used as input to a fabric cutter or a marker making system or some other portion of a garment manufacturing process 139.

Figure 1B:
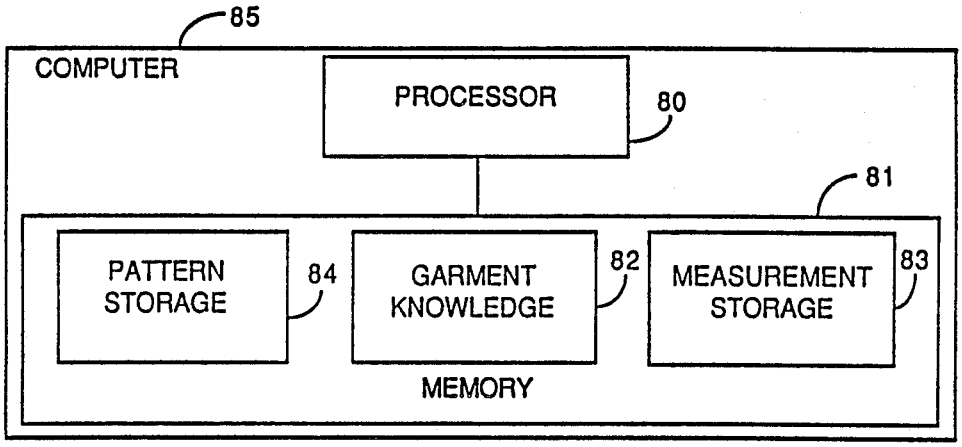

Referring to FIG. 1B, the preferred embodiment operates on a computer 85 comprising a processor 80 with associated memory 81, the latter being subdivided for explanatory convenience into pattern storage 84, garment knowledge 82, and measurement storage 83. Those skilled in the art will recognize that computer memory 81 may be embodied as a combination of internal memory along with fixed and removable mass storage. Those skilled in the art will also recognize that appropriate user interface, input, and output means (not illustrated) are normally provided with such equipment.

One embodiment of the present invention involves a separate pattern preparation system (computer 85 implementing processes 104, 110, and 124 and storing templates 122) that produces a portable data storage structure (removable mass storage 81 or electronically transmitted data structured as prepared pattern knowledge base 128). Such an embodiment could also involve a separate fitting system (computer 85 implementing process 134) that accepts data from the portable data storage structure and produces prealtered garment pattern data based on standard or individual body measurements 132.

As is further described below (see also FIGS. 1A, 1B, and 3), such a separate pattern preparation system, or the pattern preparation portion of an integrated system, could comprise pattern storage means 84 for storing garment pattern data 108 comprising points and lines depicting one or more garments 148, garment knowledge means 82 for storing generic garment knowledge 122 for each of a plurality of garment styles, and processor means (processor 80 implementing processes 104 and 110) for preparing the garment pattern data 100 for modification by relating the generic garment knowledge 122 to the garment pattern data. In such a system, the garment knowledge means could comprise feature description means 82 for storing feature descriptions in templates 676, 685, and 634, and generic constraint means 82 for storing generic constraints in templates 676, 685, 600, 634 and 612. A feature description stored by the feature description means could comprise descriptions of landmarks and other garment features that are expected to be found in garments representative of a garment style. A generic constraint stored by the generic constraint means could comprise algorithms or declarative structures for relating body measurements to changes in one or more of the landmarks and other garment features 154 found in garments representative of the garment style.

Figure 3:
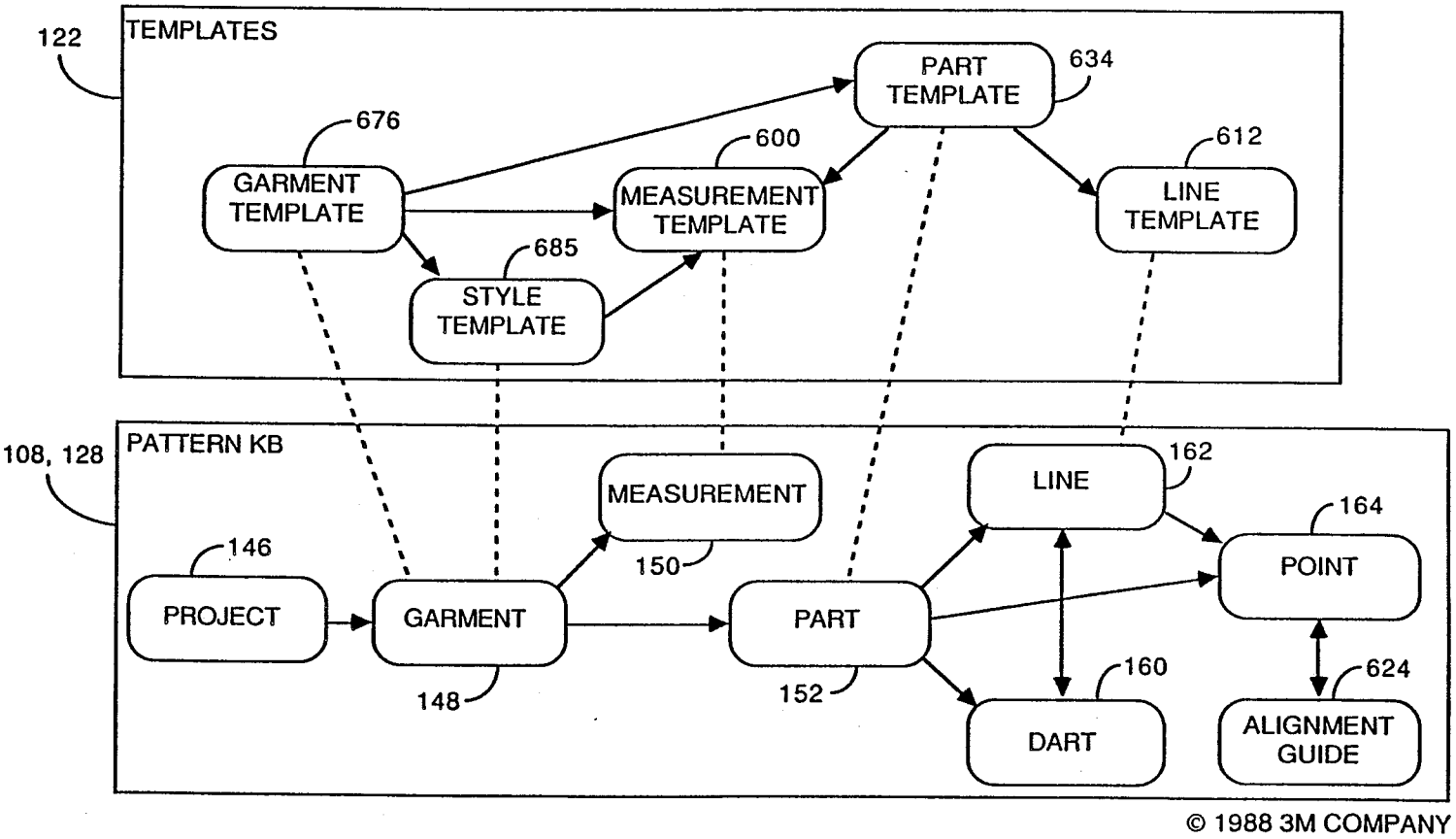

Also as described below, a portable data storage structure (memory 81 structured as prepared pattern data 128) could be used in connection with a variety of computerized systems for manipulation of garment pattern data, in addition to the pattern preparation and fitting systems described herein. Referring to FIG. 3, the system could comprise coordinate data means for storing points 164 and lines 162 depicting a garment, along with garment description means 148 for storing a description of a garment. The garment description means could comprise geometric constraint means (e.g., angle dependencies 384, reshape methods 390, FIG. 8; attached points 403, FIG. 9; to-close 558, FIG. 14; repositioning data 633, FIG. 13) for storing one or more geometric constraints that specify limits on relationships among the points and lines that depict the garment. The garment description means could further comprise measurement means for storing one or more measurement constraints 150 that map the physical dimensions of the garment onto the points and lines and specify relationships between the physical dimensions of the garment and standard or individual body measurements 132.

A separate or integrated fitting system (processor 80 executing process 134) for prealtering garment pattern data 128 based on standard or individual body measurements 132, as described below, could comprise body measurement acceptance means 80 for accepting standard or individual body measurements 132, and pattern acceptance means 80 for accepting prepared garment pattern data 128. The pattern acceptance means could be designed to accept portable data storage structure as described above. A fitting system could further comprise constraint satisfaction means (processor 80 implementing process 134) for producing prealtered pattern data 136 by satisfying the geometric and measurement constraints contained in the prepared pattern data through altering points and lines in the data.

The remainder of this document contains descriptions of the processes of the preferred embodiment and the data or knowledge used by these processes. The section entitled "Process Description" describes in detail the various processes that make up the preferred embodiment, including data conversion 104, pattern preparation 110, and fitting 134. The section entitled "Knowledge Representation", describes the format and contents of preferred pattern knowledge base 128, templates 122, and personal measurements 132.

The following introductory sections describe the conventions used in the subsequent detailed descriptions.

Introduction to Knowledge Representation

Figure 2:
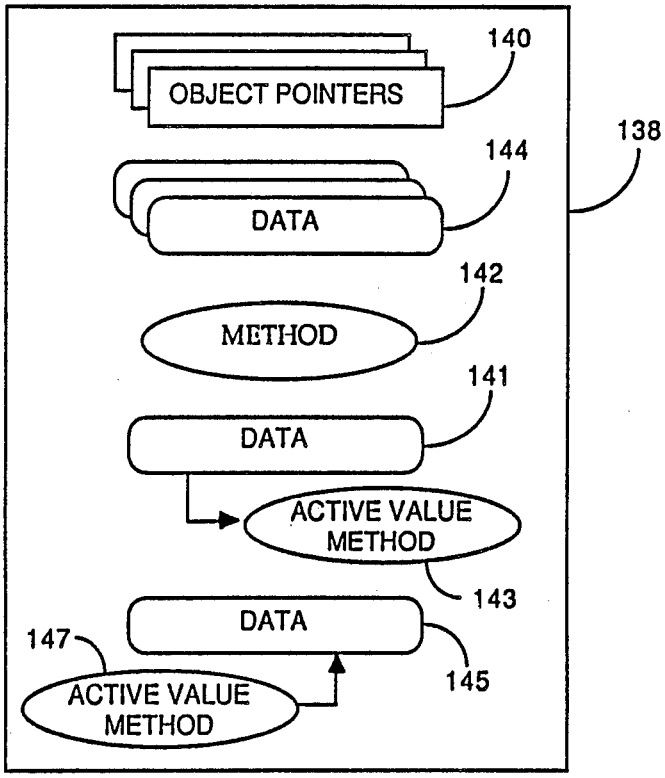

Information and processes in the preferred embodiment of the present system are represented as a collection of objects. The objects of the system, as illustrated in FIG. 2, are organized into classes or object frames 138. Each class object includes a collection of slots. There are three types of slots that may be contained in an object: object pointers 140 (illustrated by rectangles), methods 142 (illustrated by ovals), and data 144 (illustrated by round cornered rectangles).

An object pointer 140 typically points to an instance of a particular class, and these pointers may be used to navigate from one instance to another. For example, to find all the parts 152 in a particular garment 148, an access may be made to the parts slot 314 (see FIG. 5) of the particular garment 148. In the preferred embodiment, parts slot 314 contains pointers to all the part instances 152 belonging to a particular garment.

Methods 142 are illustrated by ovals. As described below, a method may be unique to the class of objects in which it is defined. Thus, a method defined in one object may have the same name, but comprise different code or commands, than a method having the same name which is defined in another object. A good example of this is the method named create which contains unique code for each object class.

Data 144 may be attributes, graphic data, products of methods, or any information which is necessary to the system.

New objects may be created as instances of particular classes. Space for slots, within an instance of a class, is typically automatically reserved when the instance is created. Exceptions are "class slots", also called class method, class data, or class pointer, which exist only in a class, and are not passed on to its instances; for example, a "create" class method may be used to create an instance of a class, but would not be passed on to instances of the class, since there is typically no need to create an instance of an instance. This distinction may be less important in an object-oriented programming system, such as KEE® from IntelliCorp, that does not distinguish between classes and instances.

Referring to FIG. 2, method slots 142 may be automatically filled in when an instance is created from a definition stored in the class level object, although they may be overridden by different definitions in specific instances. Typically, object pointers 140 and data slots 144 are initially filled with any default values that may be present in the class level objects. When no defaults are available, the slots may be empty when the instance is created and may later be filled during the process of producing prealtered patterns.

As previously suggested, each class object typically contains one method in a class slot, called create, which may be invoked to create an instance of that class.

A special kind of method is called a "demon". Two kinds of demons are illustrated in FIG. 2, a "fetch" demon 143, and a "put" demon 147. The typical function of a fetch demon 143 is to filter the data coming out of a slot to which it is attached; an access or "fetch" of the slot does not directly access the slot, but instead sees the value produced by the demon method. This is typically transparent in the sense that accessing the data slot invokes the demon automatically. A put demon 147 normally works in a similar fashion, except that in this case a value placed in a slot may be filtered by a demon method. In other words, writing to a slot that has an attached put demon method normally does not directly write to the slot, but instead invokes the demon method, whose output value is ultimately placed into the slot.

In the preferred embodiment, one or more garments are treated as a project, and a separate set of instances is created for each project and is collected together in a "knowledge base", sometimes called a "pattern knowledge base", "project knowledge base", or "project KB" 128. Such a project KB encapsulates information about a garment or set of related garments, including graphic data representing the individual parts, knowledge about how the garment or garments are intended to fit the body, and knowledge about how various aspects of fitting process 134 apply to the pattern.

FIG. 3 depicts a preferred hierarchical relationship among instances in a project KB and relationships of these instances to templates (further described in the section titled "Knowledge Representation". This may be thought of as a "structural" hierarchy as opposed to an inheritance hierarchy composed of classes and instances. For example, a project 146 contains a collection of garments 148; a garment 148 contains a collection of parts 152; and so forth. In the preferred embodiment, various instances in a project KB contain information that is derived from templates. For example, slots in a part instance 152 that is created to represent a particular pants back part may be filled with data that is derived from information contained in a part template 634 that generally describes pant back parts.

The final section of this document, entitled "Knowledge Representation", includes detailed descriptions of each of the object classes comprising the preferred embodiment. That section includes tables that summarize each of the major preferred knowledge elements and may be used as a resource for the reader, since many of the objects described in the Knowledge Representation section are referred to repeatedly in the Process Description section.

Introduction to Processes

The processes of the preferred embodiment comprise data conversion 104, pattern preparation 110, fitting 134, and post processing 137. The descriptions of these processes in the remainder of this document include pseudo code segments, which are general descriptions of what is contained in the preferred embodiment machine executable code. To better enable understanding of the pseudo code, the pseudo code conventions adopted within this document are listed in Table 18 below.

The actual code of the preferred embodiment is written in the Lisp language; although for the purposes of clarity the pseudo code style chosen for this document does not use Lisp language syntax, the reader is referred to a standard reference on the Lisp language for further explanation of any unusual constructs that may appear in the present description. In particular, the functionality of a Lisp language evaluator is assumed to be available, along with structures that behave like Lisp language symbols, lists, and property lists.

TABLE 18

| Pseudo code example | Meaning |
|---|---|
| [ | The left bracket ([) denotes the beginning of a pseudo code process description. |
| (*This is a comment) | Within pseudo code, comments are enclosed beginning with "(*" and ending with ")". |
| Line:Knots | This syntax is used to refer to slots. The name of the object in which the slot occurs is listed first, followed by the name of the slot. In this example, "Knots" is a slot in the "Line" object. Within pseudo code process descriptions, the first character of slot and object names is capitalized. |
| [define DATA CONVERSION 104 | The word "define" is used to begin a process. It can be read as "define a process as set forth below." The example shown here is the beginning of data conversion process 104. In the pseudo code, process names are capitalized after the word "define". |
| [define LINE:CREATE 381 | This is the beginning of a process for a method. The method, in this example, is found in a "CREATE" slot 381 of a class called "LINE". |
| [define LINE:CREATE 381 (Part, data) | Processes may accept input arguments. An input argument is information passed to a process when it is invoked. Input arguments contain information that is needed by a process. Individual input arguments are separated by commas. This is an example of a method that accepts two input arguments: "Part" and "data". |
| send Line:Create 381 (Part, data) | The word "send" is used to invoke a method that is contained in a method slot. In this example, the method "CREATE" 381 of the "LINE" class is invoked. Two arguments are passed to the method: "Part" and "data". Typically, the values of the input arguments are established prior to invocation and then passed to the invoked process. |
| send Line:Snap 389() | This is similar to the previous example, except that the empty parentheses "()" indicate that there are no input arguments being provided. |
| send self:Update 346 (arg1 arg2) | The term "self" is used inside a method to denote the "current instance", in other words, the object (class or instance) that contains the method being executed. In this case, another method (Update 346) in the same instance is being invoked. |
| self:Garments 300 | Another usage of the word "self" within a method is to refer to slots in the current instance in order to fetch or set their values. In this case, a method has been invoked in some instance that contains a slot called "Garments", and that slot is what is referred to here. |
| invoke Classification | The word "invoke" is used to invoke a process that is not contained in a method slot. When a process is contained in a method slot, the word "send" is used, as described above. |
| create Line instance from Line class 162 | The word "create" is used with the word "instance" in the manner shown here when an instance of a class is created. In this example, an instance of the Line class 162 is created. |
| for each known size fill in slot Line:Knots | The word "for" is used to denote a loop. All the items indented below the "for" are executed within the loop. |
| if this is a perimeter line set perimeter flag else do not set the perimeter flag | The word "if" is used to denote conditional execution. When the condition following the "if" is true, all items indented are executed. When the condition is not true the items indented after the word "else" are executed. The "else" section is not always present. |
| dart-to-close.rotation | The notation x.y is used to refer to a component y of a record x. In this example, a to-close record may contain components <pivot rotation translation>, in which case "dart-to-close.rotation" refers to the second component. |
| ] | The right bracket (]) marks the end of a process. |

PROCESS DESCRIPTIONS

As illustrated in FIG. 1A, the main processes in the preferred embodiment of the present system are data conversion 104, pattern preparation 110 (comprising classification 112, annotation 114 and fitting preparation 116), fitting 134 (comprising grading 210, adjustment 212, redrawing 216 and output preparation 218), and post processing 137. Each of these preferred processes is described in detail in the following sections.

DATA CONVERSION 104

Introduction

The first preferred process in creating a prealtered pattern, as illustrated in FIG. 1A, is data conversion 104. The purpose of data conversion in the preferred embodiment is to accept and store electronic pattern data 100 and convert them to an initial pattern knowledge base 108 (also called a pattern KB or a project KB) which can be processed by preferred pattern preparation process 110. The electronic pattern data 100 as described herein is typically substantially devoid of information relating the data to body measurements, and may be nothing more than raw coordinate data describing points and lines.

Preferred data conversion process 104, as illustrated in FIG. 31, creates instances of project 146, garment 148, part 152, line 162, point 164, and alignment guide 624 classes and fills appropriate slots with information obtained from the electronic pattern data; most of the slots residing in the created instances are not filled during data conversion, but are filled later during pattern preparation.

In the preferred embodiment, electronic pattern data 100 is the only input argument to data conversion 104, which can be described with pseudo code as follows:

```
[define DATA CONVERSION 104 (electronic pattern data 100)
create knowledge base 108 for this project
send Project:Create 301 (electronic pattern data 100)]
```

© 1988 3M Company

In the current implementation of the system, data conversion process 104 creates a pattern knowledge base, creates instances to populate that knowledge base, and fills slots in newly created instances based on information that is contained in electronic pattern data 100, which is described in the following section.

Electronic Pattern Data Contents

The primary contents of the electronic pattern data are typically raw line and point coordinate (x,y) information. An example of raw (x,y) data is illustrated in FIG. 29. Each of the lines and points which make up a pattern part is entered as a set of (x,y) coordinates. As an example, the system creates a line instance for line 870, as illustrated in FIG. 29, that includes all the (x,y) positions required to form the desired curve. Separate point instances are preferably created to represent the two endpoints: one at point 871 and one at point 872, and a separate alignment guide instance is preferably created to represent double notch 873 which falls on the line 870.

One preferred structure of electronic pattern data is illustrated in Table 19. Optional information is enclosed between angle brackets (<optional data>). For example, header information is always present in the electronic pattern data of the preferred embodiment, but the description (<Description>) is optional. The asterisk (*) in the table below indicates when a structure may be repeated in the pattern data. For example, garment data blocks, part data blocks, line data blocks and alignment guide data blocks may be repeated.

TABLE 19

| Information Type | Structure |
|---|---|
| Header information | Name |
| | <Description> |
| | Known Size |
| <Garment Data Block>* | <Name> |
| Part Data Block* | <Name> |
| | <Garment association> |
| | Line Data Block* |
| | (x,y) positions for each of the known sizes |
| | on-the-perimeter flag |
| | <Name> |
| | <Alignment Guide Data Block>* |
| | Type |
| | (x,y) position of alignment guide |
| | Plotting Information |

Project Creation

Figure 4:
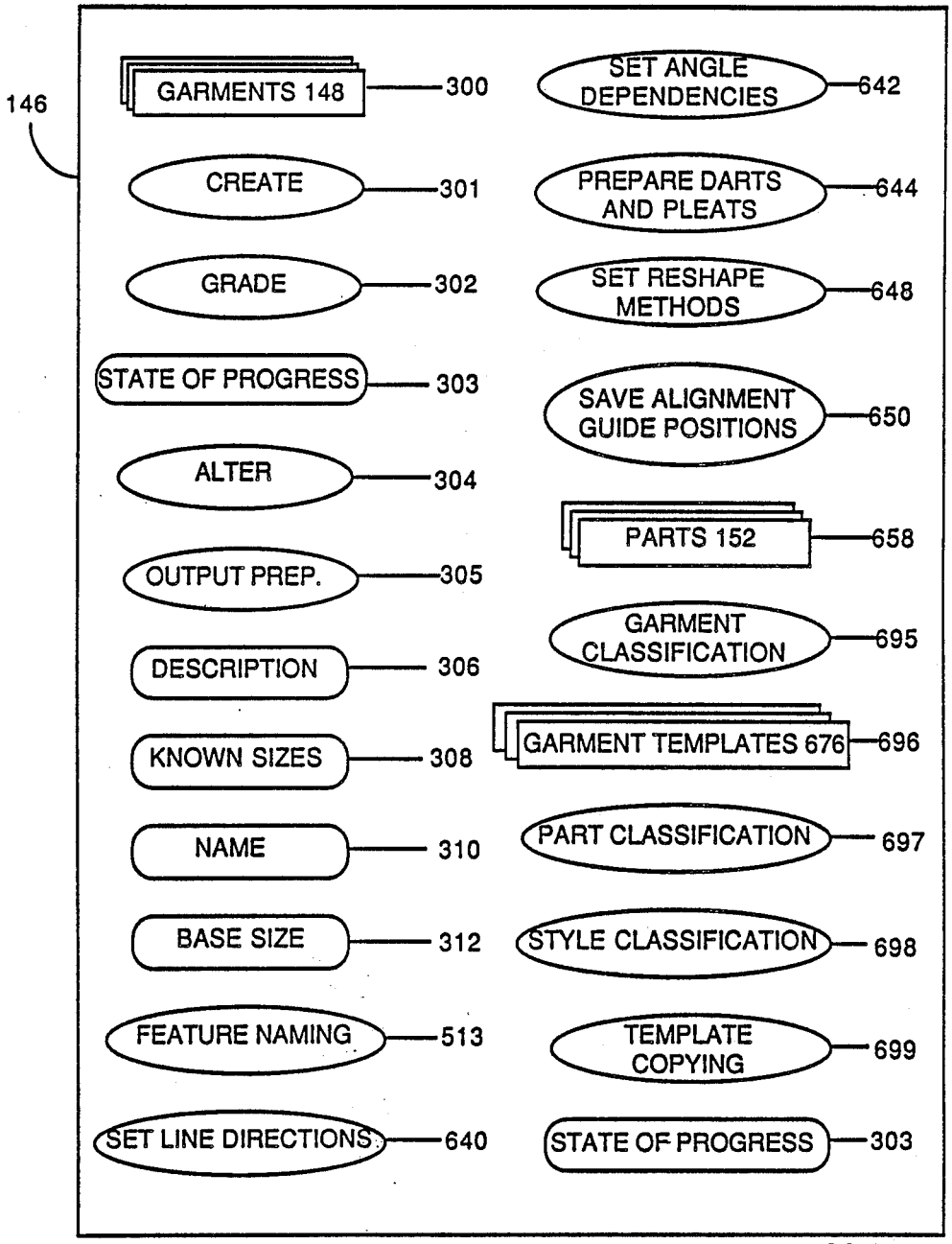

The main function of the preferred data conversion process, as is indicated by the pseudo code above, is to invoke create method 301 of project class 146 (see FIG. 4). As indicated by the pseudo code which follows below, create method 301 creates a project instance for a particular project and invokes other create methods to create garment and part instances. Electronic pattern data 100 is used as the source of information when creating a new project. Pseudo code for creating a project can be described as follows:

```
[define PROJECT:CREATE 301 (electronic pattern data 100)
create a Project instance from Project class 146
read electronic pattern data header information (see Table 19)
fill in slot Project:Description 306 if available from the
header information
fill in slot Project:Known Sizes 308 from the header information
fill in slot Project:Name 310 if available from the header
information
fill in slot Project:Base Size 312 with base size of project from
header information while there are blocks of data to read
read a data block (a data block either describes a garment or
a part)
if the data block describes a garment
send Garment:Create 319 (garment name)
if the data block describes a part
send Part:Create 343 (part data block)]
```

© 1988 3M Company

Garment Creation

As indicated by the pseudo code above, a create method 319 of the garment class 148 (see FIG. 5) is preferably invoked each time a data block for a garment is encountered. When no garment data blocks are included in electronic pattern data 100, garment instances are typically created later during classification process 112.

Create method 319 creates a garment instance in the current project. When a garment name is included as an input argument to the create method, it is stored in name slot 330 of the garment instance. Otherwise, the name slot is filled later during classification process 112.

```
[define GARMENT:CREATE 319 (garment name)
create a Garment instance from Garment class 148
if garment name is provided, then
fill in slot Garment:Name 330 with contents of input argument
fill in slot Garment:Part-Of 332 with pointer to the current
Project instance add newly created Garment instance pointer to
the slot Project:Garments 300]
```

-continued

© 1988 3M Company

Part Creation

Preferred electronic pattern data 100, as is illustrated in Table 19, includes information about each part of the project. Typically, this includes coordinate positions of the points, lines and alignment guides in each part. Additionally, the electronic pattern data may include part names, which garment a particular part is a part of, and line names. When these data items are not available in the electronic pattern data, they are preferably filled in during classification process 112 and annotation process 114.

Coordinate positions in electronic pattern data 100 may be provided for a number of different sizes. In this case, a known sizes slot 308 in project 146 preferably contains a list of the sizes for which data are provided. Alternatively, data may only be provided for one size in which case known sizes slot 308 contains only a single size. During preferred fitting process 134, a grade process 210 either uses coordinate data for one of the known sizes or derives new coordinate positions by grading from a single known size.

As implemented in the present system, a create method 343 (see FIG. 6) for a part accepts an input argument that includes information from the electronic pattern data pertaining to a particular part (e.g., part data block). Pseudo code for create method 343 can be described as follows:

```
[define PART:CREATE 343 (part data block)
create a Part instance from Part class 152
add newly created Part instance pointer to slot Project:Parts 658
fill in slot Part:Name 354 when available in part data block
if garment association is known from part data block
add a pointer to the particular Garment instance to slot Part:
Part-of 336
add the newly created Part instance pointer to slot Garment:Parts 314
for each line in the part data block
read line data
send Line:Create 381 (Part, line data)
for each alignment guide in the part data block
read alignment guide data
send Alignment Guide:Create 626 (Part, alignment guide data)]
```

© 1988 3M Company

Line Creation

Figure 6:
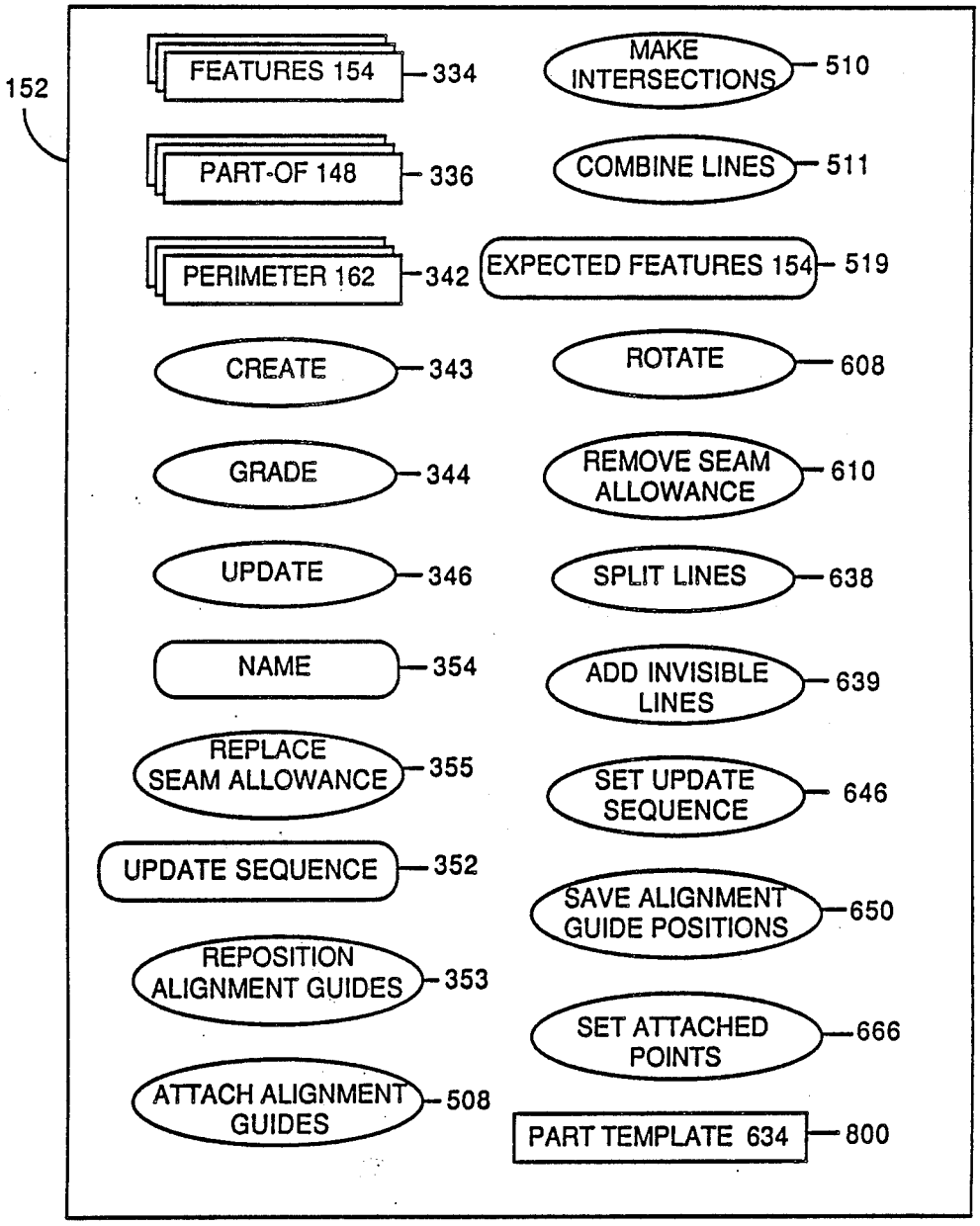

In the preferred embodiment, a line instance 162 (see FIG. 8) is created for each line in a part 152, and a pointer to each line instance is stored in a features slot 334 in the part (see FIG. 6). As implemented, a line is represented by a series of (x,y) positions for each of the known sizes 308 of a project (see FIG. 4); separate point instances 164 are created for each point of a line; and pointers to these point instances are stored in features slot 334 of the part. The following pseudo code segment creates line information for a particular part and accepts a pointer to a particular part instance 152 (see FIG. 6) and line data from the electronic pattern data 100 as input arguments:

```
[define LINE:CREATE 381 (Part, line data)
create a Line instance from the Line class 162
for each point in the line data
get point position data from line data
```

-continued

```
send Point:Create 399 (position data, Part, Line)
for each known size in Project:Known Sizes 308
fill in slot Line:Graded Data 383 with points of the line data
fill in slot Line:Part 364 with pointer to a particular part (Part input
argument)
if this is a perimeter line as indicated in the line data input argument
set perimeter flag in slot Line:Attributes 362
fill in slot Part:Name 354 when available in line data
add newly created line instance pointer to the Part:Features
334 slot]
```

© 1988 3M Company

Alignment Guide Creation

In the preferred system, an alignment guide instance 624 (see FIG. 13) is created for each alignment guide in a particular part. As is the case with the points of a line, a separate point instance is preferably created for each alignment guide. Alignment guide information typically includes type (e.g., double notch) and plotting information. Plotting information preferably provides (x,y) coordinate data for plotting a particular alignment guide marking on the pattern part. Alignment guide plotting is further described in post processing 137. The following pseudo code creates alignment guide information using a pointer to a particular part instance 152 (see FIG. 6) and alignment guide data, read from electronic pattern data 100, as input arguments:

```
[define ALIGNMENT GUIDE:CREATE 626 (Part, alignment guide
data)
create an Alignment Guide instance from the Alignment Guide
class 626
fill in slot Alignment Guide:Name 360 from alignment guide
type data
fill in slot Alignment Guide:Plotting Information 628 from
alignment guide data
read position data from alignment guide data
(*a point instance is created without an association to a specific line)
send Point:Create 399(position data, Part, <no line reference>]
```

© 1988 3M Company

Point Creation

Figure 9:
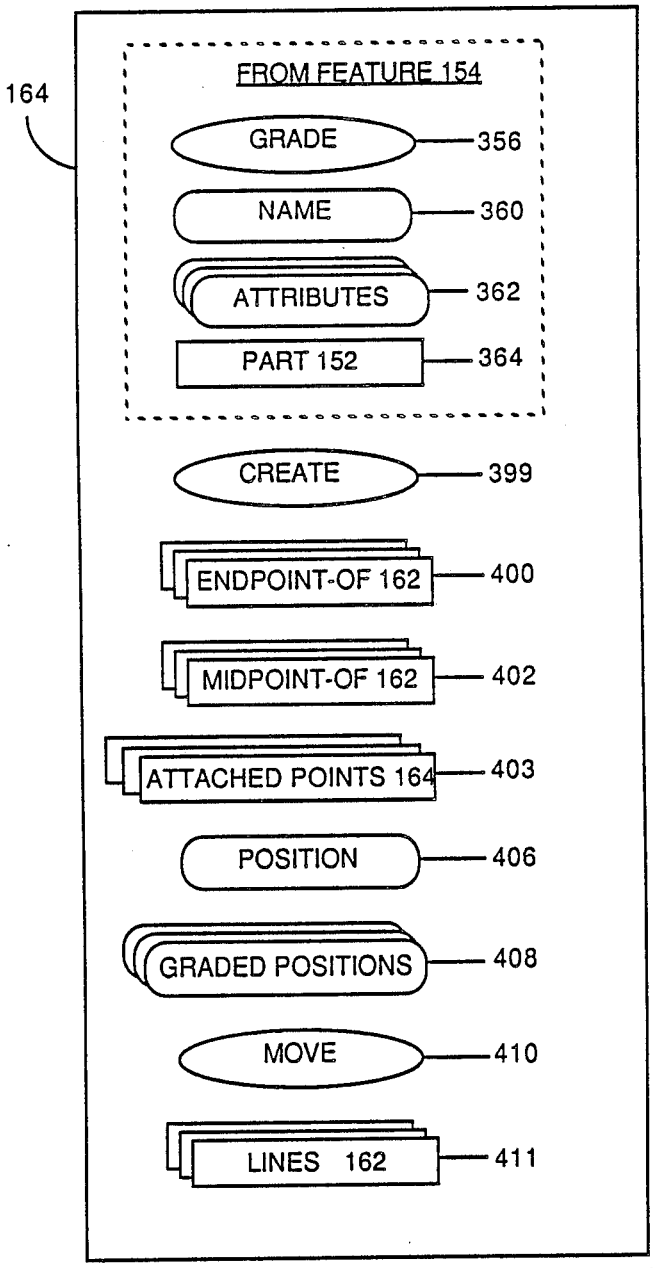

As indicated in the pseudo code segments above, lines and alignment guides may be created by invoking a create method 399 to create point instances 164 (see FIG. 9). In the case of lines, the preferred system creates a point instance for each point which, in turn, contains references to a specific line. A point instance and an alignment guide instance are typically created for each alignment guide. During data conversion, an alignment guide does not normally contain any references to a specific line. Alignment guides are preferably attached to specific lines as part of pattern preparation process 110.

Figure 8:
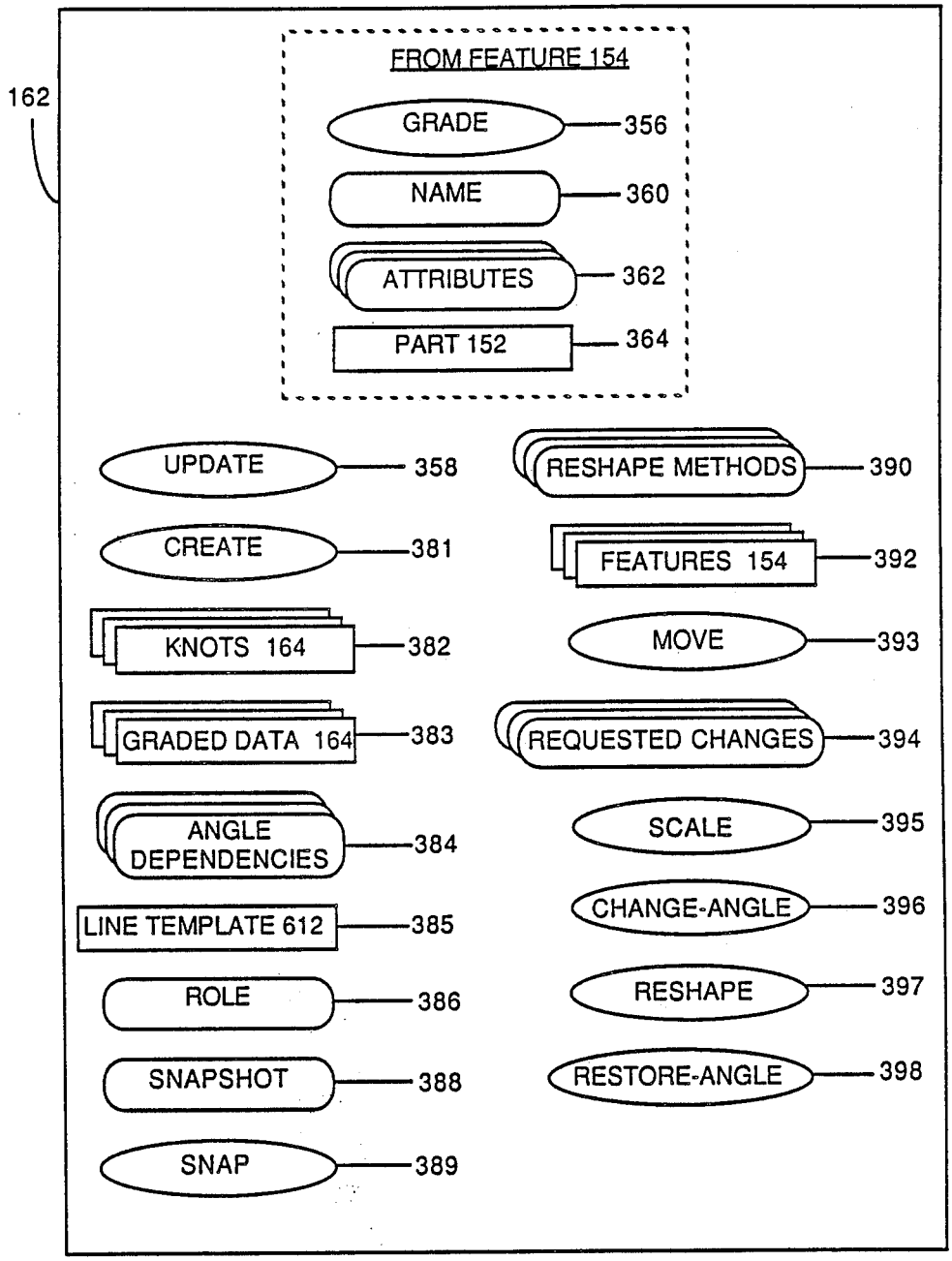

In the preferred embodiment, the method to create points accepts three input arguments: the (x,y) position of the point for each known size (position data), a pointer to the part instance that the point is a part of (Part 152, FIG. 6), and an optional pointer to the line instance that the point is a part of (Line 162, FIG. 8). Pseudo code for creation of point instances can be described as follows:

```
[define POINT:CREATE 399 (position data, Part, Line)
create a Point instance from the Point class 164
for each known size in slot Project:Known Sizes 308
fill in slot Point:Graded Positions 408 with position data for the
```

-continued

```
size
fill in slot Point:Part 364 with the pointer to a particular Part
instance
if there is a Line association as indicated by the input argument "Line"
add the Line instance pointer to the slot Point:Lines 411
add newly created Point instance pointer to Part:Features 334]
```

© 1988 3M Company

Summary of Data Conversion

At this point in the preferred system, an initial pattern knowledge base 108 has been created and contains a single project instance representing one or more garments, a collection of part instances, and a set of line, point and alignment guide instances for each part. Garment instances may have been created when included in the electronic pattern data 100. The slots containing graphic coordinate information (x,y) are typically filled, but the remaining slots are likely to be empty unless specified in the electronic pattern data. Likewise, garment instances may not have been created during data conversion.

The next preferred process in prealtering patterns is pattern preparation 110. In the preferred embodiment, pattern preparation begins with initial pattern knowledge base 108, created in data conversion, and completes the knowledge base description by filling in the remaining slots needed by fitting process 134.

PATTERN PREPARATION 110

Introduction

In the preferred embodiment, the purpose of pattern preparation (see FIG. 34) is to transform raw pattern data contained in an initial pattern knowledge base 108 into a prepared pattern knowledge base 128 that contains the knowledge needed for fitting process 134 to produce prealtered patterns. The process of transforming raw pattern data into a prepared pattern knowledge base operates in the current system by selecting an appropriate set of generic garment knowledge (templates 122) for a project and then applying the selected generic garment knowledge to the raw pattern data by identifying important landmarks and other garment features and then applying various prealteration constraints.

In the current implementation of the system, generic garment knowledge is stored in templates (garment templates 676, style templates 685, part templates 634, line templates 612, and measurement templates 600) and is structured to contain feature descriptions that generically describe landmarks and other garment features that are expected to be found in garments representative of a garment style, and to include a description of generic constraints comprising algorithms or declarative structures for relating body measurements to changes in the landmarks and other garment features in garments representative of a garment style. The reader is directed to the section entitled Knowledge Representation for a complete description of the knowledge preferably contained in these templates.

Process Organization

In the current implementation, pattern preparation is divided into three processes: classification 112, annotation 114, and fitting preparation 116. Each of the three processes embodied in the preferred pattern preparation process performs specific steps to modify the initial knowledge base in some way and then passes the resulting modified knowledge base (KB) to the next process.

Preferred classification process 112 is concerned with identifying a garment type and corresponding styles for each of the garments in a project; the identification of garment type and styles provides means for selecting a set of templates from generic garment knowledge that pertains to each specific garment. Annotation process 114 preferably includes feature identification means for identifying the points and lines in the raw pattern data that correspond to the features described in the selected templates. Preferred fitting preparation process 116 is primarily concerned with deriving physical measurements for each garment in a project and then applying generic constraints described in the selected templates to the specific features identified during annotation process 114, resulting in prealteration constraints. Both the generic constraints and the prealteration constraints preferably described how to prealter garments by altering various garment features based on a comparison between physical garment dimensions and body measurements; generic constraints typically refer to landmarks and other garment features in an abstract way, while prealteration constraints typically refer directly to specific points and lines in a particular garment pattern.

Pseudo code representing pattern preparation can be described as follows:

```
[define PATTERN PREPARATION 110 (initial pattern KB 108)
invoke Classification 112 (initial pattern KB 108)
invoke Annotation 114 (classified pattern KB 500)
invoke Fitting Preparation 116 (annotated pattern KB 502)]
```

© 1988 3M Company

Subsequent sections provide a more detailed description of the three processes invoked during preferred pattern preparation process 110.

User Interaction During Pattern Preparation

As is described in the section entitled User Interface 124, a system user may interact with the system in order to complete the first two steps of preferred pattern preparation process 110 (namely, classification 112 and annotation 114). In the preferred embodiment, the strategy employed with regard to user interaction is for the system to automatically derive as much information as possible and then ask for verification and for missing information from a system user. When information cannot be automatically derived, the system user is normally asked to provide a minimum amount of missing information so that the system may continue to automatically derive additional information. In the preferred embodiment, after classification and annotation are complete, all the information required to complete the preparation of a pattern knowledge base is available for the system to complete without user interaction. The final step of the current pattern preparation process is fitting preparation 116 which, in the current implementation, performs without user interaction.

A user may save a project that is not completely prepared and then resume preparation activities at a later time. Throughout the pattern preparation process, the preferred system maintains status information for each project that includes information about the completion status of a project. For example, one project may be classified and ready for annotation, another may be partially through the steps required to complete annotation, while a third may be complete and ready for fitting process 134.

Summary of Pattern Preparation

Preferred pattern preparation process 110 produces a prepared pattern knowledge base 128 from an initial pattern knowledge base 108. Because this process involves a large number of steps, pattern preparation is preferably divided into three areas of processing. The first of these preferred steps, classification 112 and annotation 114, include interaction with a system user to verify system derived information and to supply data that can not be automatically derived by the system. In the preferred embodiment, the last step of pattern preparation, fitting preparation 116, completes the pattern knowledge base without user interaction based on the information derived during classification and annotation.

The upcoming sections contain detailed descriptions of the preferred pattern preparation process.

CLASSIFICATION 112

Introduction

In the preferred embodiment, the purpose of classification process 112 (see FIG. 18) is to begin with an initial pattern knowledge base, as provided by data conversion process 108, and to produce a classified pattern knowledge base 500 in which one or more garments and parts within a project are classified by type (e.g., a garment type of pants or skirt, a part type of front or back), parts are collected together to form one or more garments, and garments are identified with measurements and features useful in prealtering each garment within the project to standard or individual body measurements. Subsequent preferred processing by annotation process 114 and fitting preparation process 116 completes the description of the pattern knowledge base, which is eventually used in a fitting process to prealter each garment.

Although each garment or part within an initial pattern knowledge base 108 may or may not have a name associated with it, the generic type of each garment or part may not have been classified in a manner general enough to be useful to the preferred system. For example, bloomers and knickers may need to be generally identified as pants so that fitting processes related to pants can be applied to them.

In the current implementation of the system, the way in which classification is able to classify garment and part types is through knowledge that is resident in garment templates, part templates, and style templates. The following section describes the role that these templates play in the current system during the process of classification.

Templates

In the preferred embodiment, information about each basic garment type is stored in garment templates 676 (see FIG. 10 and Table 8), with each garment template being identified by a name contained in a type slot 677. For example, basic garment types of pants, skirt, and bodice could be used as the name in type slot 677 for templates corresponding to such garment types. As implemented in the present system, a garment template corresponds to a basic garment, referred to as a "sloper" by the garment industry, that is typically a plain garment without pleats, collars, cuffs and so forth.

A pattern designer typically adds various style elements and design ease to a basic garment (sloper) to create a new design. Design ease, a term used to described the extra fabric added to a basic sloper to create a desired style, does not affect the classification process of the present system; the way in which design ease is processed in the current system is described in fitting preparation 116.

In addition to design ease, a pattern designer may style a pattern by adding style elements. A style element, as implemented in the current system, is either a part added to a garment (such as a pocket) or a characteristic of a part (such as a mid-calf-length skirt). In the preferred embodiment, information about each style element is contained in a style template 685 (see FIG. 19 and Table 14).

A collection of part templates 634 is also resident in the current system. Each part template 634 (see FIG. 12 and Table 13) contains generic part knowledge and may be identified by its type based on the contents of a type slot 660. A part's type may consist of a part name (e.g., back) and an optional garment type (e.g., pants). When a garment type is included in a part's type slot 660, the part template typically applies only to parts of a particular garment. When there is not a garment type included, a part template typically applies to all parts of a specific type for all garment types. For example, a part template for a pants back may include both "back" (part name) and "pants" (garment name), since the information associated with a pants back part is different than the information for other garment back parts, e.g., a bodice back part. By way of a contrasting example, a part template for a straight waistband in the preferred embodiment does not include a garment name, since all straight waistbands in the current system contain the same information.

In the preferred embodiment, the important measurements needed by fitting process 134 are listed in templates. Each garment template (FIG. 10 and Table 8) includes a list of measurements that are important for the fitting of a particular basic garment (e.g., a garment template whose type is "pants" may include a "waist circumference" measurement). Each style template 685 (FIG. 19 and Table 14) may also include a list of measurements that are important for fitting. For example, a style element of type "full length" may include a "waist to floor" measurement. Further, part templates 634 (FIG. 12 and Table 13) may include a list of measurements that are important for the fitting of that part. For example, for a garment that has a waistband, a part template 634 having a type "waistband" would normally include a "waistband" measurement in slot 692.

As will be described in the remainder of this section, a primary function of the preferred classification process is to match garments and parts to their corresponding templates and to identify which styles are included in each garment; after the appropriate templates are identified, the information contained in the templates may be used to provide the basis from which information is derived for the fitting process.

In the current embodiment of the system, classification process 112 is divided into four steps: garment classification, part classification, style classification, and template copying and can be described by the following pseudo code:

```
[define CLASSIFICATION 112
(*Invoke each of the four constituent processes)
send Project: Garment Classification 695
send Project: Part Classification 697
send Project: Style Classification 698
send Project: Template Copying 699]
```

© 1988 3M Company

Garment Classification

In the preferred embodiment, the purpose of the garment classification step is to identify the types of garments in a project by associating each garment with a particular garment template. Garment classification attempts to complete the classification automatically based on available descriptions and then elicits missing information and verification from the system user.

In the present system, garment classification begins by analyzing the description of a project. When electronic project data 100 includes a project description, it is typically contained in a description slot 306 of project instance 146. The project description contained in description slot 306 of each project instance is normally a textual description of the garments in the project. For example, a project description is customarily printed on the back of a prior art pattern envelope or in pattern or garment catalogs. An example of a project description is:

> "Straight skirt, below mid-knee or tapered pants have waistband and back zipper. Skirt: back slit. Pant: front pleats and side pockets. Purchased top and belt."

When a project description is not available, one may be elicited from the system user.

Each garment and style element template preferably contains a list of identifiers used to match words and phrases of a project description. For example, a garment template 676 (FIG. 10 and Table 8) whose type slot 677 contains the name "pants" may include "pants", "shorts", "slacks", and "culottes" in identifiers slot 678. If, in an implementation of the current system, there are two garment templates, one containing the word "skirt" and another containing the word "pants" in identifier slot 678, the system would identify two garments from the above project description (a "pants" garment and a "skirt" garment) for this project.

After the system matches garment template identifiers to the project description, the system user may be asked to verify the system derivation. Verification may include adding new garments, removing system derived garments, and correcting system mismatches between garments and garment templates. In the current implementation of the system, a garment instance 148 is created for each garment type identified, and each created garment instance is associated with one of the garment templates 676.

In the preferred embodiment, classification occurs at the project level, and the method used to classify garments is contained in a slot 695 (see FIG. 4), which can be described by the following pseudo code:

```
[define PROJECT:GARMENT CLASSIFICATION 695
(*Project description)
if there is not a description in Project:Description 306
elicit description from system user
```

-continued

```
fill in slot Project:Description 306 with user provided description
(*Match project description to Garment Template identifiers)
for each Garment Template 676
for each identifier in Garment Template:Identifiers 678
if identifier is in Project:Description 306
add Garment Template to Project:Garment Templates 696
(*System user verification)
present list of Project:Garment Templates to system user
for verification
allow user to change or remove from, add to and change the list
store all changes in slot Project:Garment Templates 696
(*Create Garment instances. Create method 319 is described in
Data Conversion)
for each Garment Template in Project:Garment Templates 696
let type be the contents of slot Garment Template:Type 677
send Garment:Create(type)319
fill in slot Garment:Garment Template 802 with pointer to this >>
Garment Template 676]
```

© 1988 3M Company

Part Classification

When all garments of a project are classified and garment instances created, the next step in the preferred embodiment is to classify each part in a project in order to associate each part instance with a particular part template and to associate each garment instance with its constituent parts.

In the preferred embodiment, each garment template 676 represents a basic garment which is typically comprised of a minimum set of parts expected to be found in garments of a particular type. For example, a basic pants garment normally includes a front part and back part. As implemented in the present system, each garment template 676 includes an expected parts slot 679 which contains a list of pointers to related part templates 634, and this list is used to represent a minimum set of parts that comprise a particular garment.

The first step of the preferred part classification process is to identify the project parts that correspond to the expected part templates of each garment and to associate those parts to their corresponding part templates and garments. Each part template in the system as implemented contains in an identifiers slot 690 a list of identifiers which are typically words and phrases that are associated with parts of a particular type. When part names are available, as provided during data conversion, the system preferably attempts to automatically match the minimum set of parts listed for each garment to their corresponding part template by matching part names to the words and phrases contained in identifiers slot 690. When part names are not available, they are preferably elicited from the system user.

At this point, there may still be project parts, outside of the minimum list of expected parts, that are not matched to garments and part templates. A next step of part classification is preferably to involve the system user in completing the matching of parts to garments and to part templates. A list of parts that have not been matched is preferably presented to the system user. For each unmatched part, the system user may then match the part to one of the project garments.

To complete part classification, each part may be presented to the system user along with its current part template association. The system user may then verify that each part is properly matched to its corresponding part template; additions and changes may also be accepted from the system user at this time.

In the preferred embodiment, a method to classify parts of a project is contained in a part classification slot 697, which can be described by the following pseudo code:

```
[define PROJECT:PART CLASSIFICATION 697
(*Try and match expected parts)
for each Garment 148 in Project:Garments 300
for each Part Template 634 in (Garment:Garment Template):
Expected Parts 679
if name in any Project:Parts 658 match Part Template:Identifiers 690
fill in slot Part:Part Template 634 with Part Template
add Garment to slot Part:Part-of 336
add Part to Garment:Parts 314
else
add Part Template 634 to list for user to identify
(*Ask user to provide missing expected parts)
for each Part Template 634 for the user to identify
ask user to find the Part corresponding to Part Template:Type 660
fill in slot Part:Part Template 800 with Part Template 634
add Garment to slot Part:Part-of 336
add Part to Garment:Parts 314
(*Complete part-to-garment matching)
for each Part in Project:Parts 658
if there is not an entry in Part:Part-of 336
ask user to find the Garment(s) to which this Part belongs
for each Garment 148 identified by the system user
add Garment to slot Part:Part-of 336
add Part to Garment:Parts 314
(*Complete part-to-part template matching.)
for each Part 152 in Project:Parts 658
present system user with list of part names from Part:
Name 354 and >>
part template types from (Part:Part Template):Type 660
ask user to fill in missing part names and part template types
ask user to verify the accuracy of all data and make
changes as needed]
```

© 1988 3M Company

Style Classification

After garments and parts are classified, a next step in the preferred embodiment is to identify the style elements that pertain to each of the garments. To find styles, the current system re-analyzes the phrases of the project description. Using the same project description example above, the phrases: "mid-knee" "waistband" "back zipper" "front pleats" and "side pockets" match identifiers that are stored in various style templates.

When a phrase of a project description matches an identifier of a garment's possible style template, that style may then be associated with the particular garment. When the present system has completed associating styles with garments based on the project description, the system user is typically presented with the derived information; from this point, the system user normally verifies the derived associations and modifies the information as needed.

In the preferred embodiment, a style classification slot 698 (FIG. 4) contains a method to classify styles for a project and can be described by the following pseudo code:

```
[define PROJECT:STYLE CLASSIFICATION 698
(*Try and match styles to garments based on the project description)
for each Garment 148 in Project:Garments 300
for each Style Template in (Garment:Garment Template):
Possible Styles 680
for each identifier in Style Template:Identifiers 686
if identifier matches phrase in Project:Description 306
add Style Template to Garment:Style Templates 801
(*Ask user for verification and allow for changes)
present styles for each garment
if user changes information
```

-continued

```
update slot Garment:Style Templates 801 by either >>
1. removing an entry or >>
2. adding an entry]
```

© 1988 3M Company

Template Copying

At this point, each garment within a project in the preferred embodiment has a pointer to its corresponding garment template and pointers to the styles and parts that are contained in the garment, and each part has a pointer to its corresponding part template and to the garments in which it is a part (part-of slot 336, see FIG. 6). In the current system, the next step of classification is to copy information from the template objects to the garment and part instances in the pattern knowledge base. It will be recognized by those skilled in the art that the process of copying template information is a preferred approach to facilitate greater performance by a subsequent process. An alternate approach is not to copy template information, whereby a subsequent process (e.g., a fitting process) would retrieve template information as needed.

There are two types of information that are typically copied at this time: measurements and expected features. Each garment, style and part template preferably contains a slot called measurements, with each measurements slot containing a list of measurement templates corresponding to physical dimensions of garments that are important to the prealteration of garments of a given type and to the prealteration of garments that contain particular parts and styles. The list of measurement templates important to the prealteration of a particular garment, as implemented in the current system, is the collection of the important measurement templates found in a garment's parts, styles and corresponding garment template.

A second type of information typically copied at this time from template information is expected features. An expected feature may include a name and a feature type (e.g., line or point; see also FIG. 3). Each garment template typically includes expected features that may be found in any of a particular garment's parts. Each style template may also contain a list of expected features. Expected features, which may be declared in a style template, sometimes correspond to a part name. In the absence of a part name, an expected feature is typically found in any part of a particular garment with that style. Accordingly, each part template may contain a list of expected features that are expected to be in a particular part.

In the preferred embodiment, expected features that may be found anywhere on a garment are copied to an expected features slot 521 of the corresponding garment instance, and expected features associated with a particular part are copied to an expected features slots 519 of the particular part instance.

A typical method to copy template information may be contained in a template copying slot 699 and can be described by the following pseudo code:

```
[define PROJECT:TEMPLATE COPYING 699
(*Collect important measurements for each Garment)
for each Garment 148 in Project:Garments 300
collect (Garment:Garment Template):Measurements 681
for each Part 152 in Garment:Parts 314
```

-continued

```
collect (Part:Part Template):Measurements 692
for each Style Template 685 in Garment:Style Templates 801
collect Style Template:Measurements 688
fill slot Garment:Measurements 316 with collected measurements
(*Find the expected features from each Garment Template 676)
for each Garment 148 in Project:Garments 300
for each feature in (Garment:Garment Template):
Expected Features 682
add feature to Garment:Expected Features 521
(*Find the expected features from each Style Template 685)
for each Style Template 685 in Garment:Style Templates 801
for each feature in Style Template:Expected Features 687
if feature includes a Part Template association
find Part instance 152 corresponding to specified Part Template 634
add feature to Part:Expected Features 519
else
add feature to Garment:Expected Features 521
(*From Part Templates)
for each Part 152 in Project:Parts 658
for each feature in (Part:Part Template):Expected Features 691
add feature to Part:Expected Features 519]
```

© 1988 3M Company

Summary of Classification

Preferred classification process 112 classifies each garment and part of a project and collects parts together to form garments, and the important measurements and expected features are identified and copied to their respective garment and part instances. In the preferred embodiment, the next step of pattern preparation is annotation 114, which describes how the lists of expected features are used, and fitting preparation process 116, which follows annotation, and which describes how the measurements contained in each garment instance are used.

Annotation 114

Introduction

As illustrated in FIG. 1A, annotation process 114 is part of preferred pattern preparation process 110. The purpose of annotation is to produce an annotated pattern knowledge base 502. FIG. 36 illustrates a processing flow of annotation.

In the preferred embodiment, the first set of functions performed during annotation is related to transforming various graphic elements of a project into their final form. These graphic transformations typically include attaching alignment guides, intersecting lines, and combining line segments.

In the current implementation of the system, the primary function performed during annotation process 114 is feature identification. The purpose of feature identification is to identify and name the actual lines and points corresponding to the expected landmarks and other garment features of a particular project. The features that are expected to be contained in a project are preferably determined during classification 112 and are included in classified pattern knowledge base 500. It is the function of feature identification to match those expected features to their corresponding lines and points on the pattern parts in a particular project.

Pseudo code representing annotation can be described as follows:

```
[define ANNOTATION 114 (classified pattern KB 500)
(*Graphic transformations)
for each Part 152 of the pattern KB
send Part:Attach Alignment Guides 508
for each Part 152 of the pattern KB
send Part:Make Intersections 510
for each Part 152 of the pattern KB
send Part:Combine Lines 511
(*Feature Identification)
send Project:Feature Identification 513]
```

© 1988 3M Company

Attach Alignment Guides

The first graphic transformation function, in the current implementation of annotation, is to analyze the x,y coordinates of the alignment guides and, when appropriate, to include them in the graphic description of the line to which they belong. When a pattern is originally digitized, alignment guides may be digitized separately from lines. Therefore, alignment guides, in electronic project data 100, may not be incorporated in the graphic data that describes the lines. When an alignment guide position falls directly on a line, the approach taken in the current system is to incorporate the alignment guide into the line's graphic data so that fitting process 134 moves alignment guides together with the lines to which they belong. Those skilled in the art will recognize that an alternate approach is not to incorporate alignment guides in the graphic data that describes the lines.

The attach alignment guide method analyzes each alignment guide and, when the alignment guide falls directly on a line, the alignment guide is incorporated into the line's graphic data. Analysis is typically performed separately for each of a project's known sizes 308 because results may differ from size to size. For example, an alignment guide might fall on a line between the first and second point at size 10 and between the second and third point at size 12. The pseudo code below describes an attach alignment guides method 508 (see FIG. 6).

```
[define PART:ATTACH ALIGNMENT GUIDES 508
(*Each alignment guide is represented by an alignment guide
instance 624 and a point instance 164.)
for each Alignment Guide 624 in Part:Features 334
get the corresponding Point instance from Alignment Guide:Point 630
for each Line 162 in Part:Features 334
(*an alignment guide is considered to fall directly on a line when
it matches one of the x,y coordinates already on the line or when
it falls directly on a line segment formed by connecting adjacent
x,y coordinates of the line. A tolerance may be used so that two
positions within a tolerance distance of each other are considered to
be the same.)
for each size in Project:Known Sizes 308
if the Point:Graded Positions 408 for size falls directly on the Line
add Point to the Line:Graded Data for size 383
add to the slot Point:Lines 411 the pointer to this Line instance]
```

© 1988 3M Company

Make Intersections

When a pattern part is designed, it is comprised of a set of lines. Some of these lines may intersect. With pants, for example, a dart typically intersects a waist line in two points. In order to preserve the correct graphic relationships among lines, it is important in the current implementation of the system that intersecting lines share points. In this way, when one line is moved (such as during a fitting process), the intersecting line will be adjusted accordingly.

When data is received in electronic project data 100, the lines that form the outside of a part are typically connected. That is, the end point of one outside line is the same as the starting point of another outside line. However, internal lines (not on the outside) may not share any points with perimeter lines in original electronic project data 100. Because of this, a make intersections method 510 is preferably used.

The purpose of make intersections method 510 is to force the sharing of points between internal lines and outside lines when intersections occur. Intersections are preferably made separately for each of a project's known sizes because two lines may intersect at different places at different sizes. Pseudo code for making intersections between internal lines and outside lines can be described as follows:

```
[define PART:MAKE INTERSECTIONS 510
for each internal Line 162 in Part:Features 334
for each end Point 164 of the internal Line
for each outside Line in Part:Features 334
(*a position is considered to intersect an outside line when it
matches one of the x,y coordinates already on the line or when
it falls directly on a line segment formed by connecting adjacent
x,y coordinates of the outside line. A tolerance may be used so that
two positions within a tolerance distance of each other are
considered to be the same.)
for each size in Project:Known Sizes 308
if end Point is not already part of outside >>
Line:Graded Data 383 for size
if end Point:Graded Positions 408 for size >>
intersects the outside Line
add end Point to outside Line:Graded Data 383 for size
add outside Line to end Point:Lines slot 411]
```

© 1988 3M Company

Combine Lines

In the current implementation of preferred annotation process 114, the next step is to reconcile the situation that occurs when lines in electronic project data 100 are broken up into smaller segments than is desirable in prepared pattern knowledge base 128.

Figure 44B:
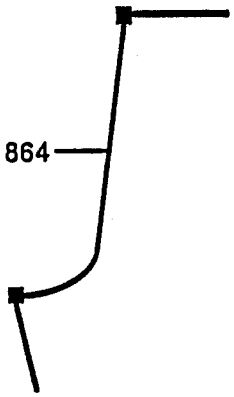

FIG. 44A illustrates an example of a crotch line that is represented as three separate line segments 863 in the original electronic data. In the current system, it is preferable that the three separate lines are combined into a single crotch line 864 as illustated in FIG. 44B. To accomplish this, the preferred embodiment employs a combine lines process 516 which operates by analyzing angle changes between connecting lines. In this preferred process, when the angle change between two line segments is less than a certain value (e.g., 10 degrees), they are combined; further, outside lines (that is, lines that form the outside edges of a part) are only combined with other outside lines, and internal lines are only combined with other internal lines.

Pseudo code for combining lines can be described as follows:

```
[define PART:COMBINE LINES 511
(*Separate loops for outside lines and internal lines)
let line-types be the list: (outside, internal)
for type in line-types
for each Line in Part:Features 334 of type
(*The adjoining line is the one sharing an endpoint with this line. A
small threshold value (e.g., 10 degrees) is used to compare
angle changes)
compare angle to adjoining line
if angle is less than specified threshold
append the adjoining line segment to the end of Line
```

-continued

```
replace all references to the adjoining line with Line
delete all references to the adjoining line]
```

© 1988 3M Company

Feature Identification

Figure 5:
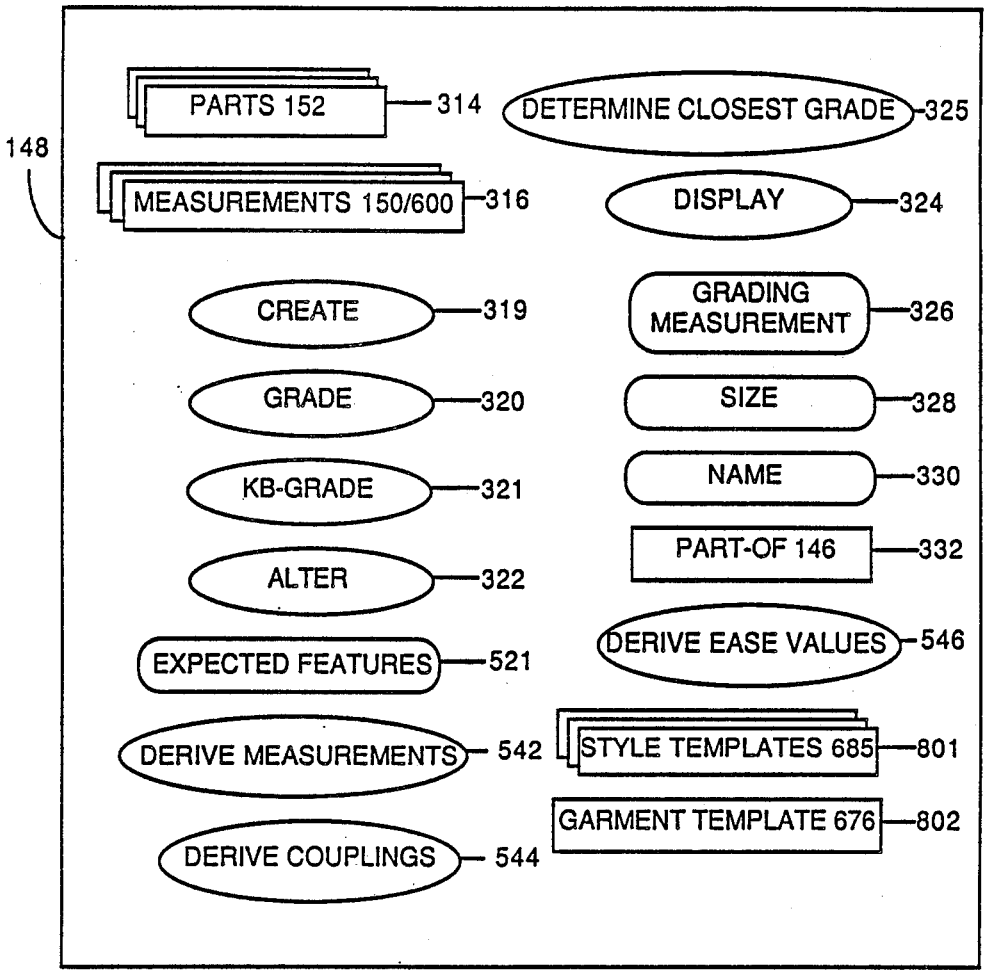

During preferred classification process 112, features that are expected to be found in a project are determined and stored in expected features slot 519 of each part (see FIG. 6) and expected features slot 521 of each garment (see FIG. 5). An entry for an expected feature typically contains a feature description including a feature name and a feature type (e.g., line or point). In the preferred embodiment of the system, the next step in the annotation process is to identify the expected features corresponding to the entries in expected features slots 519 and 521.

A preferred processing strategy employed during feature identification is to automatically identify as many features as possible. After the system has completed automatic identification, the system user is preferably asked to identify any unnamed features and to verify the accuracy of the derived information. As currently implemented, the system user interacts with the system through an agenda-driven user interface that is further described in the section entitled User Interface.

The preferred process to identify the expected features of a project is divided into three subprocesses, line identification, dart and pleat identification and point identification, and may be described by the following pseudo code:

```
[define PROJECT:FEATURE NAMING 513
invoke Line Identification
invoke Dart and Pleat Identification
invoke Point Identification]
```

© 1988 3M Company

Line Identification

The strategy used in the current implementation of the system is to begin by identifying the lines that correspond to a part's perimeter. In the preferred embodiment, each part 152 has a corresponding part template 634 (see FIG. 12) that contains an ordered list of entries corresponding to the expected perimeter lines of a particular part (perimeter slot 693), and each entry in a perimeter slot 693 is a pointer to a line template 612. The perimeter entries are typically ordered so that the end of one line in the list is expected to be connected to the beginning of the next line in the list. For example, perimeter slot 693 of a part template to describe a pants back part typically includes an ordered list of pointers to the line templates for waist, side, hem, inseam, and crotch.

Using the ordered list of perimeter lines, the preferred system tries to find one line instance in each part that is already identified and matches that line to one of the perimeter line names. When the preferred system is unsuccessful at matching any lines to perimeter line names, the system user is asked to locate the first perimeter line of a part, and after a single line is matched, the system attempts to automatically derive the remaining perimeter lines by associating connected lines in each part with corresponding line names contained in each line template.

After the system automatically derives as many perimeter lines as possible, the system user is preferably asked to verify the system derivations and to identify any missing names that are contained in expected features slots. Whenever the system user identifies a line, the system typically continues to try automatically deriving more feature names, given the additional input provided by the user. Those skilled in the art will recognize that there are alternate methods for identification. For example, a system user could be asked to identify key points instead of lines, and the system could derive line information from the identified points.

A special condition may arise during feature identification when neither the system or the user is able to locate one of the expected lines. For example, it is not uncommon for a pants pattern to be digitized without a hem line even though the current implementation of fitting process 134 may need a hem line in order to fit pants. When this case arises, the preferred system requests that the system user declare to the system that the line is not present, at which time the endpoints of that line (as preferably defined in endpoints slot 674 in the corresponding line template 612) are included in the list of expected features. In this way, the system ensures that the two endpoints for the absent line will be named and that a subsequent preferred process (called add invisible lines described in fitting preparation process 116) will create the necessary line from the endpoint data.

A process to identify lines of a project can be described by the following pseudo code:

```
[define PROJECT:LINE IDENTIFICATION
(*First find a starting line on the perimeter of each part. This is
done by matching a line name with type slot 618 in one of the line
templates 612 of the perimeter)
for each Part 512 in Project:Parts 658
for each Line 162 in Part:Features 334
if Line:Name 360 matches one of the entries in ((Part:Part
Template):Perimeter):Type 618
set starting Line for this Part to this Line instance
else
get Line Template 612 of first entry in (Part:Part Template):
Perimeter 693
ask user to identify Line corresponding to Line Template 612
fill in Line:Name 360 with name of first perimeter line (from Line
Template:Type 618
fill in Line:Line Template 385 with Line Template
set starting Line for this Part to the Line identified by the user
(*Now match lines of each part to perimeter line names beginning
with the starting Line. If there are still more perimeter lines to identify,
ask the user for help)
for each Part 152 in Project:Parts 658
loop until user can not name any more perimeter lines or until all
perimeter lines are named
find this Part's starting Line:Name 360 within the list of >>
(Part:Part Template):Perimeter 693
for each successive Line Template 612 in (Part:Part Template):
Perimeter 693 get the next Line in the part connected to starting Line
fill in next Line:Name 360 with Line Template:Type 618
add Line to Part:Perimeter 342
fill in Line:Line Template 385 with Line Template 612
set starting Line to next Line
if any of the lines in (Part:Part Template):Perimeter 693 are unnamed
ask user to identify at least one of the unnamed lines
(*Ask user to identify all remaining lines (perimeter and internal).
Lines may be either on a part on anywhere on a garment)
for each Part 152 in Project:Parts 658
collect a list of line names from Part:Expected Features 519 that
have not been named for each Garment 148 in Project:Garments 300
collect a list of line names from Garment:Expected Features 519 that
have not been named
for all line names collected
ask user to identify the line
fill in next Line:Name 360 with line name
```

-continued

```
fill in Line:Line Template 385 with Line Template 612 corresponding
to this line name
(*Handle special case when a line can not be found by forcing its
endpoints to be included in the Part's list of expected features)
for each Part 152 in Project:Parts 658
for each Line Template 612 in (Part:Part Template):Perimeter 693
if there is not a Line in Part:Features 334 with Line:Name = Line
Template:Type add Line Template:Endpoints 674 to Part:Expected
Features 519]
```

© 1988 3M Company

Dart and Pleat Identification

The next step in the current implementation of feature identification is to analyze internal lines for darts and pleats. A dart may be detected by finding a set of connected line segments that, when combined, either have one or three corners (see FIG. 32B and FIG. 32C). A pleat may be detected by finding a set of connected line segments that, when combined, have two corners (see FIG. 32D and FIG. 32E). Darts and pleats typically intersect one of the perimeter lines (a waist, for example).

When a dart or a pleat is identified in the current implementation of the system, it is assigned a name that contains "dart" or "pleat" as a first name and the name of the line that it intersects, if any, as a second name. Examples of a dart and pleat names are (dart side), (pleat waist) and (dart). The current subsystem names darts and pleats in this way so that they may later be identified during fitting preparation process 116.

After the current system has identified darts and pleats based on geometric considerations as described above, the system user is preferably asked to verify the system derived information. A dart and pleat identification process can be described by the following pseudo code:

```
[define IDENTIFY DARTS AND PLEATS
for each Part 152 in Project:Parts 658
for each internal line in Part:Features 334
if internal line connects with other internal lines and >>
intersects one of the perimeter lines
(* Dart)
if number of corners formed by connecting lines is 1 or 3
combine the lines
fill in Line:Name 360 with ("Dart" Perimeter Line:Name)
else
(* Pleat)
if number of corners formed by connecting lines is 2
combine the lines
fill in Line:Name 360 with ("Pleat" Perimeter Line:Name)
(* Ask user to verify darts and pleats)
ask user to verify all darts and pleats >>
allow user to identify additional darts and pleats >>
allow user to discard a dart or pleat identified by the system]
```

© 1988 3M Company

Point Identification

When all expected lines are named or declared not to be present, as in the special case described above, the preferred system automatically names points of a project based on the available line names. As currently implemented, the two endpoints of each expected line are named with the names contained in endpoints slot 674 contained in the corresponding line template 612 of each line. At this point in the preferred embodiment, the system user is asked to supply any remaining point names from the list of expected features that were not named by the system.

A process to identify points can be described by the following pseudo code:

```
[define POINT IDENTIFICATION
(* Derive point names from the line names)
for each Part 152 in Project:Parts 658
for each Line 162 in Part:Features 334
get endpoint names from (Line:Line Template):Endpoints 674
get Line's endpoints from Line:Knots 382
fill in first Point:Name 360 with first endpoint name
fill in second Point:Name 360 with second endpoint name
(* Ask user to provide any missing point names.)
for each Part 152 in Project:Parts 658
collect a list of point names from Part:Expected Features 519 that have not been named
for each Garment 148 in Project:Garments 300
collect a list of point names from Garment:Expected Features 519 that have not been
named
for all point names collected
ask user to identify the point
fill in next Point:Name 360 with point name]
```

© 1988 3M Company

Summary of Annotation

Preferred annotation process 114 produces an annotated pattern knowledge base 502 that establishes the relationships among the graphic elements (e.g., lines and points) and identifies the features of each garment and part of a project. In the preferred embodiment, the next step of pattern preparation is a fitting preparation process 116, which uses the information contained in the annotated pattern knowledge base, and further prepares it for the eventual use by preferred fitting process 134.

FITTING PREPARATION 116

Introduction

In the preferred embodiment, a fitting preparation process performs a series of processes in order to produce a prepared pattern knowledge base containing complete garment descriptions accepted by fitting process 134. Accordingly, the purpose of fitting preparation process 116, as illustrated in FIG. 38, is to create a prepared pattern knowledge base 128 beginning with an annotated pattern knowledge base 502. Fitting preparation typically performs without system user interaction by making use of the information in the annotated pattern knowledge base that was provided by classification process 112 and annotation process 114.

In the preferred embodiment, much of the information that ultimately resides in prepared pattern knowledge base 128 is derived from templates. In particular, the templates of the present system contain generic constraints that describe how to prealter garments of a particular style. Preferred fitting preparation process 116 generates prealteration constraints by substituting the lines and points identified during feature identification 513 for general feature descriptions contained in the generic constraints. The reader is directed to the section entitled Knowledge Representation for a discussion of the information contained in preferred garment templates 676, measurement templates 600, part templates 634 and line templates 612.

The series of functions performed by preferred fitting preparation process 116 can be described by the following pseudo code:

```
[define FITTING PREPARATION 116 (annotated pattern
KB 502)
(* Rotate parts)
for each Part instance 152 in Project:Parts 658
send Part:Rotate 608
(* Seam allowance removal)
for each Part instance 152 in Project:Parts 658
send Part:Remove Seam Allowance 610
(* Split lines)
for each Part instance 152 in Project:Parts 658
send Part:Split Lines 638
(* Add invisible lines)
for each Part instance 152 in Project:Parts 658
send Part:Add Invisible Lines 639
(* Derive measurements)
for each Garment instance 148 in Project:Garments 300
send Garment:Derive Measurements 542
(* Derive couplings)
for each Garment instance 148 in Project:Garments 300
send Garment:Derive Couplings 544
(* Set line directions)
send Project:Set Line Directions 640
(* Set angle dependencies)
send Project:Set Angle Dependencies 642
(* Set attached points)
for each Part instance 152 in Project:Parts 658
send Part:Set Attached Points 666
(* Prepare darts and pleats)
send Project:Prepare Darts and Pleats 644
(* Set update sequences)
for each Part instance 152 in Project:Parts 658
send Part:Set Update Sequence 646
(* Set reshape methods)
send Project:Set Reshape Methods 648
(* Save alignment guide positions)
for each Part instance 152 in Project:Parts 658
send Part:Save Alignment Guide Positions 650
(* Derive ease values)
for each Garment instance in Project:Garments 300
send Garment:Derive Ease Values 546]
```

© 1988 3M Company

Rotate Parts

The fitting process of the preferred embodiment expects parts to be oriented in a specific way. For example, the waist on pants is expected to be at the top of the part. Within each preferred part template 634 (see FIG. 12 and table 13), a slot named top 656 contains the name of a line that needs to be positioned at the top of the part. In the current system, the line instance corresponding to the top line is established, and then the part is rotated above the center point of the part so that the top line is at the top of the part.

The following pseudo code describes a process of rotating a part in order to orient the part in accordance with its expected orientation:

```
[define PART:ROTATE 608
find the line corresponding to value contained in slot (Part:Part Template):Top 656
selcet the center of the part as the pivot point for rotation
compute the angle needed so that the top line is at the top of the part
if angle is not 0
for each Line instance 162 in slot Part:Features 334
rotate the data in Line:Knots 382 by the rotation angle about the pivot point
```

© 1988 3M Company extension of the internal line may also be eliminated resulting in a modified internal line 876.

Pseudo code to remove seam allowance can be described as follows:

```
[define PART:REMOVE SEAM ALLOWANCE 610
(* first the outside seam lines are collected)
for all features in slot Part:Features 334
add feature to the list of outside seam lines when >>
1. the feature pointer is a pointer to a Line instance 162, >>
2. the Line is on the outside of the part and >>
3. the slot Line:Role 386 of the particular Line instance is "Seam"
(* move each outside seam line)
for each Line instance 162 in the collection of cut lines
for each point contained n the slot Line:Knots 382 of the outside seam line
move point by amount of seam allowance perpendicular to the Line >>
toward the center of the part
(* handle corners)
for each Line instance 162 in the collection of outside seam lines
if a portion of the cut Line extends beyond the new perimeter boundaries
eliminate extension by updating slot Line:Knots 382 of affected cut line
(* handle internal line junctions)
for each Line instance in this Part
if internal line originally intersected a outside seam line that was moved
if internal line extends beyond the new outside boundaries
update slot Line:Knots 382 to eliminate internal line extension]
```

© 1988 3M Company

Seam Allowance Removal

When patterns are digitized and subsequently represented in electronic pattern data 100, the outside lines on each pattern part typically correspond to cut lines. A cut line marks the line where fabric is cut prior to sewing. For lines that represent seams, the actual seam is normally inside of the cut line.

In the preferred embodiment, fitting process 134 performs calculations and alterations based on seam lines. Therefore, it is preferable to remove the seam allowance portion during fitting preparation. An alternate approach would be to leave the seam allowance portion so that subsequent fitting process 134 would calculate alterations taking seam allowance into account.

Some of the cut lines on a part are not seams and, consequently, do not require any seam allowance removal. For example, as illustrated in FIG. 42A, a bottom 865 of a pants part is folded up to form the bottom hem and, therefore, seam allowance is not removed from the bottom line.

After seam allowance is removed from each required cut line, special attention is preferably given to corners and internal line junctions. When removing seam allowance at a corner, as illustrated in FIG. 42B, a portion of each cut line 874 that forms a corner may extend beyond the new outside boundaries of the part after seam allowance is removed. Extensions 866 may then be eliminated resulting in new seam lines 875. Similarly, as illustrated in FIG. 42C, when an internal line 867 intersects a cut line 868, a portion 869 of the internal line may extend beyond the new outside boundaries of the part after the seam allowance is moved. The protruding

Split Lines

At this point in the fitting preparation process of the preferred embodiment, the lines that comprise each part are established by reference to determinations made during annotation process 114. A minimal set of lines is preferably established for each part, as described in annotation, so that the system user can easily verify the accuracy of the line names. However, it has been found advantageous in fitting process 134 that certain lines be split at strategic points to facilitate prealteration.

Figure 40B:
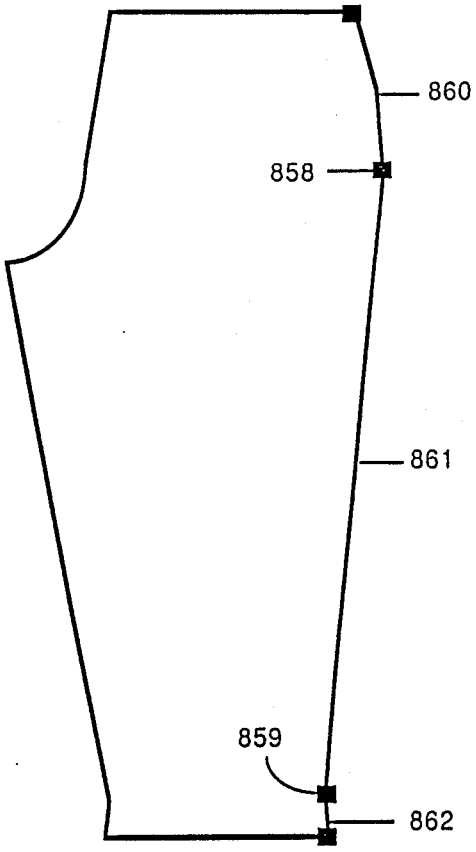

An example of a split line is the side of a back pants part. As illustrated in FIG. 40A, side 857 is represented as a single line after the annotation process. Prior to fitting, however, side 857 is advantageously split into three segments as illustrated in FIG. 40B: an upper portion 860 above side hip point 858, a lower portion 861 between side hip point 858 and side hem point 859, and a segment 862 below hem point 859. The upper portion may then be altered independently to properly control the shape of the pants side. Length alterations are then applied only down to where the pants are hemmed and, therefore, the line is advantageously split again at the hem point. These alterations are further described in fitting.

The information used to determine how to split lines may be stored in a lines to split slot 636 in each part template 634. A single part may benefit by splitting lines; accordingly, the lines to split slot typically contains a separate entry for each line that is to be split. Each entry may be structured as follows:

```
(line-to-split (split-point new-line-name1 new-line-name2)
```

-continued

```
(split-point new-line-name1 new-line-name2)
etc. for remaining split points)
```

For example, a back pants part template may contain the following entry to describe how to split the side line:

```
(SIDE ((SIDE HIP POINT) (SIDE UPPER) (SIDE LOWER)
((SIDE HEM POINT) (SIDE LOWER) (SIDE HEM))
```

This entry can be interpreted to mean: "First, split the SIDE at the point named (SIDE HIP POINT), calling the two resulting lines (SIDE UPPER) and (SIDE LOWER). Next, split the side (now called (SIDE LOWER)) at the point named (SIDE HEM POINT), calling the two resulting lines (SIDE LOWER) and (SIDE HEM)".

In the preferred embodiment, each part instance 152 of a project contains a split lines slot 638, which contains a method to split selected lines of a part. The pseudo code for split lines method 638 can be described as follows:

```
[define PART:SPLIT LINE 638
(* Each Part instance 152 is associated with a Part template 634 in Part Template
800.)
for each entry in (Part:Part Template):Lines to Split 636
find Line instance 162 corresponding to the line name in the entry
(* a single line may need to be split in many places)
for each split point in the entry
find Point instance 164 corresponding to the split point name
let saved-knots be the contents of slot Line:Knots 382
update Line:Knots 382 to terminate at the split point
update Line:Name 382 to new-line-name1 of entry
(* the method to create line instances is described in data conversion)
send Line:Create 381
set Line:Knots 382 in newly created Line instance to the saved-knots >>
beginning at the split point
set Line:Name 360 in new Line to new-line-name2 of entry]
```

© 1988 3M Company

Add Invisible Lines

Some of the lines that are needed by preferred fitting process 134 may not exist in a particular part. For example, it is common for a pants part not to include a hem line, although a hem line is needed by a fitting process to prealter inseam lengths. In the preferred embodiment, the names of the lines that are required by fitting are stored in an expected features slot 519 in each part instance 152. As described above in annotation process 114, unnamed lines may still reside in this slot when the system operator declares that these lines do not exist on a particular pattern part. Because these lines are crucial to a normal fitting process, they are typically added at this time. In the current implementation of the system, a special attribute, called invisible, is assigned to these lines so that a preferred post processing process 137 is aware not to plot them.

An endpoints slot 674, residing in each preferred line template 612 (see FIG. 33 and table 11), lists the names of the two endpoints of each line. In the preferred embodiment, the process to add invisible lines uses the endpoints slot information to create a line for each unnamed line in expected features slot 519 of a part. Pseudo code to add invisible lines can be described as follows:

```
[define PART:ADD INVISIBLE LINES 639
(* Ensure that all expected lines are present. Otherwise, create an invisible line.
Each Line instance 162 contains a pointer to a Line Template 612 in slot 385)
for each line name in Part:Expected Features 519 that is not named
find endpoint instances corresponding to (Line:Line Template):Endpoints 674
(* The method to create lines is described in data conversion process 104)
set line data to include the two endpoints, the endpoint positions and >>
the line name
send Line:Create 362 (Part, line data)
add invisible to Line:Attributes 362 of newly created Line instance
```

© 1988 3M Company

Derive Measurements

During preferred classification process 112, measurements important to the alteration of each garment are identified and associated with the garment. Each garment may carry a different set of important measurements. For example, when fitting pants it is important to know about crotch related measurements, and when fitting bodices it is important to know about neck line measurements. As implemented in the present system, a list of the measurements that are important to each particular garment are found in a measurements slot 316 of each garment 148.

In the preferred embodiment, each measurement in measurements slot 316 corresponds to a measurement template 600. For example, the name "crotch length" listed in measurements slot 316 corresponds to a measurement template named "crotch length". Each measurement template preferably includes a description about how to derive a particular physical dimension of a garment. In the preferred embodiment, this description is found in a measurement declaration slot 602 in each measurement template.

All garment styles and variations can normally be measured with the general description contained in each measurement template. For example, the measurement declaration in the preferred "crotch length" template describes how to measure the crotch length for any garment style. For example, a crotch length measurement declaration could include instructions that convey the following: "compute the crotch length on a particular garment by summing the length of the crotch line (from the waist to the crotch point) on the back and the front parts". These instructions are typically not stored as English sentences, however, but rather as declarative structures. An example of a declarative structure for crotch length is:

```
((CROTCH WAIST) (CROTCH))
(CROTCH INSEAM) (CROTCH))
(FRONT)
LENGTH
((CROTCH WAIST) (CROTCH))
(CROTCH INSEAM) (CROTCH))
(BACK)
LENGTH
(+ (FIRST VALUE) (SECOND VALUE)
```

This declarative structure can be interpreted as follows: "Compute the LENGTH starting at the CROTCH WAIST point on the CROTCH line of the FRONT and ending with the CROTCH INSEAM point of the CROTCH line on the FRONT, measuring along the CROTCH line. Store the result as FIRST VALUE. Compute the length starting at the CROTCH WAIST point on the CROTCH line of the BACK and ending with the CROTCH INSEAM point of the CROTCH line on the BACK, measuring along the CROTCH line. Store the result as SECOND VALUE. Sum the FIRST VALUE and SECOND VALUE to obtain the crotch length measurement."

A general form of a declarative structure to derive measurements can be described as follows:

| Structure | Meaning |
|---|---|
| (Point List) or previously derived value | A list of identifiers used to locate specific positions on a garment. The form includes a point name and an optional line name on which the point is located. In place of a point list, a previously derived value may be stated. |
| (Part List) | An optional list of parts. When included, the derivation is restricted to these parts. Otherwise, all parts are considered. |
| Method | how to compute the value. Examples include: |
| Distance- | The euclidean distance betweeen the positions of the points referenced in the point list. |
| Length- | The distance between points following the curve of the stated line(s). |
| Tangent- | The tangent at the point referenced in the point list along the line listed in the point list. |
| Value- | The value of a previously derived measurement. |

In the preferred embodiment, a derive measurements method 542 is invoked to create a measurement instance 150 for each important measurement of a particular garment and to perform the declared measurement calculation. The measurement calculation uses the general declarative information found in the measurement template and calculates a specific value for a particular garment. As implemented, the result of a measurement calculation is stored in a graded-data slot 520 in each newly created measurement instance.

Graded data slot 520 typically contains entries of the form: (garment measurement, fit ease, design ease) for each of a project's known sizes. Derive measurement method 542 typically calculates only a garment measurement. Fit ease and design ease are preferably calculated later by a derive ease values method 652 described in adjustment 212.

In addition to deriving a physical dimension, the current implementation of derive measurements method 542 copies declarations including a name 606, a determine adjustment 603, a preference values 673, and a grading factors 671 from preferred measurement template 600 to a newly created measurement instance 150. The purpose of these slots is further explained in the section entitled Knowledge Representation, and the preferred way in which adjustments are calculated and used is described in adjustments process 212.

Pseudo code for derive measurements 542 can be described as follows:

```
[define GARMENT:DERIVE MEASUREMENTS 542
for each Measurement Template 600 in Garment:Measurements 316
create Measurement instance from Measurement class 150
(see FIG. 11 and table 9)
replace pointer to Measurement Template 600 with
pointer to newly created >>
Measurement instance 150 in slot Garment:Measurements 316
fill in slot Measurement:Name 512 with Measurement Template:
Name 606
fill in slot Measurement:Determine Adjustment 531 with >>
Measurement Template:Determine Adjustment 603
fill in slot Measurement:Preference-Values 533 with >>
Measurement Template:Preference-Values 673
fill in slot Measurement:Grading-Factors 517 with >>
Measurement Template:Grading-Factors 671
for each size in Project:Known Sizes 308
measure the pattern at size according to the declaration in >>
Measurement Template:Measurement Declaration slot 602
store resulting garment measurement for this size in >>
Measurement:Graded-Data 520]
```

©1988 3M Company

Derive Couplings

As implemented in the present system, the next step in preparing garments is to derive couplings. A coupling is preferably implemented as a declaration that couples an adjustment to a set of garment features for a specific measurement. The amount of adjustment applied to specific features of a garment may be a function of the difference between specific garment measurements (as computed, for example, by derive measurements method 542 shown above) and specific personal measurements. The way in which adjustments are calculated and couplings are applied to alter garments in the preferred embodiment is described in fitting process 134.

The aspect of couplings described here (as part of the fitting preparation process of the present system) is determining which features of a particular garment are affected by a coupling. For example, a coupling for a waist circumference typically needs to adjust all lines of the garment that are affected by lengthening or shortening the waist. On one garment, this may only involve a front and back part; on another garment there may be front, back, waistband and pocket parts that are affected by waist circumference changes. In order to accommodate differences between garment styles, the present system declares in a general way the features which are included in a coupling; then, a derive couplings method 544 described below may be used to determine specific affected features of a particular garment from the general declaration of affected features.

In the preferred embodiment, a generic coupling is stored in a coupling declaration slot 604 of each measurement template 600. The preferred process to derive couplings, as contained in method slot 544, copies the coupling declaration information from the measurement template to a couplings slot 534 contained in each measurement instance 150 corresponding to each particular measurement. When copying a coupling declaration, preferred derive couplings method 544 searches for general feature descriptions and translates them to specific lines and points identified during feature identification 513.

General feature descriptions may be of the form:

| | |
|---|---|
| (FEATURE <type> <part> <name> <match>), where | |
| FEATURE | is a keyword to denote the beginning of a general feature description. |
| <type> | contains the type of feature, for example, LINE, POINT, or DART/PLEAT. |
| <part> | contains a reference to the parts on which features of the specified type are desired. The <part > specification may be a single part name, a list of part names or ALL. |
| <name> | contains a reference to the feature's name or a part of the feature name. A feature name may contain of a number of words (e.g., (WAIST UPPER) and (WAIST LOWER) are two lines of a waistband). |
| <match> | tells how to match the <name > to garment features. Three types of matching typically take place: synonym, primary or secondary. Synonym matching may be used to match features with exactly the same name as specified in <name> or a synonym of <name> as established in a list of synonym names residing in the system. Primary matching may be used to match features that have the same "first name" as the name specified in <name >. For example, (WAIST UPPER) is a primary match with WAIST. Secondary matching may be used to match features that have the same "first name" and "second name" as the name specfied in <name>. |
| An example of a general feature description is: | |
| ((FEATURE LINE ALL (WAIST) PRIMARY)). | |

This feature description may be used to prompt a search through all part instances of a particular garment and find all the lines whose primary name (first name) is WAIST. The result of processing this description is typically a list of pointers to all line instances 162 of a particular garment that correspond to waist lines.

General feature descriptions may contain more than one specification, as in the following example:

```
((FEATURE POINT FRONT
(CROTCH POINT) SYNONYM)
(FEATURE LINE FRONT (CROTCH) SYNONYM)).
```

This feature description may be used to search the FRONT part for a point whose name is (CROTCH POINT) or has a synonym by that name and to search the FRONT part for a LINE whose name is (CROTCH) or has a synonym by that name. The result of processing this description can include a list of two pointers: one to a point instance 164 corresponding to the crotch point and one to a line instance 162 corresponding to the crotch line.

A process to derive couplings can be described with the following pseudo code:

```
[define GARMENT:DERIVE COUPLINGS 544
for each measurement listed in slot Garment:Measurement 316
find Measurement Template 600 corresponding to the measurement
find Measurement instance 150 corresponding to the measurement
for each type of information contained in >>
```

-continued

```
Measurement Template:Couplings Declaration slot 604
if the information is a general feature description ("FEATURE")
convert the general description to specific feature pointers
copy the list of pointers to Measurement:Couplings slot 534
else
copy the information directly to Measurement:Couplings slot 534]
```

©1988 3M Company

Set Line Directions

In the preferred embodiment, the next step in fitting preparation is to insure that the order of x,y positions in each line is correct for the fitting process, and this is preferably accomplished through a set line directions method 640. The order of x,y positions that comprise a line can affect the way in which a line is altered. When scaling a line, for example, the first point of the line may be fixed, and each successive point may be moved according to some scale factor (the various operations that alter x,y positions of lines is described in fitting). On the other hand, for some lines, order of x,y positions is not important.

Those skilled in the art will recognize that the order of x,y positions that comprise a line would not need to be set at this time. The present implementation was selected for performance reasons. As an alternative, fitting process 134 could alter line data, taking into account that a line may begin at either of its two ends.

When order for a particular line is important, information about the required order may be stored in an anchor slot 614 of a corresponding line template 612. As implemented in the present system, the anchor slot contains either a point name or a line name, a point name indicating which point needs to be the starting point for the line, and a line name indicating that the line needs to begin at the point of intersection with a line whose name is contained in anchor slot 614. Pseudo code for preferred set line directions method 640 can be described as follows:

```
[define PROJECT:SET LINE DIRECTIONS 640
(*Go through each line of each part. Each Line instance 162
contains a pointer to a
corresponding Line Template 612 in slot 385)
for each Part instance 152 in Project:Parts 658
for each Line instance 162 in the Part:Features 334
if there is data in slot (Line:Line Template):Anchor 614
(*order is important)
if first point in Line:Knots 382 does not match the anchor
reverse order of Line:Knots 382]
```

©1988 3M Company

Set Angle Dependencies

Angle dependencies may be established to specify that limits on an angle between two connected lines are to be maintained during fitting. An angle dependency involves two lines: an independent line and a dependent one. At a specific time in fitting, as further described in the fitting section, the dependent line may be adjusted so that the angle between it and the independent line conforms to a specified amount. For example, when fitting pants, an angle dependency of 90 degrees typically exists between an independent crotch line and a dependent waist line.

Angle dependency relationships are stored in the preferred embodiment in an angle dependencies slot 384 in each line instance corresponding to an independent line of an angle relationship. The information contained in the angle dependencies slot typically includes a pointer to the dependent line instance and an angle.

As implemented in the present system, the contents of angle dependencies slot 384 are filled based on information contained in each part template 634; each part template contains an angle dependencies slot 654 that contains a list of angle dependency entries; and each entry contains the name of an independent line, the name of a dependent line, and an angle. The angle may either be a fixed value (e.g., 90 degrees) or a calculated value, which may be indicated by the word "measure". When a calculation is specified, the angle between the lines is preferably calculated for the base size of the project (as preferably contained in a base size slot 312 of project 146), with the calculated value used as the angle. Measuring is typically used in cases when a fixed angle does not apply to all garment styles where the angle in the original pattern design needs to be preserved.

An example of an angle dependencies declaration for a pants back part is:

```
( ((CROTCH)(WAIST)90)
((INSEAM))(CROTCH) MEASURE)
((SIDE UPPER)(WAIST)270))
```

This example shows that, there are three angle dependencies for parts that correspond to pants back, that two of the angle dependencies are fixed, and that one is measured from the base size.

In the preferred embodiment, set angle dependencies method 642 analyzes the declaration in each part template corresponding to the parts of a particular project and fills angle dependencies slot 384 in each independent line as needed. Pseudo code for set angle dependencies method 642 can be described as follows:

```
[define PROJECT:SET ANGLE DEPENDENCIES 642
(*analyze each part)
for each Part instance 152 in the Project
fine corresponding Part Template 634 for this Part instance
if there is data in slot Part Template:Angle Dependencies 654
(*process each entry separately)
for each entry in Part Template:Angle Dependencies 654
find Line instance 162 corresponding to the independent line
if entry angle = "measure"
let angle be the measured angle between the two lines
else
let angle be the number contained in the entry
fill in slot Line:Angle Dependencies 384 of the independent line >>
with the dependent line and the angle calculated above.]
```

©1988 3M Company

Set Attached Points

There are certain aspects of a garment that are not changed when garments are prealtered to match individual body measurements. For example, when pants are sewn to a finished length, the length of a pants hem that is folded up does not typically change as the inseam is lengthened or shortened. Even when a portion of a part is not directly altered by the fitting process, it may still have to be moved. In the example of a pants hem, when the hem point is lowered to lengthen an inseam, the bottom of the pants need to be lowered by the same amount.

To accomplish the necessary movement of points that are not directly altered, those points may be attached to other points that are altered by the fitting process. Then, when a point is altered, the attached points may be automatically moved by an identical amount. The preferred way in which attached points are moved is fully described in the fitting process. What is described here is the preferred way in which attached points are identified and stored in a pattern knowledge base.

Figure 17A:
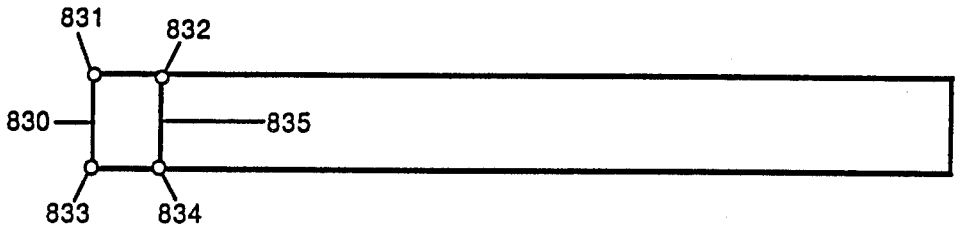
FIG. 17A illustrates a preferred concept of attached points for a waistband.
Figure 17B:
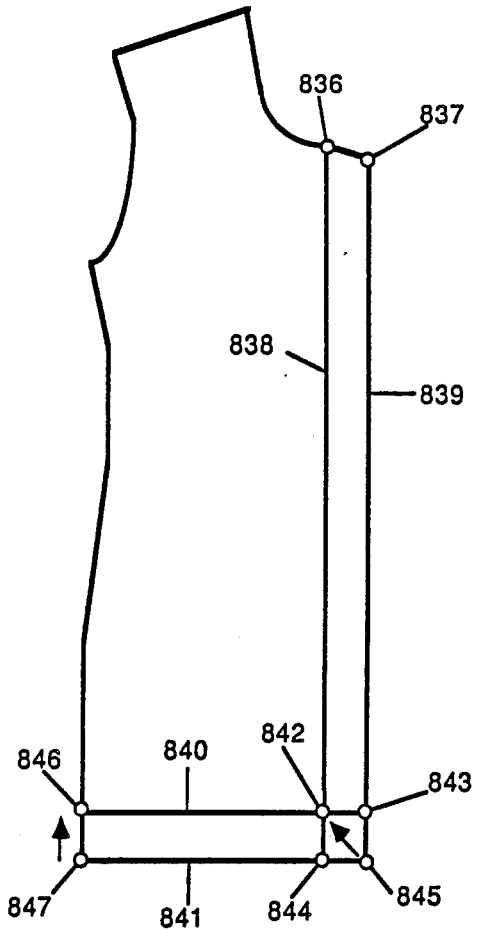
FIG. 17B illustrates a preferred concept of attached points for a bodice part.
Figure 17C:
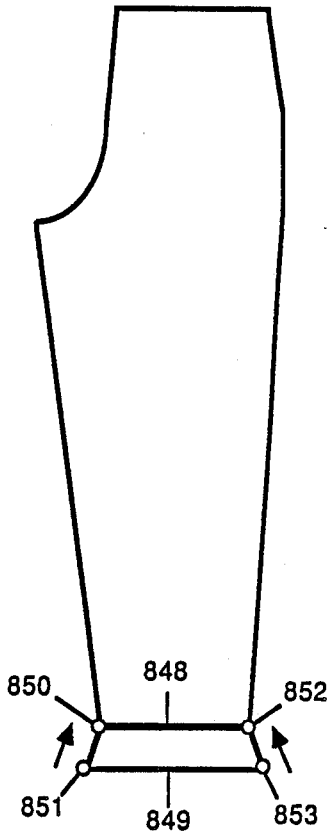
FIG. 17C illustrates a preferred concept of attached points for a pants part.

In order to implement the concept of attached points, the preferred embodiment employs an attached points slot 403 residing in each point instance 164 and containing a list of attached points (if any); the contents of the attached points slot is preferably filled by a set attached points method 666, which is illustrated in FIGS. 17A, 17B and 17C. Based on this process, when a line falls outside of the perimeter lines of a part (the perimeter lines being preferably stored in perimeter slot 342 of each part instance 152), the endpoint of the outside line is attached to the endpoint of the perimeter line.

Three examples of applying this process are illustrated. FIG. 17A illustrates an example of a waistband overlap 830 that extends outside of the perimeter. As a waistband is lengthened or shortened, the size of the overlap portion of a waistband is not typically changed. Point 831, which is the endpoint of one of the overlap lines, is attached to point 832 which is an endpoint of the connecting perimeter line. Similarly, point 833 is attached to point 834. Since perimeter lines are adjusted by fitting process 134, the overlap portion of the waistband, as defined by points 831 and 833, will be moved in and out together with adjustments to center front line 835.

FIG. 17B illustrates an example of a lapel line 839 and bottom line 841 that are outside the perimeter of the part which is defined by center front line 838 and hem line 840. The lapel and bottom lines are not directly adjusted by the fitting process, but need to move together with adjustments to the center front and hem lines. To accomplish this, the current system attaches point 837 (part of a lapel), to point 836 (part of the center front) and point 847 (part of the bottom), is attached to point 846 (part of a hem) in the same manner as in case 1. However, points 842, 843, 844 and 845 require a different process to establish the desired attachment. As implemented in the preferred embodiment, point 843 is first attached to point 842 because the line between points 842 and 843 falls outside the perimeter; next, point 844 is also attached to point 842 because the line between points 842 and 844 falls outside the perimeter; next, an analysis is performed on the attached points 843 and 844.

In the example shown, this analysis determined that both points are midpoints of other lines. Point 843 is a midpoint of the lapel line and point 844 is a midpoint of the bottom line. In the preferred process, one requirement of attached points is that they must be endpoints of all lines on which they fall. When point 843 is detected to be a midpoint of the lapel, the endpoint of the lapel line (point 845) is attached instead. Likewise, when point 844 is detected to be a midpoint of the bottom, the endpoint of the bottom line (point 845) is attached instead. The end result in this example is to attach point 845 to point 842.

FIG. 17C illustrates the situation when one of the perimeter lines is not part of the original electronic pattern data, but was added during the preferred add invisible lines method 639 described above. The preferred analysis to attach points considers invisible perimeter lines identical to normal perimeter lines. Hence, point 853 is attached to point 852 and point 851 is attached to point 850 because bottom line 849 falls outside of an invisible bottom perimeter line 848.

In the preferred embodiment, set attached points slot 666 contains a method to find the attached points of a particular part and fill attached points slot 403 accordingly. Set attached points method 666 can be described by the following pseudo code:

```
[define PART:SET ATTACHED POINTS 666
(*analyze each outside line and attach outside line endpoints to
endpoints on the perimeter)
for each Line instance 162 in Part:Features 334 that is both
outside of the >>
perimeter and shares a point with a perimeter line
let shared-point be the point shared between the perimeter and
outside line
find endpoint of the outside line
if endpoint of outside line is a midpoint of another outside line
add endpoint of other outside line to shared-point:Attached Points
slot 403
else
add endpoint of outside line to shared-point:Attached Points
slot 403]
```

©1988 3M Company

Prepare Darts and Pleats

Darts and pleats require special handling by the preferred fitting process beyond that which is required of normal lines. In the preferred embodiment, the next step of fitting preparation is to prepare darts and pleats so that fitting process 134 can alter darts, pleats and lines that have embedded darts and pleats.

Darts and pleats often intersect other lines. For example, a waist often includes one or more darts and pleats. When a waist line containing a dart is sewn, the area between the dart ends is closed which renders a smooth waist line. Preferred fitting process 134 analyzes the effect of closing darts and pleats so that lines to which darts and pleats are connected can be treated as single continuous entities.

FIG. 39A illustrates the components of a dart. In the preferred embodiment, the line segments that form a dart are combined into a single line, referred to as a dart line (818 in FIG. 39A); the two endpoints of a dart line (819 and 820) are called dart ends; and when dart ends intersect a perimeter line, the intersecting perimeter line is referred to as a parent line (labelled 821). In the current system, the point at which the line segments of a dart line form a corner is referred to as a dart point (822 in FIG. 39A).

Pleats, as illustrated in FIG. 39B, may have pleat ends (823 and 824) and a parent line 825. The line segments that form the pleat are also combined, in the preferred embodiment, to form a pleat line (labelled 826). A pleat's line segments normally form two corners which, in the current system, are identified as pleat points (827 and 828).

In the preferred embodiment, darts and pleats are prepared by a prepare darts and pleats method 644 in order to facilitate prealteration of garments containing darts and pleats. Method 644 may be implemented by creating a dart instance 160 for each dart and pleat in a project and then filling in the following slots of each dart/pleat instance:

| | |
|---|---|
| attributes: type | either "dart" or "pleat". |
| ends | two endpoints of the dart or pleat line |

-continued

| | |
|---|---|
| features | line instance of the dart or pleat line. |
| line | line instance of the parent line. |
| point | point instance(s) of the dart or pleat points (see FIGS. 39A and 39B). |
| graded data | information about how to close the dart or pleat. |

A graded data slot 558 may contain information, referred to here as "to-close" information, about how to close a particular dart or pleat for each of a project's known sizes. To-close information may be calculated identically for darts and pleats and, therefore, the term dart will be used in this discussion to refer to both darts and pleats.

The purpose of to-close information in the preferred embodiment is to describe the graphic transformations needed so that the two dart ends and the two dart lines projecting from the dart ends coincide or align with each other. Aligning the two dart ends and dart lines is one way to approximate the way that a dart is sewn together. In the preferred fitting system, when a dart is closed, the near dart end (that is, the dart end closest to the beginning of the parent line) is fixed and the far dart end is moved so that the final positions of the two dart ends coincide.

When closing a dart, the current system either applies a translation or it applies a rotation. A translation is typically applied when the two line segments of a dart are parallel. FIG. 32E illustrates an example of parallel lines for which a translation may be calculated as the displacement needed to move far dart point 816 onto near dart point 815.

When the two line segments of a dart are not parallel, the current system establishes a pivot point and a rotation angle. A way in which a pivot point and rotation angle may be computed is illustrated in FIG. 32A. Point 803 is the near dart end and point 804 is the far dart end. Lines 805 and 807 are the two line segments of a dart line.

A first preferred step in closing such a dart is to compute two directions (806 and 808) formed by two line segments (805 and 807) at the dart ends (803 and 804). The rotation angle, call it r, is defined by (direction 806-direction 808). The next step in the current process is to compute a pivot point. The pivot point typically falls on a line 809 that begins midway between the two dart ends and projects in a direction 810 which is perpendicular to a line 812 connecting the two dart ends. The position of pivot point 811 may be computed by moving a distance along line 809 equal to:

$$\left(\frac{d}{2 \cdot \tan\left(\frac{r}{2}\right)}\right)$$

where d is the distance between the two dart ends and r is the rotation angle.

Various examples of computing to-close information is illustrated in the figures. FIG. 32B illustrates an example of a symmetrical dart where pivot point 813 coincides with the dart point. FIG. 32C illustrates an asymmetrical situation where pivot point 814, obtained by applying the algorithm described above, is outside of the dart. FIG. 32D illustrates a pleat in which the pleat lines are not parallel. FIG. 32E illustrates an example of parallel pleat lines. In this case, a translation is calculated.

A prepare darts and pleats method 644 typically creates dart and pleat instances for each line that is known to represent a dart or pleat. A line instance may be known to represent a dart or pleat when the first name, as contained in name slot 360 of the line instance 162, is either "DART" or "PLEAT". Typical pseudo code to prepare darts and pleats is as follows:

```
[define PROJECT:PREPARE DARTS AND PLEATS 644
for each Part instance in Project:Parts 658
for each Line instance in Part:Features 334
if first name of Line:Name 360 is "DART" or "PLEAT"
create Dart instance from class Dart 160 (see FIG. 14 and table 7)
(*Fill in slots of the newly created Dart instance 160. FIGS. 39A
and 39B illustrate the parts of darts and pleats.)
fill slot Dart:Attributes:Type 556 with "DART" or "PLEAT"
fill slot Dart:Ends 550 with endpoints of Line
fill slot Dart:Features 555 with pointer to Line
if Line intersects a parent line
fill slot Dart:Line 554 with pointer to parent line instance
add newly created Dart instance 160 to parent Line:Features 392
fill slot Dart:Point 552 with corner point(s) of dart or pleat
(*compute to-close information as illustrated in FIGS. 32A
through 32E.)
for each size in Project:Known Sizes 308
if dart lines at this size are parallel (same angle)
fill slot Dart:To-Close 558 with vector (displacement) >>
from far dart end to near dart end
else
let far-angle = direction of dart line at far dart end
let near-angle = direction of dart line at near dart end
let r = rotation-angle = 90° + >>
(angle from near dart end to far dart end)
let d = distance between the two dart ends
let m = midpoint between two dart ends
let b = bisection line beginning at m and projecting >>
in the direction 90° + >>
(angle of line formed by connecting near dart end and >>
far dart end)
let pivot = point derived by moving along b, >>
starting at m, a distance of:
```

$$\left(\frac{d}{2 \cdot \tan\left(\frac{r}{2}\right)}\right)$$

```
fill slot Dart:To-Close 558 for this size >>
with pivot and rotation-angle]
```

© 1988 3M Company

Set Update Sequences

As is described in the section entitled Fitting 134, the lines in each part instance 152 are typically updated in a particular order during operations of fitting 134. At least two situations arise that affect the need to order the way in which lines are updated. First, when there is an angle dependency, the independent line of an angle dependency relationship is normally updated before the dependent one. Second, when there is an endpoint-midpoint relationship, as illustrated in FIG. 48, the line containing the midpoint is preferably updated before the one containing the same point as an endpoint. The reasons for updating lines in this particular order is described in fitting.

During fitting process 134, an update sequence slot 352 in each part instance 152 may be accessed to determine the correct order. Furthermore, as part of fitting preparation 116, a set update sequences method 646 may be invoked for each part instance of a project to fill update sequence slots 352. Typical pseudo code for establishing an update sequence for a particular part is as follows:

```
[define PART:SET UPDATE SEQUENCE 646
(*Start with an unordered list of lines)
initialize update sequence to be the list of Lines in Part:
Features 334
for each Line instance 162 in Part:Features 334
(*Order the list based on angle dependencies)
if there is data in slot Line:Angle Dependencies 384
for each entry in Line:Angle Dependencies 384
insure that the dependent line follows Line in the update sequence
(*Further order the list based on midpoint-endpoint dependencies)
for each midpoint on the Line
if midpoint is endpoint of another line
ensure that the other line follows Line in the update sequence
(*Store the resulting ordered list)
fill slot Part:Update Sequence 352 with resulting ordered
list of lines]
```

©1988 3M Company

Set Reshape Methods

Reshaping is a process, performed in the preferred embodiment during fitting, to reshape a line after points on a line have been moved. In the present system, the way in which a line is reshaped depends, among other things, on the contents of a line's reshape method slot 390; this slot preferably contains a list of reshape points and a reshape method for each of the reshape points. The way in which reshape points may be used and in which lines may be reshaped is fully described in the section entitled Fitting 134.

In the preferred embodiment, each line template 612 (see FIG. 33 and table 11) includes a reshape declaration slot 616 containing a declarative structure that is used to fill a reshape method slot 390 in each line instance 162. The declarative structure may include a list of entries, where each entry is of the form ((point name) (reshape method) (parameter)). The typical process to set reshape methods in each line instance is to find the line template corresponding to a particular line and to copy the entries contained in reshape declaration slot 616 to reshape method slot 390 in each line instance. In the process of copying entries, each point name may be converted to a pointer to its corresponding point instance 164 in the current project.

Typical pseudo code to set reshape methods, as contained in method slot 648, is as follows:

```
[define PROJECT:SET RESHAPE METHODS 648
for each Part instance 152 in Project:Parts 658
for each Line instance 162 in Part:Features 334
for each entry in (Line:Line Template):Reshape Declaration 616
find Point instance 164 corresponding to the point name in the
entry
add the entry to Line:Reshape Method slot 390 substituting
a pointer >>
to Point instance for the point name in the entry ]
```

©1988 3M Company

Save Alignment Guide Positions

As described above, as part of the preferred annotation process, each alignment guide whose position falls directly on a line may be incorporated into the graphic data of the line on which it falls (see attach alignment guides method 508). When lines are moved during the fitting process, alignment guides that are incorporated into lines may be moved automatically. However, a strategy is typically needed to ensure that the unincorporated alignment guides are properly positioned after lines are moved by preferred fitting process 134.

Accordingly, the preferred embodiment employs a save alignment guide positions method 650 to save information about the positions of unincorporated alignment guides prior to invoking the fitting process so that their positions can be properly restored after lines are moved by the fitting process.

Figure 41B:
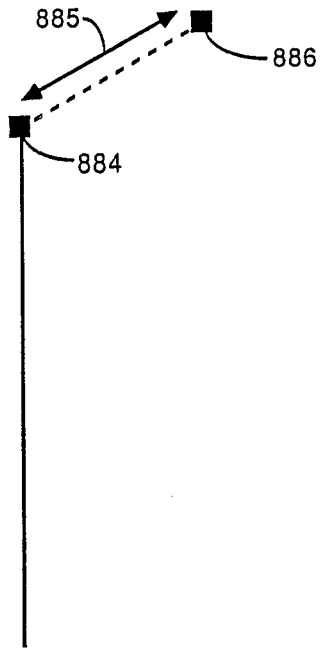

A strategy which may be employed in the preferred embodiment to save alignment guide positions is illustrated in FIGS. 41A and 41B. Each unincorporated alignment guide 624 may be associated with either a perimeter line 162 or a point 164 on a perimeter line. Then, repositioning information of the form (closet line or point, distance, direction, percentage) may be calculated and stored in repositioning data slot 633 of each alignment guide.

The first step in establishing repositioning information is preferably to find a perimeter line that is closet to a particular alignment guide. Next, a perpendicular projection may be made between the alignment guide and the perimeter line. FIG. 41A shows an example of a perpendicular projection 878 from an alignment guide 880 that intersects a perimeter line 879. In this case, distance 883 is the distance between alignment guide 880 and perimeter line 879. In the current implementation, a percentage is also calculated by taking a ratio between the distance from the beginning of the perimeter line to the point where the perpendicular projection intersects the perimeter line (881 in FIG. 41A) and the total length of the line (882 in FIG. 41A). In FIG. 41A, perimeter line 879, distance 883 between alignment guide 880 and perimeter line 879, a direction (in this case, 90 degrees) from perimeter line 879 to alignment guide 880 and a percentage defined by distance 881/distance 882 comprise the repositioning data.

As illustrated in FIG. 41B, there is not always a perpendicular projection between a perimeter line and an alignment guide that intersects a perimeter line. In this case, the shortest distance between the alignment guide and a point on a perimeter line (which is typically the endpoint of a perimeter line) may be established. In FIG. 41B, a closet point 884, a distance 885 between alignment guide 886 and closet point 884 and the direction from closet point 884 to alignment guide 886 comprise the repositioning data.

Repositioning data may be calculated for each unincorporated alignment guide and stored in repositioning data slot 633 of each unincorporated alignment guide instance 624. In the preferred embodiment, a process to calculate and store the repositioning data is contained in a save alignment guide positions method 650, which can be described by the following pseudo code:

```
[define PART:SAVE ALIGNMENT GUIDE POSITIONS 650
    (*First collect a list of the perimeter lines. Then, go through each Alignment Guide
    that is not on a line and associate it with one of the perimeter lines or to a point on a
    perimeter line.)
    collect list of perimeter lines from slot Part:Perimeter 342
    for each Alignment Guide instance 624 in Part:Features 334
    (*Is Alignment Guide on a line?)
      if there is no data in (Alignment Guide:Point):Lines 411
        for each size in Project:Known Sizes 308
          find perimeter Line closest to this Alignment Guide
          if perpendicular projection from Alignment Guide position>>
          intersects the perimeter Line
    (*Associate Alignment Guide with a perimeter line)
          add to slot Alignment Guide:Repositioning Data 633 the following:
            1. Line instance pointer
            2. distance from Alignment Guide to perimeter Line
            3. direction from perimeter Line to Alignment Guide
            4. percentage of distance from beginning of line to the >>
            perpendicular projection.
        else
    (*Associate Alignment Guide with a point on a perimeter line)
          add to slot Alignment Guide:Repositioning Data 633 the following:
            1. Point instance on perimeter line that is >>
            closest to Alignment Guide
            2. distance from Alignment Guide to Point
            3. direction from Point to Alignment Guide ]
```

© 1988 3M Company

Derive Ease Values

Ease refers to extra fabric that is needed to achieve a comfortable fit or that is intentionally added to achieve a desired style by a pattern designer. In the current system, a distinction is made between these two types of ease.

Fit ease, as defined in the current system, is the ease required to achieve a comfortable fit. For example, extra fabric may be needed around the hips to be able to comfortably walk and to sit down.

Design ease, as defined in the current system, is additional fabric added for stylistic reasons. For example, extra fabric is added under the arm to create a basic dolman sleeve; accordingly, in the current system, the extra fabric under the arm of a dolman sleeve is treated as design ease.

In the current implementation of the system, information about standard measurements and standard fit ease values are stored in measurement templates 600, each of which typically contain the information needed to establish ease for a particular measurement. As implemented in the current embodiment, a standard measurement, stored in a standard values slot 668, contains a standard value for a particular measurement for each standard size; for example, a measurement template for waist circumference contains a standard waist circumference for each standard size.

In addition, a standard amount of fit ease may be stored in a fit ease slot 670 of each measurement template for each standard size. In the case of fit ease, slot 670 typically contains either a value (the actual amount of fit ease) or a method to calculate the value. A method, when it applies, may be stored as a fetch demon.

Design ease, for a particular measurement, may be defined as the amount by which the measured value exceeds the total of the standard measurement plus the standard fit ease. Accordingly, design ease may be calculated by taking the garment measurement, stored in graded-data slot 520 of each measurement instance 150, and subtracting the sum of the standard measurement and the standard fit ease.

In the preferred embodiment, each measurement instance 150 contains an ease slot 528 that contains a fetch demon for deriving the total ease for a particular measurement. The fetch demon contents of ease slot 528 are typically copied from a fetch demon stored in an ease slot 672 in each corresponding measurement template 600. The fetch demon contents then reside in ease slot 528 where they are typically accessed during preferred fitting process 134 when adjustments are being calculated.

In the system as disclosed, a derive ease values slot 652 contains a method to establish ease information in each measurement instance 150 of a particular garment. Prior to deriving ease values, each measurement's graded-data slot 520 typically contains a garment measurement, zero fit ease and zero design ease. A derive ease values method 652 may then be used to compute fit ease and design ease and to replace the zero ease amounts in the graded-data slot with newly calculated ease values. The following pseudo code describes a typical derive ease values method:

```
[define GARMENT:DERIVE EASE VALUES 652
    for each Measurement instance 150 in Garment:Measurements 316
      find the Measurement Template 600 corresponding to this Measurement
      if there are values in Measurement Template:Standard Values 668
        for each size in Project:Known Sizes 308
          let std-meas be the standard measurement for this size from slot >>
            Measurement Template:Standard Value 668
          let fit-ease be the fit ease for this size from slot >>
            Measurement Template:Fit Ease 670
          let garment-meas be the garment measurement for this size from >>
            Measurement:Graded-Data 520
          let design-ease = garment-meas − (std-meas + fit-ease)
          replace zeros in Measurement:Graded-Data slot 520 with >>
          calculated fit ease and design-ease for this size]
```

© 1988 3M Company

Summary Of Fitting Preparation

In the preferred embodiment, fitting preparation 116 is the last step of pattern preparation process 110 (see FIG. 34). At this point, the current system has produced a prepared pattern knowledge base 128 which contains all the information needed by fitting process 134.

USER INTERFACE 124

Introduction

In preferred pattern preparation process 110, a system user 123 interacts with the system in order to complete the preparation of a pattern knowledge base which, in turn, can be used by a fitting process. Included in the operations that a system user may perform when preparing a pattern knowledge base are to begin working with a new project, to save knowledge about a project, to provide missing information about a pattern knowledge base, to correct system derived information and to verify information that is contained in a particular pattern knowledge base.

In the preferred embodiment, the strategy employed with regard to the user interface is to minimize the amount of human interaction required with the system. This is typically accomplished by automatically deriving as much information as possible and then asking for verification by a system user. When information cannot be automatically derived, the system user is normally asked to provide a minimum amount of missing information so that the system may continue to automatically derive additional information.

Project Context

The preferred system maintains status information for each project that includes information about the completion status of a project within the pattern preparation process in a state of progress slot 303. For example, one project may be in a classification state, another may be partially through the steps required to complete annotation, while a third may be complete and ready for fitting process 134. When a user interacts with a project that is not completely prepared, the remaining steps required to complete its preparation are typically presented so that the system user is able to ascertain the steps needed to complete the preparation of the project.

In the preferred embodiment, a system user may work with many different projects at a time. This is accomplished by allowing a system user to load many different projects and then to select, from a list of currently loaded projects, which one should be currently active.

To support the user's ability to work with several projects at a time, the current implementation of the system provides functions for a system user to load new projects, save a project at any given state of preparation and to select the currently active project from a list of loaded projects. The preferred user interface lists all the projects that are loaded, indicates the one that is currently active and provides status information for the currently active project.

Types Of Interaction With A Project

In the preferred embodiment, the system provides three types of user interactions for completing the preparation of a project: matching, identifying and verifying, and the system user is made aware of what types of interactions are expected at any given time. For example, at one point during a preferred feature naming method 513 (see annotation process 114), a list of unnamed features (i.e., features that could not be automatically derived by the system) are presented to the system user for identification. As features from the list are identified by a system user, the list is automatically updated to reflect only those features that remain unnamed.

A first type of interaction that is supported in the preferred embodiment is matching. An example of a matching operation occurs during preferred classification process 112 when, in the current implementation of garment classification method 695, the system user is asked to match project parts to project garments. When the system user is asked to match items, this is typically accomplished by selecting items from either a menu or from pictures which may be minature images of parts or garments that are easily recognized by persons skilled in the art of pattern preparation.

A second type of user interface interaction employed in the preferred embodiment is identification. An example of an indentification interaction occurs during the preferred method to name features (see feature naming method 513 in annotation process 114). In the current implementation of feature naming, a situation may arise when the system expects a particular feature to exist on a particular part but is unable to automatically identify the feature. In this case, an expected feature name is presented to the system user who may then identify it by selecting an expected feature from a graphic representation of a part.

A third type of user interaction made available to the system user is verification. An example of verification is found in the current process to identify darts and pleats (see feature naming method 513 in annotation 114) in which the system user is asked to verify the darts and pleats that were automatically identified by the system.

In the current system, a verification is normally elicited after the system automatically derives a given set of information in order to elicit a confirmation from the system user that information is correct and complete. Even when a system user is not modifying information in a pattern knowledge base, verification is considered useful as a confirmation of system derived information.

Summary Of User Interface

The user interface of the preferred embodiment provides a way for a system user to interact with the system during pattern preparation process 110. The system guides the user interaction by proving status information about projects and prompts about what interactions are expected from the user at any given time. When using the preferred user interface, the system user is able to work with many different projects simultaneously in order to accomplish the goal of preparing patterns that can ultimately be used by fitting process 134.

FITTING 134

Introduction

In the preferred embodiment, the purpose of fitting process 134 is to alter the geometry of pattern data in a prepared pattern KB 128 that has been prepared by pattern preparation process 110 so that a pattern or garment represented by the data fits a specific set of standard or individual body measurements 132 (FIG. 15), thus producing prealtered pattern data 136 customized to fit the given standard or individual body measurements. In an embodiment where pattern preparation process 110 and fitting process 134 are integrated on the same processor 80, a fitting process may operate from data stored by pattern preparation process 110. Alternately, a fitting process 134 may accept a prepared pattern KB 128 from portable mass storage media 81 or through other data communication. Body measurements 132 may be accepted from a variety of media or from other means.

In the preferred embodiment, fitting process 134 is accomplished by satisfying geometric and measurement constraints in prepared pattern KB 128 through a constraint satisfaction mechanism that alters points and lines that depict a garment 148. As shown in FIG. 1A, fitting process 134 may be implemented by a sequence of four steps; grading 210, adjustment 212, redrawing 216, and output preparation 218. The detailed operation of the fitting process as implemented in the present embodiment may vary somewhat from one project to the next. This variation may arise because the particular set of constraints contained in one prepared pattern 128 may differ from the set contained in another prepared pattern, and may be controlled by the structure of the prepared pattern itself, particularly with regard to preferred constraints represented by adjustments 530 and couplings 534 in measurement objects 150, as explained below. Another source of variation is that the preferred grading step 210 may be considered optional in the sense that the pattern data may not contain information necessary to drive a grading process, in which case grading does nothing in the preferred embodiment.

In the fitting process discussed below, the processes as implemented in the preferred embodiment are described; those skilled in the art will recognize that many alternate implementations are possible.

Fitting Garments

A project 146, which may contain data describing one or more garments 300, may be altered to fit a set of standard or individual body measurements 132 by altering the data which depicts each of its garments and preparing the data for output, as shown in the following pseudo code. The argument "person" here may be implemented as an instance of body measurements 132.

```
[define PROJECT:ALTER 304 (person)
    (*Alter each garment in this project to fit person)
  for each Garment 148 in self:Garments 300
    send Garment:Alter 322 (person)
  send self:Output-Preparation 305()]
```

© 1988 3M Company

Garments may be altered to fit a specified set of standard or individual body measurements by a series of steps as described in the following pseudo code, which describes a process to alter a garment instance 148. The argument "person" may again be implemented by a body measurements instance 132.

```
[define GARMENT:ALTER 322 (person)
    (*Alter this garment to fit the measurements and preferences of person)
  send self:Grade 320 (the value returned by self:Determine-Closest-Grade 325 (person))
    (*Generate adjustments and couple adjustments to features)
  for each Measurement 150 in self:Measurements 316
    send Measurement:Process-Couplings 536
    (*Redraw lines, adjust angles, etc.)
  for each Part 152 in self:Parts 314
```

-continued send Part:Update 346]

© 1988 3M Company

In the preferred process described above, a garment is first graded to one of the known sizes 308 (FIG. 4) of the current project, the size being selected by sending a Determine-Closet-Grade message 325 (FIG. 5) to the garment. The approach used in the preferred embodiment of grading to a known size before altering to fit has two advantages. First, the magnitude of the adjustments that have to be made is generally kept small, so that unintended distortion of the pattern may be minimized. Second, freedom is maintained for a garment designer to alter the overall proportions of the garment from one standard size to the next. For example, the designer may want to make the smaller sizes of a skirt pattern flare more than the larger sizes to achieve a desired visual effect. However, it is not necessary that there be more than one known size for the fitting process to work. In particular, if the body measurements correspond to a standard size rather than a particular person, the fitting process described herein may be used to grade patterns in accordance with specifications of standard sizes, which may be in the form of body measurements corresponding to the standard sizes, or may be in the form of specifications about how garment measurements themselves vary from one standard size to the next.

Figure 11:
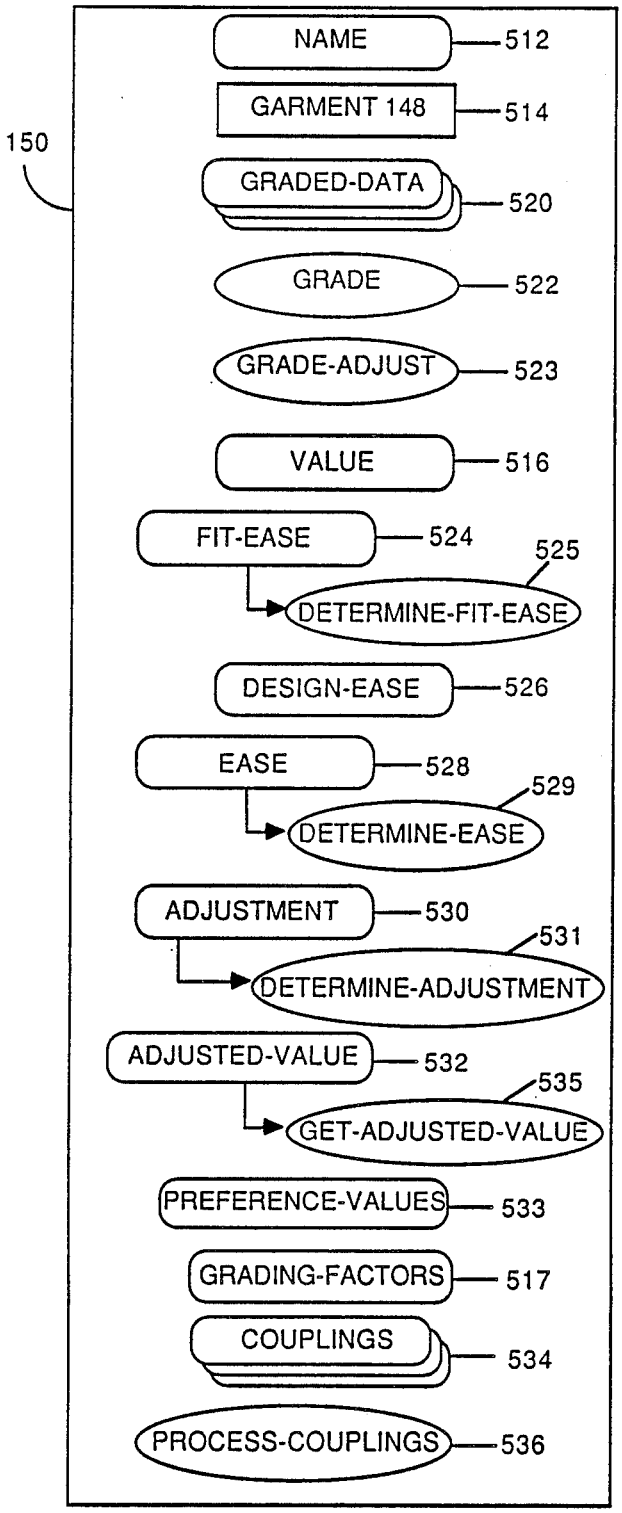

In the present embodiment, actual alteration of garment and part features begins by sending a process-couplings message 536 (FIG. 11) to each of the measurements 150 listed in the garment's measurements slot 316 (FIG. 5). Referring to FIG. 11, couplings slot 534 in each measurement instance may contain a set of couplings 220 (FIG. 45) which describe how an adjustment 530 determined for that measurement is to be applied to the features of the garment and its parts. The function of preferred process-couplings method 536 is to interpret these descriptions, and will be described below.

In the preferred embodiment, after process-couplings method 536 (FIG. 11) has completed the desired moving, scaling, rotating, etc. of features, many lines will have become discontinuous, as shown in FIG. 46, and will require redrawing. Accordingly, the preferred embodiment employs a redrawing process 216 in order to restore continuity of lines and restore important relationships between lines. This preferred redrawing process is further described in a subsequent section.

Although in the preferred embodiment couplings 220 in slot 534 may refer to values stored in adjustments slot 530, the adjustments need not be calculated ahead of time. As implemented in the current system, the adjustments are filtered by a fetch demon method, determine-adjustment 531; accordingly, the adjustments are preferably calculated when they are requested for the first time. This approach has the advantage that the various adjustments can depend on one another, and they can be made to automatically "chain" together to accomodate interdependencies among measurement adjustment calculations without requiring that a dependency graph be explicitly analyzed beforehand, as long as there are no cycles in the dependency graph. If the demon mechanism were not available, an approach consisting of generating and analyzing a dependency graph would also be effective.

Determination Of Closet Known Size

As described above, a typical process for altering garments 322 (FIG. 5) will start by grading the garment in question to a known size 308 (FIG. 4) that is closest to corresponding body measurements 132. Finding a proper known size 308 for a set of body measurements, as invoked by the preferred embodiment of garment: alter 322 described above, may be accomplished as described by the following pseudo code. A sorted list of entries may be created, each entry containing one of the project known sizes 308 and a number representing the difference between a value 516 and an ease 528 for a garment's grading-measurement 326. The resulting list may then be searched, comparing each entry with the value in a slot in body measurements 132 having a name that matches the garment's grading-measurement 326. The known size contained in the first entry that satisfies the search criterion may then be taken as the size for grading. In the following pseudo code, the search criterion is that the difference between value 516 and ease 528 be less that the chosen body measurement. If the body measurement is less than the number in the first entry in the list, then the first entry will be the size chosen, thus guaranteeing, in the preferred embodiment, that a size will be chosen. If there is only one known size for a garment, a system may bypass this processing.

```
[define GARMENT:DETERMINE-CLOSEST-GRADE 325 (person)
    (*calculate the closest available known size 308 using this Garment's Grading
    Measurement and the data for person)
  let measurement be the measurement instance for which >>
  Measurement:Name 512 matches self:Grading-Measurement 326
  let sorted-sizes be the list resulting from the following steps:
    for size in current-project:Known-Sizes 308
      collect entries of the form <size total-value>
        where total-value = value − (fit-ease + design-ease)
          where value, fit-ease, and design-ease are fetched from the entry in >>
          Measurement:Graded-Data 520 corresponding to size
  sort sorted-sizes in ascending order by total-value
  if the total-value from the first entry in sorted-sizes is larger than the value in >>
  the slot of body-measurements specified by self:Grading-Measurement 326, then
  return the size from the first enry in sorted sizes,
  else
    return the size from the first entry in sorted-sizes for which >>
    total-value < the slot of body-measurements 132 >>
```

-continued specified by self:Grading-Measurement 326

© 1988 3M Company

In the above pseudo code, garment measurements are fetched from graded-data slot 520 of the measurement instance 150 in which the contents of name slot 512 matches the contents of the garment's grading-measurement slot 326. The graded-data slot is assumed to contain an entry of the form <value fit-ease design-ease> corresponding to each of the known-sizes 308.

GRADING 210

Introduction

Grading 210 is a preferred process of configuring a project, garment, part, measurement, or feature in a particular pre-defined size. In the preferred embodiment, grading process 210 may be used as an initial step in a fitting process 134 in order to configure a garment to approximately fit a set of body measurements 132, in preparation for the "fine-tuning" of an adjustment step 212. When used in this way, the inclusion of a grading step in an overall fitting process can simplify a subsequent adjustment step by eliminating many details from consideration during adjustment. For example, such details as placement of pockets, width of collars and cuffs, number of buttons, etc. may be adequately specified by the overall size of a garment and need not be further adjusted during the remainder of prealteration.

Grading 210 is accomplished in the preferred embodiment in one of two ways. If all the relevant data (positions of points, values of measurements, dart and pleat geometry, etc.) for each of the known sizes 308 of a current project 146 is available before the fitting process 134 starts, grading is a simple retrieval process, called "retrieval grading". If graphical and other data is available for only the base size, then either grading may not be done at all, or a "knowledge-based" grading process may be used. In the case where the grading step is skipped, the preferred subsequent adjustment 212 and redrawing 216 processes may be implemented by simply working from a base size.

Retrieval Grading

Retrieval grading may be used for a particular project when all of the graphical data for each of the desired grades is made available to the system during pattern preparation as described earlier. In the preferred embodiment, a list of available grades is contained in a known-sizes slot 308 of the current project 146 (FIG. 4). Retrieval grading as described here is incapable of configuring a garment in a size other than one of these known sizes.

Referring to FIG. 5 and to the following pseudo code, a garment 148 may be graded by sending a grade message 320 to all its constituent parts 152 and measurements 150, listed in corresponding slots 314 and 316, to grade to the requested size, and finally by recording the new size in size slot 328, as shown in the following method description. This approach assumes that each of the components of a garment, parts 152 and measurements 150, contains a grade method slot that may be used to retrieve the appropriate known size data.

```
[define GARMENT:GRADE 320 (new-size)
    (*Retrieve the data representing this Garment in new-size and make it current)
  for each Part 152 in self:Parts 314
    send Part:Grade 344 (new-size)
  for each Measurement 150 in self:Measurements 316
    send Measurement:Grade 522 (new-size)
  fill in self:Size 328 with new-size]
```

© 1988 3M Company

Parts may be graded by grading each of their features, as shown in the following pseudo code, and then generating snapshots for each of their lines. In the present embodiment these snapshots are later used, during redrawing process 216, to determine the extent to which the lines have been distorted by the fitting process; this is preferably used to guide a reshape operation, discussed as part of redrawing process 216.

```
[define PART:GRADE 344 (new-size)
    (*Grade this Part to new-size)
  for each Feature 154 in self:Features 334
    send Feature:Grade 356 (new-size)
  for each Line 162 among self:Features 334
    send Line:Snap 389()]
```

© 1988 3M Company

Measurements 150 (FIG. 11) may be graded to a given size by retrieving a record of the form <value fit-ease design-ease> from a graded-data slot 520 corresponding to the given size, splitting it up, and filling in a value slot 516, a fit-ease slot 524, and a design ease slot 526 with the results. In the system as described, ease 528 and adjustment 530 slots are emptied at this step in the process to allow the demon mechanism to operate during adjustment step 212. This is shown in the following method description.

```
[define MEASUREMENT:GRADE 522 (new-size)
(*The Value, Fit-Ease, and Design-Ease slots are filled in with
information retrieved from the Graded-Data slot, which contains
for each known size a record of the form
<Value Fit-Ease Design-Ease>.)
let measurement-record be the record in self:Graded-Data 520
corresponding to new-size
fill in self:Value 516 with measurement-record.Value
fill in self:Fit-Ease 524 with measurement-record.Fit-Ease
fill in self:Design-Ease 526 with measurement-record.Design-Ease
remove values from self:Ease 528 and from self:Adjustment 530]
```

© 1988 3M Company

Points 164 (FIG. 9) may be graded by fetching the stored position for the requested size from a graded-positions slot 408 and saving it in a position slot 406, as follows. In the preferred embodiment, a position is simply an (x y) pair.

```
[define POINT:GRADE 356 (new-size)
(*Instantiate the Position data for new-size in this Point)
```

-continued

```
fill in self:Position 406 with (fetch Position from self:Graded-
Positions 408 for new size)]
```

© 1988 3M Company

A line 162 (FIG. 8) in the system as described here may vary from size to size for two reasons. First, the positions of points comprising the line (which may be contained in a knots slot 382) may vary from size to size, and that data typically resides in the constituent points. Therefore, the method for grading points 164 as described above will preferably automatically cause a line to be drawn in proper position for a given size. Second, as discussed above in the description of line object 162 and in the description of annotation 114, the set of points 164 comprising a particular line 162 may vary from size to size due to the placement of alignment guides and the occurrence of line intersections. A process for grading lines, as described in the following pseudo code, fetches a size-specific list of points from a line's graded-data slot 383 and places the list in the line's knots slot 382.

```
[define LINE:GRADE 356 (new-size)
(*Fill in the line's Knots slot 382 with the proper complement
of Points 164 corresponding to new-size)
fill in self:Knots 382 with (fetch from self:Graded-Data 383
for new-size)]
```

© 1988 3M Company

In the present embodiment, adjustment process 212 operates on individual points, lines, darts, etc., and redrawing process 216 resolves the discontinuities that may result, as shown in FIG. 46. Redrawing process 216 discovers these discontinuities by comparing the positions of points with their positions in the unaltered lines. The positions of points in an unaltered line may be stored in a snapshot slot 388 (see FIG. 8) in each line instance 162. In the system as described, snapshots are generated for each line in a garment after the garment is graded by invoking a snap method 389 for each line. The resulting snapshot, stored in the line's snapshot slot 388, may be a collection of records of the form <point position> where point is a pointer to a point instance 164 in the list of the line's knots 382, and position is the (x,y) position of that point as fetched from the point's position slot 406 at the time of the snap operation.

```
[define LINE:SNAP 389( )
        (*Take a snapshot to assist in later updating. This is typically done after all the
        Points in this Line's Knots have been graded.)
    remove all values from self:Snapshot 388
    for each Point 164 in self:Knots 382
        add to self:Snapshot 388 the record <Point Point:Position>]
```

© 1988 3M Company

Darts 160 (FIG. 14) may be graded by filling in a to-close slot 558 with data retrieved from a graded-data slot 560. In the present system, the to-close slot of each dart contains a record of the form <pivot rotation translation> specifying what must be done to close the dart so that the line broken by the dart will be continuous. The semantics of the to-close record are provided in the description of dart objects in the section "Description of Objects".

```
[define DART:GRADE (new-size)
        (*Fill in the To-Close slot with data retrieved from Graded-Data for new-size.)
    fill in self:To-Close 558 with (fetch from self:Graded-Data 560 for new-size)]
```

© 1988 3M Company

Knowledge-Based Grading

Knowledge-based grading (FIG. 16) is a preferred process of configuring a project or garment in one of a set of pre-determined sizes, given graphical data for another size. In the preferred embodiment, it is not normally used as a grading step 210 in fitting process 134, but rather is typically used to produce graded pattern data 131 for the pre-determined sizes themselves.

Figure 16:
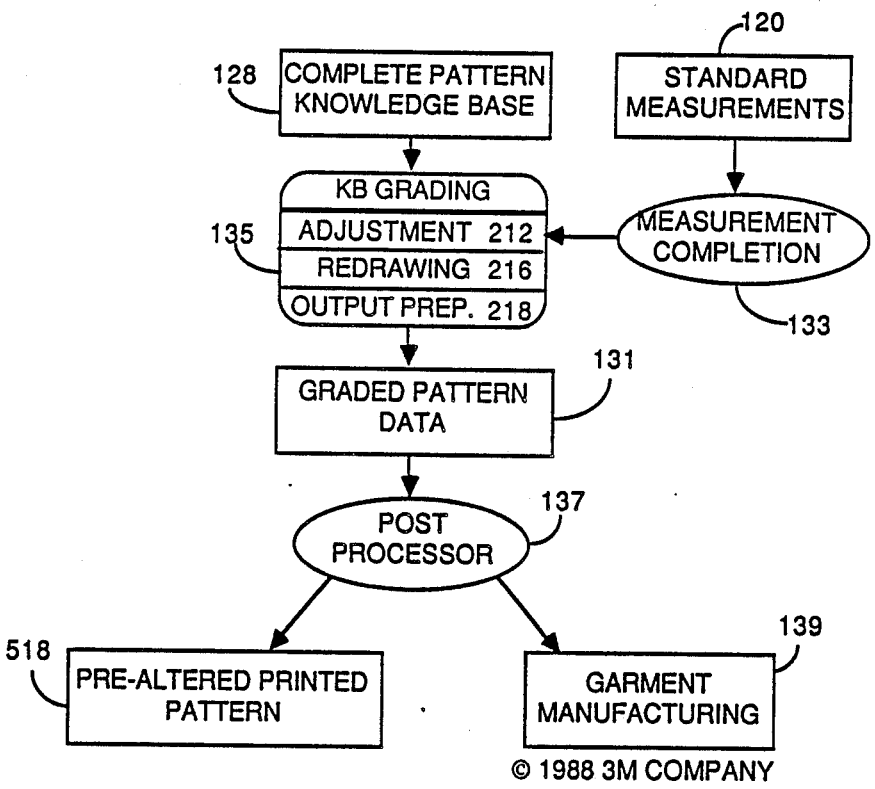
FIG. 16 represents a preferred flow of data through a knowledge-based grading system.

Two approaches to knowledge-based grading are described herein; those skilled in the art will recognize that others are also possible. The first approach, as illustrated in FIG. 16, simply uses a set of standard body measurements 120 corresponding to each of the desired graded sizes to drive a normal fitting process 135 from a single base size, thereby producing graded pattern data 131.

If the fitting process being used requires body measurements that are not known for the various standard sizes, they may be derived from known measurements by establishing proportionally factors among the measurements based either on statistical studies of anthropometric data or on measurements of existing garments in various sizes that are known to fit satisfactorily. These proportionality factors may then be expressed in terms of derivation descriptions 735 (FIG. 15), which may be simply algebraic formulas of the form m=f(m1, m2, . . . ), where m is the unknown measurement, and m1, m2, etc. are either known or can in turn be derived from known measurements. A measurement completion process 133 may then use the derivation descriptions to automatically derive estimates for body measurements that are expected by measurement constraints 150 but are missing from a particular set of standard or individual body measurements.

A second approach to knowledge-based grading uses knowledge about particular garments as derived during pattern preparation 110 along with generic knowledge about grading as contained in measurement template objects 600 (FIG. 37) and knowledge about the desired pre-determined sizes as contained in grade-sets 775 (FIG. 20). The first approach described here has the advantage of being very easy to use; the second has the advantage of enhanced flexibility for the garment designer in terms of changing garment proportions across the size range. The second approach will be described in more detail below.

Generic knowledge about grading could comprise grade descriptions (e.g., a grading factors slot 517 in a measurement instance 150 (FIG. 11) that describe how physical dimensions of garments should vary from one size to the next. As shown in FIG. 21, a set of pre-determined sizes may be thought of as a graph. A knowledge-based grading process, as described in the following pseudo code, can operate by finding a path through this graph from the current base size to a desired new-size, then adjusting the various measurements according to this path in a manner analogous to preferred adjustment process 212 as used in preferred fitting process 134

In the preferred embodiment of the present system, both types of connections are implemented by grade set objects 775 (see FIG. 20, Table 17). Grade range connections such as 772 (FIG. 21) may simply be successive elements in a sizes slot 778 of a particular grade set instance 775. In a system containing more that one grade set, a special grade set may be allocated whose sizes are a list of base sizes 777 of various grade sets 775. This special set is referred to in the following pseudo code as a meta-set.

```
[define FIND-GRADE-PATH (old-size new-size)
        (*Find a path through the grade graph (see FIG. 21) from old-size to new-size. A
        path is a series of steps that leads through the graph along defined connections.)
    let old-set be the grade-set containing old-size
    let new-set be the grade-set containing new-size
    if old-set ≠ new-set, then
        return a list composed of a path from old-size to the base-size of old-set,
        a path from the base-size of old-set to the base-size of new-set in meta-set, and
        a path from the base-size of new-set to new-size
    else,
        return a path from old-size to new-size within old-set]
```

© 1988 3M Company and as described in a subsequent section, then updating part geometry as in preferred redrawing process 216, and finally preparing the data for output as in preferred output preparation process 218. Note that line snapshots are generated twice in the following pseudo code; once before applying the couplings that account for grading adjustments, and once before applying couplings as part of a subsequent adjustment process 212.

Adjustment step 212 of fitting process 134 in the preferred embodiment consists primarily of calculating adjustments and applying couplings. These operations are described below under adjustment process 212. A grade-adjust process, as described by the following pseudo code, is an alternative to a fitting adjustment process. In this case, the calculated adjustment is not typically based on body measurements, but instead on

```
[define GARMENT:KB-GRADE 321 (new-size)
        (*Alter a garment to conform to the dimensions corresponding to new-size)
    let grade-path be the value of find-grade-path(current-project:Base-Size new-size)
    for each Measurement 150 in self:Measurements 316
        send Measurement:Grade-Adjust 523 (grade-path)
    for each Part 152 in self:Parts 314
        for each Line 162 among Part:Features 334
            send Line:Snap 389( )
        for each Measurement 150 in self:Measurements 316
            send Measurement:Process-Couplings 536( )
        for each Part 152 in self:Parts 314
            send Part:Update 346( )
            for each Line 162 among Part:Features 334
                send Line:Snap 389( )]
```

© 1988 3M Company

Those skilled in the art will recognize that in the above pseudo code the measurement:process-couplings, part:update, and second line:snap steps could be folded into the remainder of the fitting process, yielding an improvement in efficiency. It will also be recognized that if direct output of graded data is desired, a final prepare-for-output step could be added to the above process.

As shown in FIG. 21, a set of pre-determined sizes may be thought of as having two types of connections. Connections among individual sizes within a grade set, as symbolized by arrows 771, 772, and 773, may be thought of as grade-range connections. Connections among the base sizes of the various grade sets 775 (such as Misses 10 774), as symbolized by arrow 770, may be thought of as grade-set connections. A grade path, as produced by a process described by the following pseudo code, may comprise a series of steps through this graph along defined connections. For example, a path from Misses 12 to Juniors 5 according to the connections defined in FIG. 21 would be (Misses 12, Misses 10, Juniors 9, Juniors 7, Juniors 5).

grading factors 517 stored in individual measurement objects 150 and on grading indices stored in sizes slots 778 in grade-set objects 775. The grade-path calculated above may be broken down into a sequence of grade steps, and each transition may be matched with a range entry in a grading-factors slot 517 in a measurement object 150 and with entries in sizes slot 778 in grade-set objects 775. The resulting factors may be multiplied together and summed, as shown below, to yield an adjustment value.

```
[define MEASUREMENT:GRADE-ADJUST 523 (grade-path)
(*Calculate an Adjustment 530 for a particular
Measurement object 150 by matching up
successive entries on grade-path with entries in self:Grading-Factors
517)
consider grade-path to be a sequence grade-step1 . . . grade-stepn
fill in self:Adjustment 530 with
```

$$\sum_{k=1}^{n-1} \text{grade-factor}_k \cdot (\text{grade-index}_{k+1} - \text{grade-index}_k)$$

where

-continued grade-factor$_k$ is the number corresponding to the transition from >>
grade-step$_k$ to grade-step$_{k+1}$ in self:Grading-Factors 517,
and
grade-index$_k$ is the index corresponding to
grade-step$_k$ from the grade-set >>
that covers the range grade-step$_k$ to grade-step$_{k+1}$]

© 1988 3M Company

The remainder of the knowledge-based grading process in the preferred embodiment is identical with adjustment 212 and redrawing 216 steps of fitting process 134.

Project Grading

The capability to grade an entire project is provided in the present embodiment for completeness and convenience. At the project level (FIG. 4), grading process 302 consists of first checking to ensure that the requested size is available, and then sending grade messages 320 to all the garments listed in garments 300 specifying the new size. If retrieval grading is to be used as defined above, it is preferably an error to request grading to a size that has not been supplied in the original input data; available sizes may be those that comprise a list in known-sizes slot 308 of a particular project 146.

```
[define PROJECT:GRADE 302 (new-size)
        (*Grade all garments in this project to new-size)
    if new-size is not a member of self:Known-Sizes 308
        throw an error "unknown size"
    for each Garment 148 in self:Garments 300
    send Garment:Grade 320 (new-size)]
```

© 1988 3M Company

Summary of Grading

In the preferred embodiment, grading may be used to produce a version of a garment or project in one of the so-called "standard sizes". In the case of retrieval grading, the size must be one of the sizes available in the original data, the list being stored in known sizes slot 308 of a project instance 146 (FIG. 4). In the case of knowledge-based grading, the original graphic data is preferably altered using adjustment 212 and redrawing 216 processes according to a description of grades and adjustments contained in measurement instances 150. When preferred grading process 210 is used as a part of preferred fitting process 134, the next step in the preferred embodiment is adjustment process 212, as described below.

ADJUSTMENT 212

Introduction

In the preferred embodiment, an adjustment step 212 of the fitting process is responsible for computing and applying the changes that are required to alter standard size garments to fit an individual. Prior to this step, the garments in a pattern KB have been graded to a known size 308 that most closely matches an individual's body measurements 132. After preferred adjustment process 212 is completed, the various graphical features will have been moved, scaled, rotated, etc. as needed, but these changes will not have been coordinated between features. This situation is illustrated in FIG. 46, which shows a line 234 after grading 210 has positioned its points according to one of the known-sizes 308, as previously described; the same line 235 after adjustment 212, the process currently being described, has moved a point; and again the same line 236 after redrawing 216, a process yet to be described, has redrawn the line to account for the movement of the point.

In the preferred embodiment, four major operations comprise the adjustment step, all controlled by methods in measurement instances 150 (FIG. 11). These preferred methods are determine-fit-ease 525, which adjusts the fit ease of a particular measurement to account for body proportions as determined from body-measurements 132 and to account for personal preferences as listed in ease preference slot 733 (FIG. 15), determine-ease 529, which combines fit-ease and design-ease and takes into account dependencies among the various measurements of a garment with respect to total ease, determine-adjustment 531, which computes the amount by which a particular physical dimension of a garment needs to be changed to fit the given body-measurements 132, and process-couplings 536, which applies the computed adjustments to the garment pattern data in order to accomplish the desired change in physical dimension by altering the points and lines depicting a garment as determined by couplings 220 (FIG. 45), residing in slot 534, that were generated during pattern preparation.

Couplings

In the preferred embodiment, adjustment process 212 may be initiated by invoking a process-couplings method 536 in each of the measurement instances 150 listed in a measurements slot 316 of a garment 148. The remainder of an adjustment process 212 may be implemented to occur as fetch demon methods determine-fit-ease 525, determine-ease 529, determine-adjustment 531, and get-adjusted-value 535 are invoked; the details of the control flow preferably depend on the contents of the couplings and the various demon methods. Alternative approaches would include fetching the ease and adjustment values before invoking the process-couplings method, thereby causing the demon methods to perform the necessary calculations, or calculating the various ease and adjustment values explicitly in such a way as to ensure that a calculation is not attempted until the results of other calculations it depends on are available.

In the preferred embodiment, a coupling 220 (FIG. 45) is a description of what has to be done to a garment to account for an adjustment to a particular measurement; it "couples" an adjustment to the features of the garment and its parts. Couplings 220 may be records of the form <comment features operation parameters predicate> as shown in FIG. 45. As implemented, comment 222 contains a human-readable description of the coupling, for the convenience of a programmer. The list of features that are the subject of the coupling may be contained in a features slot 224. Preferred operation 226 may specify the operation to be performed on the features, such as move, scale, rotate, etc. Parameters 228 may be a list of forms to be evaluated that yield a list of parameters appropriate for the specified operation. For example, if the operation is move, evaluation of the parameters may yield a list of the form (x-offset y-offset). A predicate 230, when present, may be evaluated to yield a boolean value that will block application of the coupling if it is false.

The following coupling, from an example measurement instance called "Waist-Circumference", shows how the waist seams on a garment could be changed in response to a calculated adjustment. In this example, features 224 is a list of affected garment features, listed by name, operation 226 is "scale", which will cause the lines to be expanded uniformly according to the adjustment, and parameters 228 is a list of one item, a form to be evaluated by a Lisp interpreter. In standard notation, it would read $$1 + \frac{\text{Adjustment}}{\text{self:Value}}$$

In other words, if the value of the waist-circumference were 50 cm and the adjustment turned out to be 10 cm, the argument to the scale operation would be 1.2. In this example, predicate 230 is empty, meaning that the coupling will always be applied when a measurement instance containing this coupling receives a process-couplings message.

| WAIST-CIRCUMFERENCE: | |
|---|---|
| Comment 222: | "Scale waist seams on back and front" |
| Features 224: | (waist-front waist-back) |
| Operation 226: | Scale |
| Parameters 228: | ((+1 (/ Adjustment (self:Value)))) |
| Predicate 230: | — |

© 1988 3M Company

Couplings 220 as described above may be interpreted or "applied" by a process-couplings method 536, described below. There may be several couplings in couplings slot 534, each of which is typically processed individually. When predicate 230 is blank, or if evaluation of the predicate produces a true value, then processing may proceed; otherwise no further action is typically necessary. Parameters 228 may then be evaluated, and the resulting list may be used as the set of arguments for a message, as specified by operation 226, to be sent to each of the listed features 224.

```
[define MEASUREMENT:PROCESS-COUPLINGS 536 ( )
        (*Use the Couplings to apply the Adjustments to the parts and features of Garment)
    for each Coupling 220 in self:Couplings 534
        if either a) Predicate 230 is blank, or
                b) evaluation of Predicate 230 yields true, then
            evaluate Parameters 228 of Coupling in a context>>
                    including (Self ← self), (Garment ← self:Garment 514),
                            (Adjustment ← self:Adjustment 530),
                            and (Person ← body-measurements 132)
            for each of the Features in Coupling
                send Operation of Coupling to Feature with the calculated Parameters]
```

© 1988 3M Company

A critical step in the preferred method shown above is setting up an evaluation context for parameters 228; recall that evaluation, in the preferred embodiment, refers to invoking an interpreter. The evaluation context shown above defines four symbols, which may be referred to by the text of the couplings. They are self, the measurement instance itself; garment, fetched from the measurement's garment slot 514; person, the body measurements 132 being adjusted for; and adjustment, fetched from the measurement's adjustment slot 530. Since fetching from adjustment slot 530 may be implemented to automatically invoke determine-adjustment demon method 531, the adjustment may automatically be calculated at this time. An adjustment calculation in turn typically refers to ease slot 528, automatically invoking a determine ease demon method 529, which in turn preferably refers to fit-ease slot 524, automatically invoking a determine-fit-ease demon method 525. An adjustment calculation may also refer to the adjustments of other measurement instances, in turn triggering the necessary calculations in those instances.

Adjustments

In the preferred embodiment, adjustment slot 530 of a measurement instance 150 may contain either a default process, given here, or a specialized process, an example of which is provided below. The default process in the preferred embodiment subtracts the contents of value slot 516 of the measurement instance from the sum of the corresponding body measurement, as determined from body-measurements 132, plus the contents of ease slot 528 of the measurement, as shown in the following pseudo code. As is typical in a fetch demon method, the current value of the slot, when present, may be used; otherwise a new value may be computed and placed in the slot. In this way, each slot value need be computed only once per fitting, regardless of the number of times it is accessed. Note that this approach typically requires that the slot be emptied before the commencement of adjustment process 212. In the current system, this is accomplished in measurement:grade method 522 as described above.

```
[define MEASUREMENT:DETERMINE-ADJUSTMENT 531 (current-value)
        (*This is the default demon for Adjustment slot 530 of a Measurement instance 150. It
        is activated when the slot to which it is attached is accessed. The value returned
        by this function is seen as the value of the slot. The current-value parameter is the
        current value contained in the slot. If it is non-empty, it will be used; otherwise a
        new value will be calculated and stored in the slot.)
    if current-value is non-empty return it
    else
        let calculated-value be
            ((the contents of the body-measurements 132 slot>>
                whose name matches self:Name 512)+
                self:Ease 528)−
                self:Value 516
                fill in self:Adjustment 530 with calculated-value
```

-continued

```
return calculated-value]
```

© 1988 3M Company

An example of a specialized process for determine-adjustment 531 that depends on the adjustments 530 of a number of other measurement instances 150 is shown in the pseudo code below. Before this computation is complete, adjustments 530 will probably have been computed by the respective determine-adjustment demon methods 531 for measurement instances 150 named back-wedge, front-wedge, waist-to-hip-back, waist-to-hip-front, and crotch-depth, and ease 528 will preferably have been filled in by a determine-ease demon method 529 for the measurement instance 150 containing this particular process for the determine-adjustment method 531.

```
[define MEASUREMENT:DETERMINE-CROTCH-LENGTH-ADJUSTMENT 531 (current-
value)
        (*The crotch length adjustment depends on the adjustments for back wedge, front
        wedge, back hip-to-waist, front hip-to-waist, and crotch depth.)
    if current-value is non-empty return it
    else
        let calculated-value be
            (personal crotch length measurement + self:Ease 528)−
            (self:Value 516+
                (a measurement instance 150 named Back-Wedge):Adjustment 530+
                (a measurement instance 150 named Front-Wedge):Adjustment 530+
                (a measurement instance 150 named Waist-to-Hip-Back):Adjustment 530+
                (a measurement instance 150 named Waist-to-Hip-Front):Adjustment 530+
                (2.(a measurement instance 150 named Crotch-Depth):Adjustment 530))
        fill in self:Adjustment 530 with calculated-value
        return calculated-value]
```

© 1988 3M Company

Calculation of an adjustment 530 normally refers to the value of ease slot 528 of the same measurement instance 150. The value contained in an ease slot 528 may automatically be derived on demand by demon method determine-ease 529. A default process for a determine-ease method 529 may simply add the fit-ease 524 to the design-ease 526 as shown here.

```
[define MEASUREMENT:DETERMINE-EASE 529 (current-value)
        (*This is the default demon for the Ease slot of a Measurement object. It is activated
        when the slot to which it is attached is accessed. The value returned by this
        function is seen as the value of the slot. The current-value parameter is the current
        value contained in the Ease slot. If it is non-empty, it will be used, otherwise a new
        value will be calculated and stored in the slot.)
    if current-value is non-empty return it
    else
        let calculated-value be self:Fit-Ease 524 + self:Design-Ease 526
        fill in self:Ease 528 with calculated-value
        return calculated-value]
```

© 1988 3M Company

The example below illustrates a specialized process for a determine-ease demon method 529. In this case, the ease 528 of a measurement instance 150 named "crotch length" being computed, and it depends on the value of ease slot 528 of another measurement instance 150 named "crotch depth", and the demon mechanism ensures that the crotch depth ease is available when it is needed. The factor of 1.6 used for relating crotch length ease to crotch depth ease in this example is empirically derived.

```
[define MEASUREMENT:DETERMINE-CROTCH-LENGTH-
EASE 529 (current-value)
```

-continued

```
        (*This is the demon for the Ease slot of a Measurement
        object that describes the Crotch Length measurement
        on a pair of pants. The fitting ease for crotch length is
        a constant times the crotch depth ease plus
        the design ease for the crotch length.)
    if current-value is non-empty return it
    else
        let calculated-value be
            (1.6 · (a measurement instance named "crotch-
            depth"):Ease 528) + >>
            self: Design-Ease
        fill in self:Ease 528 with calculated-value
        return calculated-value]
```

Figure 15:
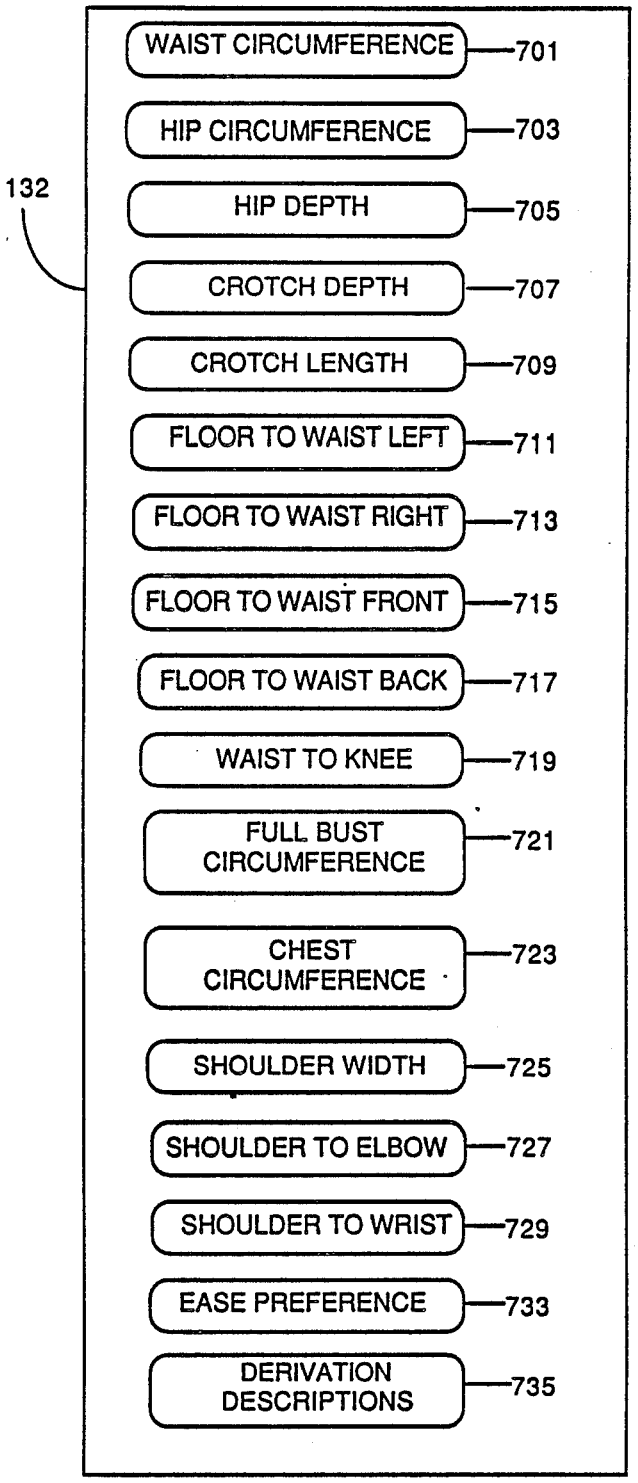

Ease calculations may be used to determine relationships between body measurements 132 and physical dimensions of a garment. These calculations normally refer to contents of a fit-ease slot 524 of the same measurement instance, which may automatically invoke a determine-fit-ease demon method 525. In the preferred embodiment, a user's personal preference related to desired fit may be accepted as an ease preference slot 733 of body measurements 132 (FIG. 15). As implemented, a default process for a determine-fit-ease demon method 525 returns the value of fit-ease slot 524 modified in accordance with a user's ease preference value. Preference-values slot 533 in measurements 150 (FIG. 11), in the system as described, may contain constraints on ease preference in the form of two ratios, called tight-ratio and loose-ratio, and the ease-preference slot 733 of body measurements 132 may have one of the values tight, normal, or loose.

```
[define MEASUREMENT:DETERMINE-FIT-EASE 525
(current-value)
        (*The parameter value is the current value of
        the fit-ease slot. This demon method
        accounts for personal preference according to
        the expressed personal preference and
        the contents of the preference-values slot,
        and returns the (potentially) modified
        fit-ease value.)
    if either (a) self:Preference-Values 533 is empty, or
                (b) Body-Measurements:Ease-Preference 733 is
                "tight" then
            return (value · tight-ratio)
          else if Body-Measurements:Ease-Preference
          733 is "loose" then
            return (value · loose-ratio)]
```

Adjustment Operations

In the preferred embodiment, once parameters 228 of a coupling 220 (FIG. 45) have been evaluated, a final step in applying couplings is to send the message specified by operation 226 to each of the features listed in features 224 of the coupling. The repertoire of coupling operations available in the present system includes point:move 410, line:move 393, line:scale 395, line:-change-angle 396, dart:move 561, dart:length 562, and dart:widen 564.

A point 164 may be translated or moved by invoking its move method 410, which in the preferred embodiment changes the x and y components of the contents of its position slot 406, as shown below.

```
[define POINT:MOVE 410 (delta-x delta-y)
        (*Move this Point by changing its Position)
    add delta-x to the x-component of self:Position 406
    add delta-y to the y-component of self:Position 406]
```

A line 162 may be translated or moved by invoking its move method 393, which in the preferred embodiment moves all points 164 listed in knots slot 382, and by then modifying each of the entries in snapshot slot 388 by the same delta-x, delta-y amounts, as shown below. In the preferred embodiment, modification of the snapshot entries 388 is necessary because moving a line does not distort it, although it may distort other lines, and because comparison between the snapshot data and the final actual positions of the same points is used during redrawing process 216 to determine the amount by which the line has been distorted during adjustment process 212.

```
[define LINE:MOVE 393 (delta-x delta-y)
        (*Move all the Knots of Line by delta-x, delta-y, and
        move the snapshot data by the
        same amount to
        prevent triggering a reshape)
    for each Point 164 in the self:Knots 382
        send Point:Move 410 (delta-x delta-y)
        if there is an entry for this Point in self:Snapshot
        388, then
            translate the Snapshot position for this Point by
            delta-x, delta-y]
```

In the preferred embodiment, each line 162 includes a scale method slot 395, which may be used to change the length of the line without changing its shape by isomorphic scaling, as illustrated in FIG. 22. Because the shape is not changed, the snapshot data 388 will also preferably be modified, as illustrated below, to avoid having redrawing process 216 attempt to reshape the line. The "scale-factor" argument may be a ratio specifying the amount by which the line is to be shrunken or expanded, with a value of 1.0 causing no change to the line. The scale method may also take an optional argument called "origin", specifying that one of the points on the line is to remain fixed during the scaling operation. If this argument is not given, the first point in the list of knots will typically remain fixed. FIG. 22 illustrates the operation of this method; 287 is a line before scaling, and 288 is the same line after scaling by 1.5 with a point 280 as the origin. Note that darts may be handled in such a way as to be unchanged by this operation.

```
[define LINE:SCALE 395 (scale-factor origin)
        (*Scaling changes the length of a line by scale-factor
        without changing its shape. The
        parameter origin is the Point in the Knots of
        this Line that is to remain fixed in
        the process. The Snapshot data will be updated
        in the scale-knots routine to avoid
        triggering reshaping.)
    if origin is blank, let origin be the first point in self:Knots)
    scale-knots (self scale-factor (the list of Knots from
    origin to the end) scale-knots (self scale-factor
    (the list of (reverse Knots) from origin to the start))]
```

In the preferred embodiment, most of the work of scaling lines is performed by a scale-knots process, shown below. Referring to FIG. 22, point 280 is the first point in the list "knots". As implemented, the positions of points 281 and 282 are scaled about point 280; then, the dart and points beyond the dart, that is points 283, 284, 285, 286, and all points on line 287 beyond point 286, are moved the amount by which point 282 was moved; the origin is then moved to point 284, and the remainder of the knots are then scaled about point 284 in the same fashion.

```
[define SCALE-KNOTS (line scale-factor knots)
        (*Scale the positions of all but the first point 164 in
        parameter knots by scale-factor
        with respect to the position of the first point in
        knots. Update the snapshot data
        388 in line 162 in the process. When a darts is
        encountered, shift it intact and then
        shift the origin across the dart.)
    let start be the position 406 of the first point 164 in knots
    drop the first point 164 from the list of knots
    while there are still points 164 in the list of knots
        (*scale the position of the next knot, keep track
        of how far it moved, and check to see
          whether it was a dart end.)
        let offset be the amount by which the first
        point 164 in knots is moved >>
          as its position 406 is scaled about start by scale-
          factor
        translate the position recorded for this point
        in line:Snapshot 388 by offset
        if the first point 164 in knots is the end
        of a dart or pleat 160)
            (*translate the dart and the remainder of the
            line, shift the origin, and continue.)
              with the Dart 160 of which the first point 164
              in knots is an end
                  send Dart:Move 561 (offset_x offset_y)
              for each point 164 in knots except the first
                  send Point:Move 410 (offset_x offset_y)
                  translate the position recorded for
                  point in line:Snapshot 388 by
                  offset
              set start to the position 406 of the Point
              164 at the far end of this Dart 160
```

-continued

```
drop the first point 164 from the list of knots]
```

A change-angle method 396 may be invoked by a coupling 220 to change the angle specified by an angle dependency in slot 384 of a line 162 (FIG. 8), as shown in the following pseudo code. As previously noted in the description of line object 162, angle-dependencies slot 384 may contain records of the form <point dependent-line angle> which specify that the angle between a line 162 containing the record in its angle-dependencies slot 384 and a dependent-line specified in the record about the specified point must be the specified angle. Since many lines are curved, the angle specified in an angle dependency record is typically the angle between the tangents of the lines 162 at the point 164 where they join.

```
[define LINE:CHANGE-ANGLE 396 (other-line delta)
        (*Find the Angle-Dependency on this Line that
        refers to other-line and change its
        angle by delta.)
    if there is an angle-dependency in self:Angle-
    Dependencies 384 >>
      with dependent-line = other-line, then
        add delta to the angle of this angle-dependency]
```

Both darts and pleats in a garment may be represented by instances of dart 160 (FIG. 14), and they may be distinguished by the value of the type attribute, listed in attributes slot 556. For the purpose of the present discussion, both will be referred to as "darts".

As shown in the following pseudo code, a move method 561 for dart instances 160 may be invoked during line:scale 395, as described above. Features 154 listed in the dart's features slot 555 may then be moved by sending move messages to them, and the position of the pivot listed in the dart's to-close slot 558 may be translated by the given delta-x, delta-y.

```
[define DART:MOVE 561 (delta-x delta-y)
        (*Move this Dart by moving its features and the
        pivot point in its to-close slot)
    for each feature in self:Features 555
        send feature:Move (delta-x delta-y)
    translate the pivot in self:To-Close 558 by (delta-x delta-y)]
```

In the preferred embodiment, adjustment methods for darts 160 may include lengthen 562 and widen 564. The lengthen operation may change the length of a dart without changing its angle or the length of the line intersected by the dart, as shown in FIG. 27, and is preferably meaningless for dart instances 160 that are identified as pleats, the identification being accomplished in the preferred embodiment by the value of a type attribute in an attributes slot 556. Darts may be lengthened by scaling them by the ratio $$\frac{\text{new-length}}{\text{old-length}},$$

as shown in the following pseudo code. Referring to FIG. 27, the dart itself, including point 754 and the to-close data for the dart, and the portion of the line 757 between the two dart ends 752 and 755 may be scaled by this process; the portion of line 757 beyond point 755, including 756, may then moved by the amount by which point 755 is moved. Therefore this process preserves the length of the original line 757 as it appears on a garment; i.e. with the dart closed.

```
[define DART:LENGTHEN 562 (new-length)
(*Make the length of this dart be new-length. The length is defined as the length of
one of the lines describing the dart from the seam line to the dart point. It is
assumed that both sides of the dart will be the same length. The length of a dart is
changed by scaling the dart about its initial end. Note that this operation is
meaningful only for darts, not pleats. FIG. 27 shows the result. Here, the initial end
of the dart is 752. It is necessary that the portions of the perimeter line to the left
of 752 and to the right of 755 retain their original lengths. This description will use
the nomenclature of the figure.)

let scale-factor be the ratio new-length / (length of the segment (point 752) − (point 754))

scale-knots (self:Line scale-factor ((self:Line 554):Knots 382))
let offset be the amount by which point 755 was moved
move point 753 by one-half of offset
scale pivot of self:To-Close 558 about point 752 by scale-factor
translate the portion of (self:Line 554) beyond point 755 by offset
update snapshot records in (self:Line 554):Snapshot 388 >>
for all Points 164 in (self:Line 554):Knots 382 that were moved]
```

© 1988 3M Company

In the preferred embodiment of the system, widening a dart or pleat causes it to occupy more space on the line 162 that is broken by the dart, the line preferably being listed in the dart's line slot 554. This may be done without changing the length that the line in slot 554 will have when the dart is closed or sewn together, as in a finished garment. The rotation angle in the dart's to-close slot 558 is also typically changed unless the dart closes with a translation rather than a rotation, in which case the translation in the to-close slot 558 is preferably changed instead. As shown in FIG. 28 and in the following code, this may be achieved with a one-dimensional scaling operation anchored along a line 767 through a point 762 parallel to the centerline of the dart or pleat. The length of the line on the finished garment may be preserved by shifting all points on a line 768 that lie to the right of point 765 by the same amount that point 765 was moved by this process. In the following pseudo code, the notation $point_x$ is shorthand for "the x component of the contents of position slot 406 of a point 164".

```
[define DART:WIDEN 564 (ratio)
        (*Change the width of this Dart 160 by ratio. Refer
```

-continued

```
        to FIG. 28 for point references. If
        rotation is given in self:To-Close 558, adjust
        it; otherwise, adjust the translation.
        Both situations can be handled by a
        one-dimensional scaling operation
        perpendicular to the centerline of the dart.
        Note that the centerline is by definition
        the perpendicular bisector of the line between
        the two dart ends (762 and 765 in the
        figure). The description is in terms of the
        point names used in the figure.)
let dart-points be the collection of all points
164 derived from self:Features 555, >>
  along with all points 164 in knots 382 of
  self:Line 554 between points 762 and 765
    (*This includes the points 164 from knots
    slots 382 of any lines 162 listed in
    self:Features 555)
let p1 be point 762
let p2 be point 765
let original-p2 be a copy of p2:Position
let dart-direction be the direction from p1 to p2
for each point 164 in dart-points
    rotate point:Position 406 about p1:Position
    by (−dart-direction)
    replace point_x with (p1_x + ((point_x − p1_x) · ratio))
    rotate point:Position 406 about p1:Position
    by dart-direction
let offset be (p2:Position - original-p2)
    (*This is the amount by which p2 was moved)
translate pivot of self:To-Close 558 by one-half of offset
if rotation of self:To-Close 558 is not empty, then
    set rotation of self:To-Close to the angle
    formed by the new positions of >>
      p1,pivot of self:To-Close, and p2
if translation of self:To-Close 558 is not empty, then
    add offset to translation of self:To-Close
translate the portion of self:Line 554 beyond p2
by the offset, and update >>
    snapshot records in (self:Line 554):Snapshot
    388 for all points 164 in >>
    (self:Line 554):Knots 382 that have been moved]
```

Summary of Adjustment

An adjustment process, in the preferred embodiment, is used to apply constraints that relate aspects of body measurements 132 to the graphical features of the garments in a project. These constraints, as described herein, take the form of adjustment calculations that relate body measurements contained in body measurements 132 to individual garment measurements 150, and couplings that relate those garment measurement adjustments to the graphical features of the garments. After adjustment, the graphical description of a garment is typically inconsistent; a redrawing process 216, as described below, may be used to restore consistency.

REDRAWING 216

Introduction

In the preferred embodiment, a redrawing process 216 is used during fitting process 134 to restore continuity to lines on which individual points have been moved as a result of applying the couplings during adjustment process 212 and to satisfy other geometric constraints that are represented in the prepared pattern KB 128. Parts 152 may be redrawn by sending update messages 380 to the individual lines 162 (FIG. 8) as listed in features slot 334 of each part 152 (FIG. 6). In the present system, the order in which this is done is controlled by an ordered list of lines 162 contained in a part's update-sequence slot 352, which may be used to ensure that, in each dependency relationship between two lines 162, the independent line is updated before the dependent line. In the system as described, dependency relationships may be either endpoint-midpoint dependencies or angle dependencies. In an endpoint-midpoint dependency, shown in FIG. 48, the independent member may be shown as a line 238 on which a shared point 240 is a midpoint, and the dependent member may be shown as a line 239 on which a shared point 240 is an endpoint. An angle dependency, shown in FIG. 47, is typically a record of the form <point dependent-line angle> contained in an angle-dependencies slot 384 of a line 162. The independent member of this relationship 242 may be a line containing the angle-dependency record, and the dependent member 243 may be a line referred to as dependent-line in the angle dependency record.

Redrawing Parts

Parts 152 may be redrawn by sending update messages 346 to them, invoking a process as described in the following pseudo code. In the preferred embodiment, each line included in a part's features, as listed in slot 334 (FIG. 6), includes a requested-changes slot 394 (FIG. 8) that is used to communicate dependencies among lines during redrawing 216. These slots are typically emptied at the beginning of the process. Each line 162 may then be sent an update message, the order typically being controlled by the part's update-sequence slot 352 as described above.

```
[define PART:UPDATE 346 ( )
        (*Update all features in this part after making
        fitting adjustments. Note that most
        of the adjustments simply move points and
        lines, and may also request future
        changes in angle dependencies. The result
        is that many of the lines are now
        discontinuous or do not meet properly. The
        Update process redraws lines and adjusts
        other features to accommodate these changes.)
    for each Line 162 among self:Features 334
        remove all values from Line:Requested-Changes
    for each Line 162 in the ordered list self:Update-Sequence 352
        send Line:Update ( ) 358]
```

Redrawing Lines

Lines 162 (FIG. 8) are redrawn, in the preferred embodiment, by a process residing in update slot 358, as illustrated by the pseudo code below. Update slot 358 may be inherited from features 154, a superclass of line 162, but the process described here is preferably unique to instances of the line class 162. Since darts or pleats 160 may break a line 162 up into segments, any darts that lie along a line are typically closed before redrawing occurs and opened again afterward. A preferred process of closing and opening darts is described subsequently and is illustrated in FIG. 35.

In the preferred embodiment, an update process 380 is used to restore continuity to a line, otherwise called reshaping the line, as illustrated in FIG. 46. For each point 164 in the line's knots slot 382 for which the current actual position of the point 164 differs from the position recorded for that point in the line's snapshot slot 388, the line may be reshaped according to either a reshape-method recorded for that point in a reshape-methods slot 390 corresponding to the line, or according to a default reshape method.

An additional function of update process 380 as described here is to satisfy angle dependency constraints by propagating angle adjustment requests from independent lines to dependent lines, and by processing angle adjustment requests. As was explained earlier, in the system as described herein, an angle-dependencies slot 384 of an independent line may contain angle-dependency records that specify a dependent line, a point 164 that the two lines share, and an angle that the two lines must form around the given point. A graphic example of an angle dependency is illustrated in FIG. 47, where line 242 is an independent line, 243 is a dependent line, 244 is a point where they meet, and 245 is an angle between them that is to be preserved. As a final step in the process of updating an independent line as described herein, each angle-dependency record residing in the line's angle-dependencies slot 384 is processed, calculating the proper direction for the corresponding dependent line at the common point. A request may then be posted in a requested-changes slot 394 of the dependent line, specifying the type of request, "restore-angle", the common point, and the direction that the dependent line must take at the point. A dependent line, after being reshaped as described below, may pick up requests from its requested-changes slot 394 and invoke its restore-angle method 398 for each one in turn, as described in the following pseudo code.

```
[define LINE:UPDATE 380 ()
        (*Update the positions of the knots forming this
        line to account for motion of points,
        angle dependency adjustments, dart changes,
        etc. Reshape requests are implicit in
        the differences between the positions of points
        and their positions as recorded in a
        snapshot, and other requests are entries in the
        Requested-Changes slot of the form
        <request-type parameters>. All of these operations
        are performed with any darts
        or pleats along this line closed up.)
```

-continued

```
dependent-line:Requested-Changes 394
where direction = (tangent of self at point) +
(angle in angle-dependency record)]
```

Darts 160 (and pleats, which are distinguished, in the preferred embodiment, from darts only by graphic representation and the contents of a type entry in attributes slot 362) may be closed or opened by invoking a close-darts process, which preferably combines segments of a line broken by darts or pleats using coordinate transformation, as described in detail by the following pseudo code. As illustrated in FIG. 35, the line containing the dart comprises two segments 255 and 257 (the points between the two dart ends have been omitted for clarity). The close-darts process may be implemented by searching the given list of points, called knots in the following code, for a point having an entry for a dart-end in an attributes slot 362. One such point is identified as 261 in FIG. 35. If one is found, the dart 160 may be closed using the information in its to-close slot 558. If the to-close data specifies a rotation, the remainder of the points in knots (points beyond 261) may be rotated through an angle 260 specified by rotation about a pivot point 256. Note that this is not necessarily the same point as the dart point 258. If, on the other hand, the to-close data specifies a translation, the remainder of the points in knots may be moved by the specified translation. At this point, the two points 261 and 262 lie on top of one another. Finally, the routine may be invoked recursively, using the list of points beyond the second end 262 of the dart that was closed, to close any further darts that might lie on the line. Darts may be opened instead of closed by this process by specifying a true value for the undo? parameter.

```
[define CLOSE-DARTS (knots undo?)
(*Close up all darts (and pleats) in knots, which is a list of points. If undo? is true,
then open them instead of closing them. Refer to FIG. 35 for a diagram and reference
numbers.)
let first-dart-end be the first point 164 in knots which >>
has a value for dart-end in Point:Attributes 362
if first-dart-end 261 was found, then
let first-dart be the dart 160 indicated by the dart-end attribute of first-dart-end
let dart-to-close be first-dart:To-Close 558
if dart-to-close.rotation 260 is not empty, then
if not undo?, then
let rotation be dart-to-close.rotation
else
let rotation be (- dart-to-close.rotation)
rotate all points beyond first-dart-end in knots about dart-to-close.pivot 256 >>
through the angle rotation
else
if not undo?,then
let translation be dart-to-close.translation
else
let translation be (- dart-to-close.translation)
translate all points beyond first-dart-end in knots by dart-to-close.translation
invoke close-darts ((all points beyond the second end of first-dart in knots)undo?)
```

©1988 3M Company

```
invoke close-darts (self:Knots false)
send self:Reshape 397 ()
for each restore-angle request in self-Requested-
Changes 394
    send self:Restore-Angle 398 (request)
invoke close-darts (self:Knots true)
for each angle-dependency record in self:Angle-
Dependencies
    (*Angle-dependency records are of the form
    <point dependent-line angle>)
    add a record of the form <"restore-angle"
    point direction> to>>
```

Lines 162 may be reshaped by invoking a method in a reshape slot 397 (FIG. 8). Reshaping may be necessary when an individual point 164 is moved independently of a line that includes the point in its knots slot 382. This situation is illustrated in FIG. 46, where 234 is an unaltered line, 235 is the same line after a point 237 has been moved independently of the line, and 236 is the same line after completion of a reshape process such as the one described below. The fact that a point has been moved independently of a line whose knots list 382 contains the point may be detected by comparing the contents of a position slot 406 of the point 164 with the position of the point as recorded in the line's snapshot slot 388. If a line 162 is moved or scaled, the snapshot data for the line is typically updated, as described in adjustment process 212, to reflect the fact that these operations do not change the shape of the line. In general, however, since moving a line means moving all of the points listed in its knots slot 382, other lines that connect to the line being moved will also have those points moved independently of the connecting lines.

In the process described by the following pseudo code, a list of points 164 that have been moved independently of the line 162 is collected, along with, for each such point, the position as recorded in the line's snapshot slot 388, the current position as stored in the point's position 406, and two items fetched from the line's reshape-methods slot 390, a reshape-method and a parameter. These two items may be used to specify a desired shape characteristic of a line. This collection of points and associated reshape data may then be passed off to a process called reshape-curve, to be described subsequently.

```
[define LINE:RESHAPE 397 ( )
(*Scan the contents of Snapshot slot 388 of this Line 162 to find points 164 which have
been moved independently of this line. For each one, look up and apply the reshape
method specified for it in Reshape-Methods slot 390.)
let reshape-points be
for each Point 164 in self:Snapshot 388
when the current position of Point is different from the >>
position recorded for Point in self:Snapshot 388
collect (a record of the form >>
<Point old-position new-position reshape-method parameter>)
where old-position = the position recorded for Point in self: Snapshot, and
new-position = the current value of Point:Position 406, and
reshape-method = the reshape method recorded for Point in >>
self:Reshape-Methods 390, and
parameter = the parameter recorded for Point in self:Reshape-Methods
invoke reshape-curve (self:Knots 382 reshape-points)]
```

©1988 3M Company

The process described by the following pseudo code takes apart the reshape-points list and activates individual reshape processes. For each of the available reshape methods, which in the present embodiment include linear, isomorphic, sinusoidal, and cubic, there is a process that accepts a list of points, an offset, and an optional parameter. Each of them, as described herein, operates by assuming that the last point in the list of points has been moved by the given offset, and moves the remainder of the points to shape the line. For this reason, the process described here manipulates the list of points to ensure that last point is the point being moved. Therefore, in the preferred embodiment, if the first point in a parameter "knots" is the point being moved, the knots are reversed; if a middle point is being moved, the knots are split, and the second portion reversed; and if more than one middle point appears in the reshape-points parameter, the line is split multiple times. This is accomplished in the process described herein by making a recursive call to a reshape-curve process as described by the following pseudo code.

```
[define RESHAPE-CURVE (knots reshape-points)
(*Do the actual reshaping on a line 162 as represented by the list of knots. This is a
recursive process if there is more than one middle point on the line in the reshape-
points list.)
sort the reshape-points to be in the same order as knots
(*Handle the near end and far end first, then see what's left)
if the first point in parameter knots corresponds to the first reshape-point, then
(*The individual reshaping routines, as implemented herein, move the last point)
with the first reshape-point
apply reshape-method to >>
(reverse (knots)
(new-position-(current position of reshape-point))
parameter)
drop the first reshape-point from the list
if the last point in knots corresponds to the last reshape-point, then
with the last reshape-point
apply reshape-method to
(knots
(new-position - (current position of reshape-point))
parameter)
drop the last reshape-point from the list
(*Handle midpoint reshapes recursively)
while there is still at least one reshape-point in the list
with the first reshape-point
apply reshape-method to
((the list of knots from the first to the one >>
corresponding to this reshape-point)
(new-position - (current position of reshape-point))
parameter)
invoke reshape-curve >>
((the list of knots from the one corresponding to >>
the first reshape-point to the end)
reshape-points)
```

-continued

```
drop the first reshape-point from the list]
```

©1988 3M Company

In the preferred embodiment, there are four different methods for reshaping a line in response to independent movement of one of the points in the line's knots slot 382. They are isomorphic, which distributes the change evenly along the length of the line, thereby preserving the overall curvature profile of a line; sinusoidal, which has the effect of preserving the tangents of the original line at the end points and at the moved point; cubic, which concentrates the change closer to the point that was moved, and linear, which applies an anisomorphic coordinate scaling operation to the line. This particular set of reshaping operations has been arrived at by attempting to emulate the manual operations performed by persons skilled in the art of garment pattern alteration. The more typical cubic spline approach was rejected because of the difficulty encountered by inexperienced operators in placement of guide points. Each of the reshaping methods as enumerated above is described in detail below. Each of them is implemented in the preferred embodiment as a process accepting three arguments: "knots", a list of points 164 describing the segment being reshaped; "offset", an amount by which the far end of the segment has been moved; and "parameter", an optional argument whose meaning varies according to the particular reshape method as described below.

The operation of the isomorphic reshape method is illustrated in FIG. 23. A graph 250 shows the preferred relationship between point motion and distance along a segment. The illustration shows an original segment 251 and the same segment 252 after a point 253 is moved and the segment reshaped to accommodate the motion of point 253 according to this method. As can be seen from the illustration in FIG. 23, the effect of this reshaping method is to distribute the change evenly along the length of the segment, thereby causing a minimal amount of overall distortion to the shape of the line. The following pseudo code details how this may be accomplished.

```
[define RESHAPE-CURVE-ISOMORPHIC (knots offset parameter)
(*Redraw the curve represented by knots, moving the far end by offset.
Intermediate Points are moved by an amount equal to the offset times
the ratio of their distance from the near end to the total line
length. The parameter is not used. Graphically, the effect may be
visualized as in FIG. 23.)
let length be the total length of the segment described by knots
let partial-length be 0
while there are at least 3 points in knots
add the distance from the first point to the second point of >>
the list knots to partial-length
move the second point in knots by
```

$$\text{offset} \cdot \frac{\text{partial-length}}{\text{length}}$$

```
drop the first point from knots]
```

© 1988 3M Company

Sinusoidal reshaping, as illustrated in FIG. 24, may be accomplished in a similar fashion to the isomorphic method explained above, except that a sinusoidal transfer function 265 is used instead of a linear one to relate point motion to distance along the line. As can be seen from FIG. 24, the effect of this method of reshaping is to preserve the direction of the segment at both of its end points. For this reason, it is typically used when a middle point along a line has been moved, to avoid the formation of "corners". The following pseudo code details a process that will reshape a line in this manner.

```
[define RESHAPE-CURVE-SINUSOIDAL
(knots offset parameter)
(*Redraw the curve represented by knots, moving the far end
by offset. The parameter is not used. The reshape graph is an offset
sinusoid which has the effect of preserving the tangents of the
original line at its endpoints. This is illustrated in FIG. 24.)
let length be the total length of the segment described by knots
let partial-length be 0
while there are at least 3 points in knots
add the distance from the first point to the second point of >>
the list knots to partial-length
move the second point in knots by
```

$$\text{offset} \cdot \frac{1 - \cos\left(\pi \cdot \frac{\text{partial-length}}{\text{length}}\right)}{2}$$

```
drop the first point from knots]
```

© 1988 3M Company

A cubic reshaping method, illustrated in FIG. 25, also operates on a "transfer function" principle, as did the isomorphic and sinusoidal methods described above. A cubic transfer function 267 has the property that if the slope is p at (0, 0), the slope will be 1/p at (1, 1). Practical limits for the value of p with this approach are from 0.33 to 3.0, since with values much outside this range, the second derivative of the transfer function changes sign within the interval (0, 0) to (1, 1), leading to serious distortion of the line being reshaped. As may be seen in FIG. 25, the effect of this method of reshaping is to concentrate the effect of the point motion closer to the end point that was moved, thereby minimizing disturbance at the opposite end of the segment. The following pseudo code details a process for cubic reshaping, in which the "parameter" argument represents the factor "p" as described above.

```
[define RESHAPE-CURVE-CUBIC (knots offset parameter)
(*Redraw the curve represented by knots, moving the far end
by offset. The reshape graph is a cubic of the form
```

$$y = \left(-2 + P + \frac{1}{p}\right)x^3 + \left(3 - 2p - \frac{1}{p}\right)x^2 + px$$

```
where p is the parameter which gives the slope of the reshape
curve at the origin. The slope at (1,1) is 1/p. This has the effect
of concentrating the change near the endpoint being moved.
Practical limits to the value of the parameter are [.33-3.0] with
this simple formula.)
let length be the total length of the segment described by knots
let partial-length be 0
let p be parameter
while there are at least 3 points in knots
add the distance from the first point to the second point of >>
the list knots to partial-length
let x be
```

$$\frac{\text{partial-length}}{\text{length}}$$

-continued move the second point in knots by $$\text{offset} \cdot \left(\left(-2 + p + \frac{1}{p}\right)x^3 + \left(3 - 2p - \frac{1}{p}\right)x^2 + px\right)$$

drop the first point from knots]

© 1988 3M Company

A linear reshape method operates on a different principle than the "transfer function" principle described for the three methods described previously. This reshape method has the advantage that a curve can be "bounded" as illustrated in FIG. 26. In this example, no point on curve 292 will cross line 296 as long as offset 295 does not cause point 294 to cross line 296. This property holds when fixed point 290 lies on a vector 296 that determines the orientation of a local coordinate system as described below, and when all points on the original line 292 lie on the same side of vector 296 as a point 294 that is to be moved.

According to this method, a rectangle 293 is inscribed about a curve 292, and a local coordinate system within the rectangle is distorted by anisomorphic scaling to accomplish the reshaping. Referring to FIG. 26, the method as described by the following pseudo code may accept an argument, point 290 in this example, which is a point in the segment described by the "knots" argument that is used to determine the orientation of the inscribed rectangle. In this example, fixed point 290 and orientation-point 290 are the same point in order to illustrate the boundedness property of this reshape method; they need not be.

As implemented, a rectangle 293 is created to enclose all points of line 292, with a vector 296 through fixed point 290 parallel to the tangent of curve 292 at orientation point 290. In order to simplify processing, the coordinate data given in position slot 406 of each point 164 in knots may be rotated about point 290 through an angle that makes the orientation vector 296 be horizontal (parallel to the x-axis), and then translated so that point 290 lies at the origin (0, 0). Once this is accomplished, horizontal and vertical scale factors may be derived from the offset given, and applied to each point in knots. Finally, the translation and rotation as described previously may be undone to complete the process. Note that the process described by the following pseudo code also ensures that calculation of the horizontal and vertical scale factors will not result in dividing by 0, by forcing an isomorphic reshape instead of the linear one if a divide by 0 condition is detected.

```
[define RESHAPE-CURVE-LINEAR
(knots offset orientation-point)
(*Redraw the curve represented by knots, moving the far end by
offset. This is done by inscribing a rectangle about the line and
distorting the local coordinate system within the rectangle. The
orientation-point is a Point, 290 in FIG. 26. The tangent of the
segment described by parameter knots at point 290 determines the
orientation of the coordinate rectangle. Note that this method is
unusable if the direction from point 290 to point 292 is paralle to
the tangent at point 290, and the offset has a component per-
pendicular to that direction. In that case, the Isomorphic reshape
is used instead.)
let tangent be the tangent of the Line at point 290
rotate all knots about 290 through the angle (−tangent) (* the
direction at 290 is now 0)
rotate offset 295 about (0,0) through the angle (−tangent)
let translation be the position of 290
```

-continued

```
translate all knots by (−translation) (* this puts 290 at the origin)
if ((292_y = 0) and (offset_y ≠ 0)) or
((292_x = 0) and (offset_x ≠ 0)),then
(* Scale factor calculation below would involve a divide-by-0.)
invoke reshape-curve-isomorphic (knots offset orientation-point))
else (* here is the actual reshaping.)
let x-scale be the ratio
if 292_x = 0
then 1
else
```

$$\frac{292_x - \text{offset}_x}{292_X}$$

```
let y-scale be the ratio
if 292_y = 0
then 1
else
```

$$\frac{292_y - \text{offset}_y}{292_y}$$

```
scale the position of each point in knots by (x-scale, y-scale)
translate all knots by translation (* this restores point 290 to its
original position)
rotate all knots about 290 through the angle tangent (* point 292
is now where it belongs)]
```

© 1988 3M Company

A process for restoring angles specified in angle-dependencies, illustrated in FIGS. 43A and 43B and detailed in the following pseudo code, is a constraint satisfaction means for altering the coordinate data of a line such that the tangent at one end of the line is changed while the tangent at the other end remains fixed. In FIG. 43B, line 270 depicts a segment before angle restoration and line 271 shows the same segment after angle restoration. A situation in which angle-dependencies might be used to advantage is illustrated in FIG. 49. In this example, lines 275 and 278 are to be sewn together in a finished garment, after which lines 274 and 277 are intended to form a continuous seam. The use of angle dependencies 273 and 267 ensures that a "corner" is not formed at the point where lines 274 and 277 meet.

Referring to FIG. 43A, angle restoration may be accomplished by using a cubic formula 272 of the form $y=ax^3+bx^2+cx+d$, whose slope at the origin is equal to the desired angle change and whose slope at a point a distance from the origin along the x-axis equal to the length of the line is 0, to control the motion of points along the line. The cubic function $y=x^3-2x^2+x$ has a slope of 1 at (0, 0) and 0 at (1, 0), and may be scaled to accomplish the same effect; this is more efficient than calculating coefficients and is implemented by the following pseudo code. In a process described by the following pseudo code, this function is scaled in the x-dimension by the length of the line, and in the y-dimension by the tangent of the angle between the current direction and desired direction of the line at the specified point. The y-values derived from this formula are then used to shift points along the line in a direction perpendicular to the slope of the line at the point being shifted.

```
[define LINE:RESTORE-ANGLE (point direction)
(* Change the shape of this Line so that its tangent at point is
direction. This is done by applying an offset along the length of
this Line described by the cubic formula
y = x^3 − 2x^2 + x
where y is the perpendicular offset at distance x from point. It is
```

-continued

```
assumed that point is one of the endpoints of this Line.)
let x-scale be the length of this Line
let y-scale be x-scale · tan (direction − (the direction of this Line
at point))
let partial-length be 0
let kts be self:Knots
while there are still at least three points in kts
add to partial-length the distance between the first two points
shift the second point in kts in a direction perpendiculat to the
vector >> from the first to the second by
y-scale · (x^3 − 2x^2 + x)
where
```

$$x = \frac{\text{partial-length}}{\text{x-scale}}$$

```
drop the first point from kts]
```

© 1988 3M Company

Summary of Redrawing

A redrawing process, as described herein, may be used to apply internal constraints to the graphical description of the garments in a project. Examples of these constraints in the preferred embodiment are reshape methods, used to reshape a line that has been distorted by adjustment 212, and angle dependencies, used to constrain the angle formed by two lines at a point where they join. After the preferred redrawing process, pattern data represents a garment or set of garments that have been modified to fit the individual represented by body measurements 132. An output preparation process, described below, may then be used to prepare the data for output and utilization by a user.

OUTPUT PREPARATION 218

Introduction

In the preferred embodiment, the purpose of output preparation is to prepare pattern parts for eventual output to an output device, such as a plotter, marker making system, or other equipment related to producing garments or garment patterns. In the current implementation of the system, output preparation is comprised of two processes related to preparing pattern parts for output, one to reposition alignment guides and another to replace seam allowance.

Pseudo code for the preferred output preparation process can be described as follows:

```
[define PROJECT:OUTPUT-PREPARATION 305
(*First reposition the alignment guides in each part)
for each Part 152 in Project:Parts 658
send Part:Reposition-Alignment-Guides 353
(*Then replace the seam allowance in each part)
for each Part 152 in Project:Parts 658
send Part:Replace-Seam-Allowance 355]
```

©1988 3M Company

Reposition Alignment Guides

In the preferred embodiment, a strategy is needed to reposition alignment guides that are not incorporated into a line's graphic data following alteration by the preferred adjustment process 212 and redrawing process 216. As described in the preferred fitting preparation process 116 in the section entitled Save Alignment Guide Positions, a repositioning data slot 633 of each unincorporated alignment guide may contain information about how to reposition a particular alignment guide. The purpose of preferred reposition alignment guide method 353 in the preferred embodiment is to establish coordinate positions for unincorporated alignment guides in a particular part using information stored in repositioning data slot 633, and can be described by the following pseudo code:

```
[define PART:REPOSITION-ALIGNMENT-GUIDES 353
(*Check for data in repositioning data slot 633. An entry contains the following four
fields:
1. a reference feature which is either a line or point instance,
2. a distance
3. a direction, and
4. a percentage (when reference feature is a line instance).)
for each Alignment Guide instance 624 in Part:Features 334
let reference be reference feature in the entry
(*The reference feature may be a line)
if reference feature is a Line instance 162
let line-position be the position on the reference line that >>
is equal to the percentage distance from the beginning of the line
let new-position be the position obtained by moving perpendicularly from the >>
line-position by the distance contained in the entry
(*Or the reference feature may be a point)
else
let new-position be the position obtained by moving in the specified >>
direction from the reference point by the distance contained in the entry
(*Now store the new alignment guide position in the Point instance for this Alignment
Guide)
fill (Alignment-Guide:Point):Position 406 with new-position]
```

©1988 3M Company

Seam Allowance Replacement

As was described in the preferred fitting preparation process 116 in the section entitled Seam Allowance Removal, a seam allowance portion was removed from each part of a project. At this time, in the preferred embodiment, the seam allowance portion is typically replaced so that the resulting lines of each part represent cut lines.

The process to replace seam allowance essentially reverses the process that removed seam allowance as illustrated in FIGS. 42A, 42B, and 42C. Each outside line that is also a seam line is preferably moved out by a seam allowance portion. When outside seam lines form a corner, as illustrated in FIG. 30, a corner 856 may need to be formed after seam lines 855 have been moved. A process to replace seam allowance and to form a corner for a part can be described by the following pseudo code:

```
[define PART:REPLACE-SEAM-ALLOWANCE 355
(*Collect the outside seam lines)
for each feature in Part:Features 334
add feature to the list of outside seam lines when >>
1. the feature pointer is a pointer to a Line instance 162>>
2. the Line is on the outside of the Part>>
3. the slot Line:Role 386 is "Seam"
(*Move each outside seam line)
for each Line instance 162 in the collection of outside seam lines
for each point contained in Line:Knots 382
move point by amount of seam allowance perpendicular to the Line away >>
from the center of the part
(*handle corners)
for each Line instance 162 in collection of outside seam lines
if adjoining Line instance is also an outside seam line and formed a corner prior to>>
seam allowance replacement
project both Line instances so that they also form a corner at their new location]
```

©1988 3M Company

Summary of Output Preparation

In the preferred embodiment, output preparation is the last step of fitting process 134. At this point the pattern knowledge base contains information that can be used by post processor 137 to produce plotted pattern parts (with cut lines) or as input to a garment manufacturing process.

Knowledge Representation

Introduction

This section describes each of the objects and their respective slots comprising the preferred embodiment of the present system. It will be recognized by those skilled in the art that many alternate implementations are possible. Each object description below includes a table, listing slots, slot types, and references in the "comments" column to the process descriptions where further detail may be found on the use and definition of the slots. The method slots in each object are more fully described in descriptions of the process that executes the particular method. In the case of object pointers and data slots, a reference is provided in the comments section of the table to the process which fills each particular slot.

Table 16 below lists each of the objects of the preferred embodiment, along with the corresponding table number and figure number. Following the table are the detailed descriptions of each of the preferred objects.

TABLE 16

| Table | FIG. | Object |
|---|---|---|
| 1 | 4 | Project 146 |
| 2 | 5 | Garment 148 |
| 3 | 6 | Part 152 |
| 4 | 7 | Feature 154 |
| 5 | 9 | Point 164 |
| 6 | 8 | Line 162 |
| 7 | 14 | Dart 160 |
| 8 | 10 | Garment Template 676 |
| 9 | 11 | Measurement 150 |
| 10 | 37 | Measurement Template 600 |
| 11 | 33 | Line Template 612 |
| 12 | 13 | Alignment Guide 624 |
| 13 | 12 | Part Template 634 |
| 14 | 19 | Style Template 685 |
| 15 | 15 | Body Measurements 132 |
| 17 | 20 | Grade Set 775 |

In the preferred embodiment, a project instance is created from the project class 146, as illustrated in FIG. 4, and a single project instance is created for each pattern knowledge base (KB) during data conversion 104. As is illustrated in FIG. 3, the project is the highest level object of the knowledge base hierarchy.

As is illustrated in FIG. 4 and in Table 1 below, each project 146 in the current system contains slots as shown; the text following Table 1 describes each of these slots as implemented in the preferred embodiment, it being recognized by those skilled in the art that many alternate implementations are possible. Methods referred to in Table 1 and in the explanation following Table 1 are detailed in descriptions of the processes referred to in the comments column of the table.

TABLE 1

| Slot | Slot Type | Comments |
|---|---|---|
| garments 300 | pointer | filled in during data conversion 104 or during classification 112 |
| create 301 | class method | executed during data conversion 104 |
| grade 302 | method | executed during fitting 134 |
| state of progress 303 | data | used during pattern preparation 110 |
| alter 304 | method | executed during fitting 134 |
| output preparation 305 | method | executed during fitting 134 |
| description 306 | data | filled in during data conversion 104 or during classification 112 |
| known sizes 308 | data | filled in during data conversion 104 |
| name 310 | data | filled in during data conversion 104 or during classification 112 |
| base size 312 | data | filled in during data conversion 104 or during annotation 114 |
| feature identification 513 | method | executed during annotation 114 |
| set line directions 640 | method | executed during fitting preparation 116 |
| set angle dependencies 642 | method | executed during fitting preparation 116 |
| prepare darts & pleats 644 | method | executed during fitting preparation 116 |
| set reshape methods 648 | method | executed during fitting preparation 116 |
| save alignment guide positions 650 | method | executed during fitting preparation 116 |
| parts 658 | pointer | filled in during data |

TABLE 1-continued

| Slot | Slot Type | Comments |
|---|---|---|
| | | conversion 104 |
| garment classification 695 | method | executed during classification 112 |
| garment templates 696 | pointer | filled in during classification 112 |
| part classification 697 | method | executed during classification 112 |
| style classification 698 | method | executed during classification 112 |
| template copying 699 | method | executed during classification 112 |

Garments slot 300 may contain object pointers to each garment instance 148 contained in the pattern KB.

Create method 301 may be invoked to create a new project instance from the project class 146. A single project instance may be created for each pattern KB.

Grade slot 302 may contain a method to grade all the garments of a project.

State of progress slot 303 may contain information about the completion status of a project within pattern preparation process 110. The use of this slot is more fully described in user interface 124.

Alter slot 304 may contain a method to alter all the garments of a project.

Output preparation slot 305 may contain a method to prepare parts of a project for output.

Description 306 is typically a textual description of the garments in a project and is customarily printed on the back of a pattern envelope or included in pattern or garment catalogs. This text, when available, may be used by classification process 112 to identify garments and features of each project. When description 306 is not included in electronic pattern data 100, it may be elicited from the system user during classification.

Known sizes 308 may be a list of sizes for which garments of a particular project are available (e.g., misses 8 through misses 22).

Name 310 may be the name by which a designer identifies each project, normally a short identifier including the pattern number (e.g., BUTTERICK 3474).

As is the case with the project object, many of the objects that will be described in this section contain a slot called "name" that normally contains a symbol that is used to refer to the object. When "the object named x" is mentioned, an object that contains "x" in a slot called "name" is being referred to.

Base size 312, for a particular project, may be the size in which garments for the project were originally designed. As previously indicated, it is customary in the garment and garment pattern industry to design a garment in only one size, and then to grade it to additional sizes, as in U.S. Pat. No. 3,391,392. The purpose for including a base size in the preferred embodiment is to resolve inconsistencies in the raw data between various sizes. For example, when two lines in the raw data form an intersection at one size but not at another, the present system resolves the conflict by analyzing the data at the base size. It may be assumed that the base size data is the most accurate and, therefore, adjustments may be made, when necessary, to conform to the base size data. When a base size 312 is not included in the electronic pattern data 100, it may be elicited from the system user during annotation process 112, as is further discussed in the description of that process.

Feature identification 513 may contain a method to establish names of the features (like lines, points and darts) of a particular project.

Set line directions 640 may contain a method to establish the correct direction for each line. This process is further described in the discussion of fitting preparation 116.

Set angle dependencies 642 may contain a method to establish angle dependency relationships between lines.

Prepare darts and pleats 644 may contain a method to create dart/pleat instances 160 and to fill the slots of dart/pleat instances with data needed by the fitting process.

Set reshape methods 648 may contain a method to establish reshaping information for each line. Reshaping information may be used by the fitting process to reshape lines after points of the lines are moved.

Save alignment guide positions 650 may contain a method to save information about the positions of alignment guides prior to invoking fitting 134 so that their positions may be properly restored after lines are moved by the fitting process.

A pointer to each part instance of a project may be stored in parts slot 658.

Garment classification slot 695 may contain a method to classify the garments of a project.

Garment templates slot 696 may contain pointers to each garment template 676 corresponding to the garments in a particular project.

Part classification slot 697 may contain a method to classify the parts of a project.

Style classification method 698 may contain a method to identify the styles of a particular project. The way in which styles are used in the current system is described in classification 112.

As is described in the current classification process, information from template objects may be copied to garment and part instances by template copying method 699.

Garment 148

Garment instances, as illustrated in FIG. 5, may be created either during data conversion 104 or classification 112 from the garment class template 148. A garment instance is typically created for each garment of a project; along with its parts 314 and measurements 316, a garment instance 148 typically comprises a description of a garment along with geometric and measurement constraints that allow alteration by preferred fitting process 134. Each garment may include a collection of parts which, when sewn together, form a single garment (e.g., a skirt).

In the preferred embodiment, data conversion process 104 creates garment objects when garment information is included in the electronic pattern data 100. Otherwise, garment objects may be created during classification process 112 by eliciting the information from the system user.

As illustrated in FIG. 5 and in Table 2 below, each garment in the preferred embodiment contains slots as shown; the text following Table 2 describes each of these slots as implemented in the preferred embodiment.

TABLE 2

| Slot | Slot Type | Comments |
|---|---|---|
| parts 314 | pointer | filled in during data conversion 104 or during |

TABLE 2-continued

| Slot | Slot Type | Comments |
|---|---|---|
| | | classification 112 |
| measurements 316 | pointer | filled in during fitting preparation 116 |
| create 319 | class method | executed during data conversion 104 |
| grade 320 | method | executed during grade 210 |
| kb-grade 321 | method | executed during grade 210 |
| alter 322 | method | executed during fitting 134 |
| display 324 | method | executed during plotting 517 |
| determine-closest-grade 325 | method | executed during fitting 134 |
| grading-measurement 326 | data | filled in during annotation 114, used by fitting 134 |
| size 328 | data | filled in during fitting 134. |
| name 330 | data | filled in during data conversion 104 or during classification 112 |
| part-of 332 | pointer | filled in during data conversion 104 or during classification 112 |
| expected features 521 | data | filled in during classification 112 |
| derive measurements 542 | method | executed during fitting preparation 116 |
| derive couplings 544 | method | executed during fitting preparation 116 |
| derive ease values 546 | method | executed during fitting preparation 116 |
| style templates 801 | pointer | filled in during classification 112 |
| garment template 802 | pointer | filled in during classification 112 |

Parts slot 314 may contain object pointers to each part instance 152 of a garment.

Measurements slot 316 may contain object pointers to all the measurements that are important for a particular garment. The way in which these measurements are used is further described in the description of fitting 134.

Create slot 319 may contain a method to create a new garment object instance from the garment class. A separate garment object may be created for each garment of a project.

Grade slot 320 may contain a method to grade all the parts of a garment to a particular size.

KB-Grade slot 321 may contain an alternate method to grade all parts of a garment to a particular size.

Alter slot 322 may contain a method to alter all the parts of a garment.

Display slot 324 may contain a method to generate a graphic representation of a garment on a display, plotter, fabric cutter, or other graphic output device.

Determine-closet-grade 325 is a method used during preferred fitting process 134 to decide which of the known sizes should be used as the starting point for fitting a particular set of body measurements 132.

Grading measurement 326 may contain a body measurement which may be used to determine an approximate known size to begin altering a particular garment (e.g., waist circumference). The use of this grading measurement is further described in the discussion of fitting 134.

Size 328 may contain a designator which reflects the information currently represented by the state of a particular garment; for example, after a garment is sized to misses 10, the size slot 328 may contain "misses 10". This slot is preferably filled by the methods that effect the state of garment data (grade 320 and alter 322).

Name 330 may be the name by which a designer idenifies the garment. For example, a project named "Pattern #3474" may contain two garments named "pants" and "skirt". This name may either be contained in the original raw pattern data 100 or may be elicited from the system user, preferably during classification.

Part-of 332 may be an object pointer to project object 146 of which a particular garment object is a part.

Expected features 521 may contain a list of the features that are expected to be found in a particular garment. Each expected feature may contain a name and a feature type (e.g., point, line or dart). This information is used by preferred annotation process 114 to identify the features of a garment.

Derive measurements 542 may contain a method to derive measurements that are important for a particular garment. The way in which measurements are used in the preferred embodiment is described in fitting 134.

Derive couplings 544 may contain a method to derive couplings that are important for a particular garment. The preferred way in which couplings are used is described in fitting 134.

Derive ease values 546 may contain a method to derive ease values for each measurement of a particular garment. The preferred way in which ease values are used is described in fitting 134.

Style templates slot 801 may contain pointers to style templates 685 corresponding to the styles in a particular garment. The preferred way in which styles templates are used and associated with garments is described in classification process 112.

Garment template slot 802 may contain a pointer to a garment template corresponding to a particular garment. Preferred garment templates are described in classification 112.

Part 152

In the preferred embodiment, part instances may be created during data conversion 104 to correspond to each individual pattern piece making up a garment. FIG. 6 details the components of a preferred part instance schematically, and Table 3 below lists preferred slots along with their types and comments detailing where to find further descriptions of the use of slot information and operation of methods; the text following Table 3 describes each of these slots as implemented in the preferred embodiment.

TABLE 3

| Slot | Slot Type | Comments |
|---|---|---|
| features 334 | pointer | filled in by data conversion 104 and annotation 114 |
| part-of 336 | pointer | filled in by data conversion 104 or classification 112 |
| perimeter 342 | pointer | filled in by annotation 114 |
| create 343 | class method | executed during data conversion 104 |
| grade 344 | method | executed during grade 210 |
| update 346 | method | executed during redraw 216 |
| update sequence 352 | pointer | filled in by fitting preparation 116, used by redraw 216 |
| reposition alignment guides 353 | method | executed during output preparation 218 |

TABLE 3-continued

| Slot | Slot Type | Comments |
|---|---|---|
| name 354 | data | filled in by data conversion 104 or classification 112 |
| replace seam allowance 355 | method | executed during output preparation 218 |
| attach-alignment-guides 508 | method | executed during annotation 114 |
| make-intersections 510 | method | executed during annotation 114 |
| combine-lines 511 | method | executed during annotation 114 |
| expected-features 519 | data | filled in by classification 112 and annotation 114, used by annotation 114 |
| rotate 608 | method | executed during fitting preparation 116 |
| remove seam allowance 610 | method | executed during fitting preparation 116 |
| split lines 638 | method | executed during fitting preparation 116 |
| add invisible lines 639 | method | executed during fitting preparation 116 |
| set-update-sequence 646 | method | executed during fitting preparation 116 |
| save alignment guide positions 650 | method | executed during fitting preparation 116 |
| set attached points 666 | method | executed during fitting preparation process 116 |
| part template 800 | pointer | filled in by classification 112, used by annotation 114 and fitting preparation 116 |

Features 334 may be a list of instances of the class of features 154 that together make up the graphic description of the part.

The garment 148 of which a particular part 152 is a part may be listed in part-of 336.

Perimeter 342 may be a list of lines 162 that together describe the perimeter of a part.

Create method 343 preferably resides in the class to create new part instances 152.

Grade method 344 may be invoked to fill in data for a part 152 corresponding to a particular known size. Known sizes 308 may be listed in the project instance 146 of a particular pattern knowledge base.

Update method 346 is preferably part of a redraw process 216, where it is preferably responsible for reconstructing the shape of a part after completion of preferred adjust process 212.

A list of the lines from features slot 344 may be sorted according to dependency relationships and stored in update-sequence 352 to control redraw process 216. A description of these dependencies and the use of update sequence 352 may be found in the description of redraw 216.

Reposition alignment guides slot 353 may contain a method to reposition the points associated with alignment guides after parts of a project have been adjusted.

Name 354 may contain a name of a particular part; the name may be used to match part templates 634 with parts instances 152 during classification 112.

Replace seam allowance slot 355 may contain a method to replace the seam allowance that was removed as part of fitting preparation process 116.

Attach alignment guides slot 508 may contain a method to attach alignment guides to lines. This process is further described in annotation 114.

Make-intersections slot 510 may contain a method to graphically represent lines that intersect and is further described in annotation 114.

Combine-lines slot 511 may contain a method to combine adjacent line segments during annotation process 114.

Expected features slot 519 may contain a list of features that are expected to be found in a part. This information is preferably used by annotation process 114 during feature identification.

Rotate slot 608 may contain a method to rotate a part so that the line contained in top slot 537 is oriented at the top of a part.

Remove seam allowance slot 610 may contain a method to remove the seam allowance portion from a particular part. This process is further described in fitting preparation 116.

Split lines slot 638 may contain a method to break single lines into multiple lines. The resons for splitting lines and the preferred way in which splitting is performed in the preferred embodiment is described in fitting preparation process 116.

Add invisible lines slot 639 may contain a method to create an expected line when it does not exist in electronic data 100. The preferred way in which invisible lines are created in further described in fitting preparation process 116.

Set update sequence slot 646 may contain a method to establish an order for updating the lines of a part.

Save alignment guide positions 650 may contain a method to save the position of each alignment guide in a part that is not part of a line. After the fitting process moves lines, the saved positions are preferably used to restore the alignment guide positions.

Set attached points slot 666 may contain a method to attach points to other points in a part. The preferred way in which this information is used is described in fitting preparation 116.

Each part, in the current system, corresponds to a particular part template. During classification 112, part template slot 800 is preferably filled with the part template corresponding to each part of a project.

Feature 154

Figure 7:
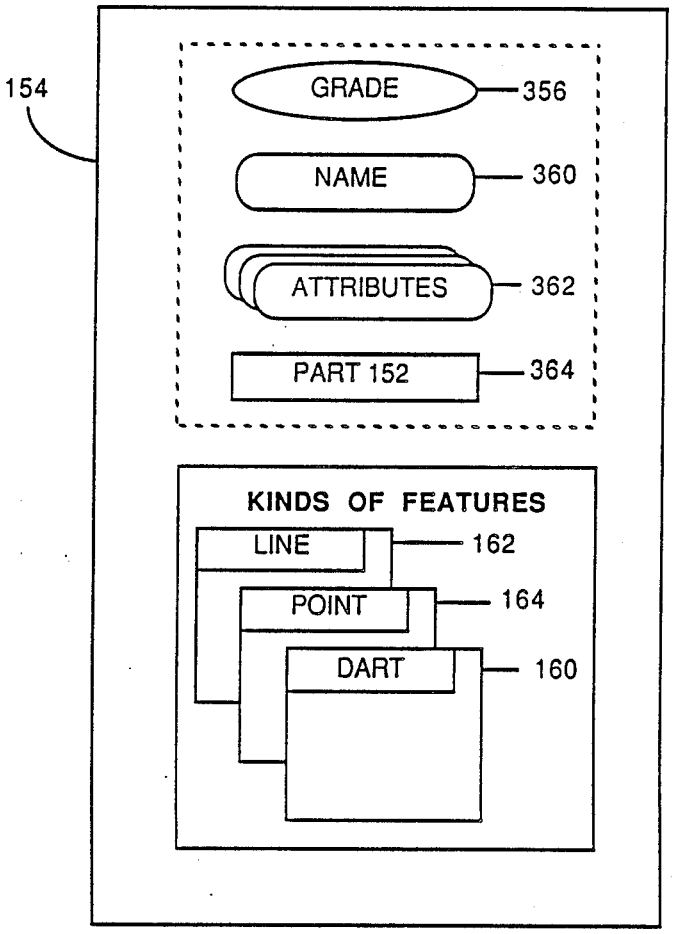

In the preferred embodiment, classes point 164, line 162, and dart 160 are all subclasses of feature 154 (FIG. 7). The slots listed in Table 4 are preferably included in every instance of each of the subclasses by inheritance, as described above. The text following Table 4 describes each of these slots as implemented in the preferred embodiment.

TABLE 4

| Slot | Slot Type | Comments |
|---|---|---|
| grade 356 | method | executed during grade 210 |
| name 360 | data | filled in by annotation 114 |
| attributes 362 | data | filled in by fitting preparation 116 |
| part 364 | pointer | filled in by data conversion 104 |

Grade method 356 may contain a process to retrieve or create data for a particular feature to make it conform to one of the sizes as listed in known sizes 308 (FIG. 4) of the project instance 146 in a particular pattern KB. As detailed in the description of grade process 210, each subclass of feature 154 may implement a separate process for this method; in other words, the slot is typically inherited by each subclass, but the process residing in the slot may be specific to each subclass.

Name 360 may contain a symbol that may be used to refer to a specific instance of one of the feature subclasses. For example, a line 162 that represents the waist seam on a particular garment 148 might contain the symbol "waist" in this slot.

Attributes 362 may be used in instances of feature subclasses to contain a list of symbols or name-value pairs. For example, a line 162 lying on the perimeter of a part 152 might include the symbol "perimeter" in this slot.

Part 364 may contain a pointer to the part instance 152 that contains a particular instance of one of the feature subclasses.

Point 162

In the preferred embodiment, point instances 164 are created in a knowledge base during data conversion 104. A point 164 typically represents an (x y) coordinate.

As illustrated in FIG. 9 and in Table 5 below, points contain slots as shown; the text following Table 5 describes each of these slots as implemented in the preferred embodiment.

TABLE 5

| Slot | Slot Type | Comments |
|---|---|---|
| create 399 | method | executed during data conversion 104 |
| endpoint-of 400 | pointer | filled in by data conversion 104 |
| midpoint-of 402 | pointer | filled in by data conversion 104, annotation 114 and fitting preparation 116 |
| attached points 403 | pointer | filled in during fitting preparation 116 |
| position 406 | data | filled in by grade 210 |
| graded-positions 408 | data | filled in by data conversion 104, annotation 114 and fitting preparation 116 |
| move 410 | method | executed during adjust 212 |
| lines 411 | pointer | filled in by data conversion 104, annotation 112 and fitting preparation 116 |

Create method 399 typically exists only in the point class, not in point instances. It may be used to create new instances of the class of points.

Endpoint-of slot 400 may contain a list of pointers to the line instances to which a particular point is an endpoint.

Midpoint-of slot 402 may contain a list of pointers to the line instances to which a particular point is a midpoint.

Attached points slot 403 may contain a list of pointers to other point instances that are attached to a particular point instance. The preferred way in which attached points are determined is described in the section entitled Set Attached Points in the fitting preparation process 116. In the preferred embodiment, when this point is moved, the attached points are automatically moved by the same amount. The preferred process of moving attached points is described in fitting.

Position slot 406 may contain the current x,y coordinate of a point.

Graded-positions slot 408 may contain an x,y coordinate for each known size of the project in which this particular point instance resides.

Move 410 may contain a method to move points.

Lines slot 411 may contain a pointer to each line instance 162 that contains a particular point.

Line 162

In the preferred embodiment, line instances are created during data conversion 104. A line represents a graphic feature and preferably consist of an ordered list of points 164. A line 162 may be drawn by connecting together its points 164. Alternatively, a line 162 may be drawn by computing splines or other smooth curves with which to connect together its points 164.

As illustrated in FIG. 8 and in Table 6 below, lines as implemented in the present system contain slots as shown; the text following Table 6 describes each of these slots as implemented in the preferred embodiment.

TABLE 6

| Slot | Slot Type | Comment |
|---|---|---|
| update 358 | method | executed during redraw 216 |
| create 381 | method | invoked by data conversion 104 |
| knots 382 | data | filled in by data conversion 104 |
| graded data 383 | pointer | filled in by data conversion 104, annotation 114 and fitting preparation 116 |
| angle-dependencies 384 | data | filled in by fitting preparation 116 |
| line template 385 | pointer | filled in by annotation 114 |
| role 386 | data | filled in by annotation 114 |
| snapshot 388 | data | filled in by grade 210 |
| snap 389 | method | executed during fitting 134 |
| reshape-methods 390 | data | filled in by fitting preparation 116 |
| features 392 | pointer | filled in by annotation 114 |
| move 393 | method | executed during adjust 212 |
| requested-changes 394 | data | filled in by adjust 212 |
| scale 395 | method | executed during adjust 212 |
| change-angle 396 | method | executed during adjust 212 |
| reshape 397 | method | executed during redraw 216 |
| restore-angle 398 | method | executed during redraw 216 |

Update method 358 may be used to update the position of the points on a line in order to account for changes that occur to a line during fitting process 134.

Create method 381 typically exists only in the line class, not in line instances. It may be used to create new instances of the class of lines.

Knots slot 382 in a line instance may contain the list of point instances 164 through which the line passes. The first point in the knots list may be called the "anchor" of the line. In discussing the various functions that affect lines, terms like "near end", "far end", "before", and "beyond" may be used to refer to positions in the list of knots of a line. These preferably refer to relationships with the anchor point; "near end" preferably means the anchor or the point closer to the anchor, such as the near end of a dart. "Far end" preferably means the last point in the list of knots or the point occuring later in the list, such as the far end of a dart.

Graded data slot 383 may contain an ordered list of points of a line for each of a project's known sizes.

Angle-dependencies slot 384 may contain a list of records of the form <point dependent-line angle> that constrain the angle at which two lines join. The point field of an angle-dependency may be the point at which the line containing the angle-dependency meets the dependent-line specified in the angle-dependency, and will normally be a shared endpoint. The angle is preferably the angle that the tangents of the two lines form where they meet at the specified point. The angle may be measured in a counter-clockwise direction from the independent line (the line containing the angle-dependency record) to the dependent-line specified in the record. Angle-dependencies are preferably processed by a restore-angle method 398 during a redraw phase 216 of the preferred fitting process.

Line template slot 385 may contain a pointer to a line template 612 corresponding to a particular line. Line template slot 385 is preferably filled during feature identification 513.

The meaning or function of a line in a pattern may be specified by the contents of a role slot 386. This slot preferably has one of the values "seam", "fold", "grainline", "hem", or "reference".

Snapshot slot 388 preferably holds a list of points and associated (x, y) positions during the fitting process.

Snap method 389 may be invoked during the preferred fitting process to fill in the snapshot slot.

Reshape methods slot 390 may contain a list of entries of the form (point reshape-method parameter) that specify the manner in which a line may be reshaped. The contents of this slot may be used by reshape method 397 when reshaping lines and is fully described in redraw process 216.

A list of features associated with a line may be contained in a features slot 392. These features are typically darts or pleats that break up a line, in which case this slot would normally contain pointers to dart instances 160.

A line instance may be moved by sending a message to its move method 393, giving x and y offsets describing the desired movement. The effect of moving a line is preferably to move all the points in the list in its knots slot 382. Moving a line also preferably shifts the positions listed in the snapshot slot 388 for reasons that are explained in the description of fitting process 134.

Requested-changes slot 394 may be used during a fitting process to contain requests for changes that can not be processed immediately. In the present embodiment, the only type of request that will appear in this slot is a restore-angle request. These requests are preferably placed in the slot during the adjustment phase 212 of fitting process 134, and are preferably accessed and processed during the redrawing phase 216.

Scale method 395 may be used during the adjustment phase of the preferred fitting process to change the size or length of a line without changing its shape; this may be accomplished by performing an isomorphic scaling of coordinates of the points in a knots slot about a specified origin. This is explained further in the description of a fitting process.

Change-angle method 396 may also be used during adjustment phase 212 of the preferred fitting process. Its function is to modify the angle field of a specified angle-dependency record.

Reshape method 397 may be invoked during the redraw phase 216 of fitting 134 to reposition the points listed in the knots slot as shown in FIG. 46.

Restore-angle method 398 may be used to adjust the tangent angle of a dependent line during preferred redraw process 216. It is typically invoked in response to the processing of an angle-dependency on an independent line that contains a dependent line in its dependent-line field.

Dart 160

Dart objects 160 may be used to represent both darts and pleats in a garment as pictured in FIGS. 39A and 39B. Both are preferably instances of a line 162 being folded back on itself in a finished garment.

Figure 14:
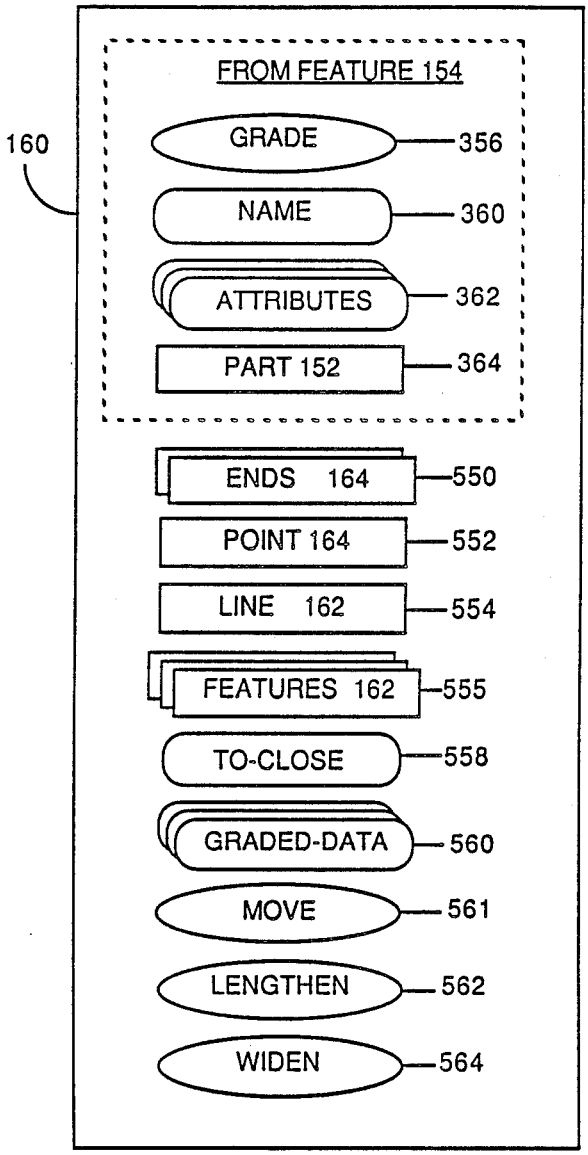

As illustrated in FIG. 14 and in Table 7 below, darts may contain slots as shown; the text following Table 7 describes each of these slots as implemented in the preferred embodiment.

TABLE 7

| Slot | Slot Type | Comments |
|---|---|---|
| ends 550 | pointer | filled in by fitting preparation 116 |
| point 552 | pointer | filled in by fitting preparation 116 |
| line 554 | pointer | filled in by fitting preparation 116 |
| features 555 | pointer | filled in by fitting preparation 116 |
| to-close 558 | data | filled in by grade 210, used by redraw 216 |
| graded-data 560 | data | filled in by fitting preparation 116 |
| move 561 | method | invoked during adjust 212 |
| lengthen 562 | method | invoked during adjust 212 |
| widen 564 | method | invoked during adjust 212 |

Ends 550 is typically a pair of pointers to points 164. These are the two points 164 where the dart intersects a line 162, typically a perimeter line that is broken by the dart, as illustrated in FIGS. 39A and 39B.

Point 552 may be a point 164 where the two lines describing a dart 160 meet, or the two points where pleat lines meet, as illustrated in FIGS. 39A and 39B.

Line 554 may be a pointer to a line instance broken by a dart 160. In FIGS. 39A and 39B, this "parent line" is labelled 821.

Features 555 may contain a pointer to the line instance or instances that describe the graphic elements making up a dart or pleat 160. Typically, in the case of an ordinary dart, these will be at least a pair of line segments described by one or more line instances having the two ends 550 as endpoints.

To-close 558 may contain a record of the form <pivot rotation translation> that describes means for closing a dart or pleat represented by a particular instance of dart 160. As illustrated in FIG. 35, closing a dart or pleat may be accomplished by a rotation, which typically involves rotating a segment 257 about a pivot 256 through a rotation angle 260. On the other hand, a dart or pleat may be closed by translation, as illustrated in FIG. 32E, which preferably involves a translation to make point 816 lie on top of point 815. Preferred grade process 210 fills a to-close slot from data that is typically stored in a graded-data slot 560. To-close information may be used for closing and opening darts in preferred redraw process 216.

Graded-data 560 may contain to-close data for a particular dart 160 for each of the sizes listed in known-sizes slot 308 of the project instance 146 (FIG. 4) residing in the knowledge base that contains a particular dart instance 160.

Move method 561 may be invoked to move graphic features 555 of a dart 160 through a given (delta-x delta-y) offset. Further detail is provided in the description of adjust process 212.

Lengthen method 562 may be invoked to lengthen a dart, which typically means changing the distance between the points and the end. This may occur during adjust 212, and further detail is provided in that section of this document.

Widen method 564 may be used to change the width of a dart without changing its length. A process for doing this is provided in the description of adjust 212.

Garment Template 676

In the preferred embodiment, information about each basic garment type is stored in a garment template which are resident in the system and accessed during pattern preparation process 110.

Figure 10:
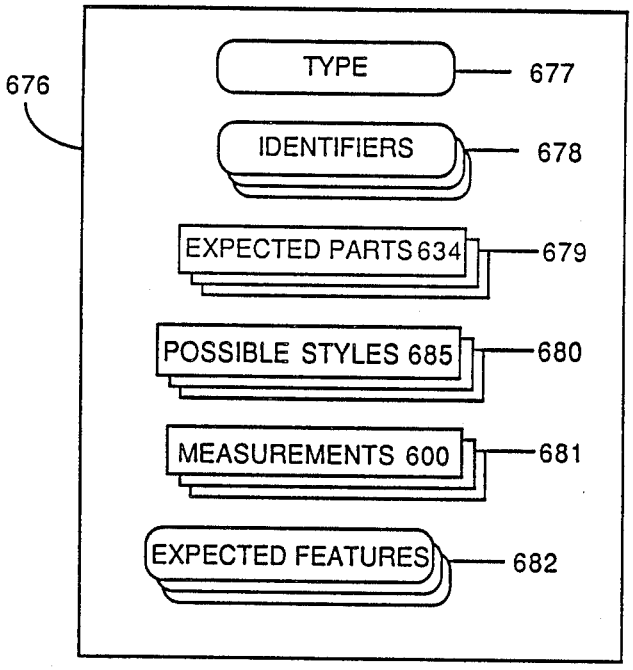

As illustrated in FIG. 10 and in table 8 below, garment templates preferably contain slots as shown; the text following Table 8 describes each of these slots as implemented in the preferred embodiment.

TABLE 8

| Slot | Slot Type | Comments |
|---|---|---|
| type 677 | data | used by pattern preparation 110 |
| identifiers 678 | data | used by pattern preparation 110 |
| expected parts 679 | pointer | used by pattern preparation 110 |
| possible styles 680 | pointer | used by pattern preparation 110 |
| measurements 681 | pointer | used by pattern preparation 110 |
| expected features | data | used by pattern preparation 110 |

Type slot 677 may contain a name that depicts the type of a garment (e.g., pants or skirt).

Identifiers slot 678 may contain a list of words and phrases that are typically associated with garments of a particular type. For example, the word shorts, jeans and culottes are typically associated with pants.

Expected parts slot 679 may contain a list of pointers to a minimum set of part templates 634 that are expected to comprise a particular garment. For example, a pants type garment template typically includes two expected parts, a front and a back.

Possible styles slot 680 may contain a list of pointers to style templates 685 that may be included in a particular garment type. This information may be used by classification process 112 to identify styles related to a particular garment.

Measurements slot 681 may contain a list of pointers to measurement templates 600, where each measurement template represents a garment measurement that is important to the prealteration of a particular garment type.

Expected features slot 682 may contain a list of feature names that are expected to be included in a particular garment type. This information is used by annotation process 114 to identify the features of a garment.

Measurement 150

In the preferred embodiment, measurement instances are created during fitting preparation process 116. A measurement instance is typically created for each significant physical dimension on a garment.

As illustrated in FIG. 11 and in Table 9 below, measurements may contain slots as shown; the text following Table 9 describes each of these slots as implemented in the preferred embodiment.

TABLE 9

| Slot | Slot Type | Comments |
|---|---|---|
| name 512 | data | filled in by fitting preparation 116 |
| garment 514 | pointer | filled in by fitting preparation 116 |
| graded-data 520 | data | filled in by fitting preparation 116, used by grade 210 |
| grade 522 | method | executed during grading 210 |
| grade-adjust 523 | method | executed during KB grading 135 |

TABLE 9-continued

| Slot | Slot Type | Comments |
|---|---|---|
| grading-factors 517 | data | filled in by fitting preparation 116, used by KB grading 135 |
| value 516 | data | filled in by grade 210 |
| fit-ease 524 | data | filled in by grade 210 |
| determine-fit-ease 525 | method | fetch demon on fit-ease 524, executed during adjust 212 |
| design-ease 526 | data | filled in by grade 210 |
| ease 528 | data | filled in by grade 210 |
| determine-ease 529 | method | fetch demon on ease 528, executed during adjust 212 |
| adjustment 530 | data | filled in by adjust 212 |
| determine-adjustment 531 | method | fetch demon on adjustment 530, executed during adjust 212 |
| adjusted-value 532 | data | filled in by adjust 212 |
| get-adjusted-value 535 | method | fetch demon on adjusted-value 532, executed during adjust 212 |
| preference-values 533 | data | filled in by fitting preparation 116, used by adjust 212 |
| couplings 534 | data | filled in by fitting preparation 116, used by apply-couplings 214 |
| process-couplings 536 | method | executed during apply-couplings 214 |

Name slot 512 may contain the name of a particular measurement. Many, but not all, of the measurement instances created for a garment will typically correspond directly to particular body measurements, in which case the symbol contained in name slot 512 of the measurement instance preferably matches the name of one of the slots in body measurements 700. A slot in body measurements 700 that has the same name as a particular garment measurement (as indicated by the contents of its name slot 512) may be known as the "corresponding measurement". For example, a garment 148 named "skirt" might have pointers in its measurements slot 316 referring to measurement instances named "waist-circumference", "hip-circumference", "waist-to-hip", "waist-to-knee", and "flare". With the exception of "flare", all of these would typically have corresponding measurements as indicated in table 15.

In the present embodiment, each garment instance 148 may contain a list of pointers to measurement instances 150 in measurements slot 316. The set of measurement instances for one garment will typically not overlap the set for another garment, even though there may be multiple measurement instances in a project with the same name. For instance, a project containing both a blouse and a jacket would normally have two measurement instances for "chest circumference", but they would likely have different values if one is intended to be worn over the other.

Garment slot 514 may be a pointer to a garment instance 148 (FIG. 5) whose measurements slot 316 may contain a pointer back to measurement instance 150 (FIG. 11). This preferred forward-and-backward pointer arrangement allows a garment 148 to enumerate its measurements 150, and allows a measurement instance 150 to determine the garment instance 148 that it describes. In other words, each of the measurement instances 150 listed in measurements slot 316 of a particular garment instance 148 (FIG. 5) will preferably have pointers back to the same garment instance 148 in a corresponding garment slot 514 of a particular measurement instance 150 (FIG. 11).

Graded data 520 may contain entries for each of the known sizes of a particular project 146; each of these entries may be a record consisting of fields <value fit-ease design-ease>. During grading 210, the contents of these fields are preferably moved by a grade method 522 to slots having corresponding names.

Accordingly, grade method 522 preferably fills in value 516, fit ease 524, and design ease 526 slots with the value from graded data 520 for a particular size. It also preferably clears out ease 528 and adjustment 530 slots in preparation for adjustment process 212 (FIG. 1A).

If knowledge-based grading is used, grade-adjust method 523 may be used to fill in an adjustment 530 according to a desired grade change, preferably using the contents of grading-factors slot 517 as described below. Pseudo code for a typical implementation of this method is given in a previous section entitled "Knowledge-Based Grading".

Grading-factors 517 may contain the informatinn necessary to process a grade path according to a preferred grade-adjust method 523. In the preferred embodiment, this consists of a list of grade ranges and associated adjustment factors. For example, if hip circumference is intended to increase by 4 cm per grade from misses 6 to misses 12, and by 6 cm per grade from misses 12 to misses 24, the grading-factors list might look like

```
(((misses-6 misses-12)+4) ((misses-12
  misses-24)+6)).
```

If ease values are to change from one grade to the next, they typically would also be included, and the grading-factors list might look like

```
(((misses-6 misses-12)(value + 4)(fit-ease + 0.2)(design-ease +
0))
((misses-12 misses-24)
(value + 6)(fit-ease + 0.3)(design-ease + 0.2))).
```

Value slot 516 may contain the actual value for the measurement in the size to which a garment 514 was most recently graded. For example, in a measurement instance named "waist-circumference" for a garment named "pants", value slot 516 might contain "60 cm" when the garment is graded to size "misses 12".

Fit-ease 524 may be the minimum amount by which a particular measurement should be larger than a corresponding body measurement to allow normal comfort and wearability. If there is no corresponding body measurement, as might be the case with a measurement instance named "front-darts" on a garment named "pants", this slot typically has no meaning. In the preferred embodiment, a fit ease slot 524 is accessed through a demon method, determine-fit-ease 525.

Determine-fit-ease 525 is preferably a demon method, activated when values are fetched from fit-ease slot 524. Its purpose is preferably to take into account both personal preferences and body shape variations. This is fully described in the text describing adjust process 212 (FIG. 1A).

Design-ease 526 may be the amount by which a value 516 is larger than the sum of a corresponding body measurement (if there is one) and fit ease 524.

Ease 528 may be the total amount by which a particular garment measurement is intended to be larger than a corresponding body measurement. It is preferably accessed through a demon method determine-ease 529, which typically adds fit ease 524 and design ease 526.

A demon method determine-ease 529 normally adds together the values contained in fit-ease slot 524 and design-ease slot 526. In some cases it may be used to account for dependencies among the ease values on different measurements. For example, the ease on a total crotch length on a pair of pants depends on crotch depth ease. See the description of adjust process 212 for more detail.

Adjustment 530 may be the amount by which a physical garment dimension described by a particular measurement needs to be changed to make the garment 514 fit the person being altered for. It is preferably accessed through a demon method, determine-adjustment 531. Effectively, adjustment slot 530 along with the fetch demon determine-adjustment 531 specifies a relationship between a physical dimension of the garment and body measurements.

A demon method determine-adjustment 531 may be used to provide the central functionality for adjustment process 212 in the preferred embodiment, determining how changes in the physical garment dimension may be derived from body measurements 132. Generally, each type of measurement has its own code or description for this method. In the simplest case, when there is a corresponding body measurement, the adjustment is the difference between the sum of the corresponding body measurement, ease 528, and value 516. Using the demon mechanism in this way allows the numerous dependencies among different adjustments to be taken into account automatically at run time. More detail and examples are provided in the description of adjustment process 212.

Adjusted-value 532 may be the sum of value 516 and adjustment 530. It is preferably accessed through a demon method, get-adjusted-value 535, which typically does the sum in order to ensure that the adjustment will be calculated if necessary.

Preference-values slot 533 may contain two ratios specifying the maximum and minimum amounts by which fit-ease 524 can be multiplied to accommodate personal fit preference. For example, if the normal waist circumference fit ease is 2 cm, and the value in this slot are 2.0 and 0.5, then a person requesting a tight fit could get a fit ease of 1 cm, and a person requesting a loose fit could get 4 cm of fit ease. The normal fit ease for a particular size may be contained in a record corresponding to that size in a graded-data slot 520. Determine-fit-ease demon method 525 is preferably responsible for combining a normal value, the customer's preference, and the range specified in this slot.

Coupling slot 534 may contain a list of coupling data structures 220, shown graphically in FIG. 45, that specify how an adjustment 530 computed for a particular measurement 150 is to be applied to the various features of a particular garment 148 and its parts 152. Effectively, couplings slot 534 may be used to map a physical dimension of the garment onto the points and lines that depict the various parts of the garment. Within a coupling record 220, a comment field 222 may be used to hold a human-readable description of the coupling. A features field 224 may contain a list of features 154 (FIG. 3) such as points, lines, darts, etc. that are to be operated on by the coupling. An operation field 226 may contain the name of a method slot contained in each of the features listed in the features field 224 that will accomplish the desired transformation, for example, to move or scale lines. A parameters field 228 may contain a list of expressions to be evaluated and passed to the method specified in an operation 226. For instance, if the contents of operation 226 is "move", the contents of parameters 228 will typically be two expressions that, when evaluated, will yield x and y distances to move. A predicate field 230 may be empty or may contain an expression that will be evaluated, and if the result is false, the message specified by operation 226 will typically not be sent. As indicated by Table 9, code used in connection with couplings is described in connection with fitting preparation 116 and adjustment 212.

A process-couplings method 536 is preferably responsible for applying or interpreting couplings 534. In the preferred embodiment, it is a central component of adjust process 212. Predicate 230 (FIG. 45) is preferably evaluated and if it is not false, parameters 228 may be evaluated and messages as specified by operation 226 may be formulated and sent to each of the features 224 in each coupling 220 contained in couplings slot 534.

Measurement Template 600

In the preferred embodiment, information about each garment measurement is stored in measurement templates which are resident in the system and are accessed during pattern preparation process 110. Information stored in measurement templates may be used when creating measurement instances 150.

As illustrated in FIG. 37 and in table 10 below, measurement templates preferably contain slots as shown; the text following Table 10 describes each of these slots as implemented in the preferred embodiment.

TABLE 10

| Slot | Slot Type | Comments |
|---|---|---|
| measurement declaration 602 | data | used by fitting preparation process 116 |
| determine adjustment 603 | data | used by fitting preparation process 116 |
| couplings declaration 604 | data | used by fitting preparation process 116 |
| name 606 | data | used by fitting preparation process 116 |
| standard values 668 | data | used by fitting preparation process 116 |
| fit ease 670 | data | used by fitting preparation process 116 |
| ease 672 | data | used by fitting preparation process 116 |
| grading-factors 671 | data | used by fitting preparation process 116 |
| preference values 669 | data | used by fitting preparation process 116 |

Measurement declaration slot 602 may contain a declarative structure that indicates how to derive a particular a physcial dimension for a measurement in terms of expected landmarks and other garment features. The preferred way in which this slot is used to derive measurements is described in derive measurements method 542 in fitting preparation process 116.

Couplings declaration slot 604 may contain generic couplings which describe how changes to the physical dimensions of a garment within a particular garment style are to be applied to expected landmarks and other garment features of garments representative of that garment style. The contents of this slot may be used to derive coupling as described in derive couplings method 544 in fitting preparation process 116.

Determine adjustment 603 may contain a generic adjustment description which describes how body measurements 132 relate to changes in the physical dimension of a garment 148. The contents of this slot may be copied to measurement 150 during fitting preparation process 116. The preferred way in which an adjustment 530 is used is described as part of adjust process 212.

Name slot 606 may contain the name of a particular measurement. This slot may be used by a derive measurements method 542 (see fitting preparation process 116) to fill in the name of a newly created measurement instance.

Standard values slot 668 may contain a standard value for a particular measurement for each standard size. These values may be used by a derive ease values method 652 during fitting preparation 116.

Fit ease slot 670 may contain a standard amount of fit ease for a particular measurement for each standard size. This may be an amount by which a physical garment dimension should differ from body measurements in order to allow for comfort and wearability. These values may be used by a derive ease values method 652 during fitting preparation 116.

Ease slot 672 may contain an active value for deriving the total ease for a particular measurement and is typically copied to ease slot 672 in measurement instances 150 by derive ease values method 652 during fitting preparation 116.

Grading factors 671 normally contains an initial value for a grading-factors slot 517 in a corresponding measurement 150. The purpose of this data is to describe how physical dimensions of a garment are intended to vary from one size to the next.

Preference values 669 normally contains an initial value for a preference-values slot 533 in a corresponding measurement 150. The purpose of this information is to allow taking into account user preference with regard to desired fit in relating body measurements to physical dimensions of a garment.

Line Template 612

In the preferred embodiment, line templates contain information to describe the various types of lines that can exist on pattern parts. Typically, each line instance 162 of a project corresponds to one of the line template objects. Line template information is preferably used during annotation process 114 and during fitting preparation process 116.

As illustrated in FIG. 33 and in Table 11 below, line templates may contain slots as shown; the text following Table 11 describes each of these slots as implemented in the preferred embodiment.

TABLE 11

| Slot | Slot Type | Comments |
|---|---|---|
| anchor 614 | data | used by fitting preparation 116 |
| reshape declaration 616 | data | used by fitting preparation 116 |
| type 618 | data | used by annotation 114 and fitting preparation 116 |
| set reshape methods 648 | method | executed during fitting preparation 116 |
| endpoints 674 | data | used by annotation 114 and fitting preparation 116 |

Anchor slot 614 may contain the name of a point or line which corresponds to the starting point for a line. The anchor information is preferably used by a set line directions method 640 during fitting preparation process 116.

Reshape declaration slot 616 may contain declarative structures known as reshape descriptions (see FIGS. 23–26) that specify the desired shape of lines associated with a particular line template. This information may be used to fill in a reshape method slot 390 of a line instance 152. The contents of reshape declaration slot are preferably established by set reshape methods slot 648.

Type slot 618 may contain a list of names to identify a particular line template. Typically, there are three names: line name, part name, and garment name. Part name and garment name are normally optional. When part name and garment name are included, a particular line template typically applies only to parts and garments with the specified name. When part name is not included, a particular line template normally applies to all parts. Similarly, when a garment name is not included, a line template normally applies to all garments.

Set reshape methods slot 648 may contain a method to copy the entries contained in a reshape declaration slot 616 into a reshape method slot 390 in each line instance corresponding to the line template. In a process of copying entries, each point name may be converted to a pointer to its corresponding point instance 164.

Endpoints slot 674 may contain a list of point names that are expected to be endpoints of a line associated with a particular line template 612. In the preferred embodiment, the first name corresponds to the first point of a line, and the second point name corresponds to the last point of a line. This information is preferably used by annotation process 114 to automatically determine point names. Endpoints slot 674 may also be used by fitting preparation process 116 to add invisible lines (see section entitled Add Invisible Lines in fitting preparation).

Alignment Guide 624

Alignment guides normally represent a special marking on pattern parts that indicate how to align pattern parts when sewing them together or when cutting them out. In the preferred embodiment, an alignment guide instance is created for each alignment guide. Each alignment guide instance preferably contains a point slot 630 which points to a point instance that is associated with an alignment guide.

Figure 13:
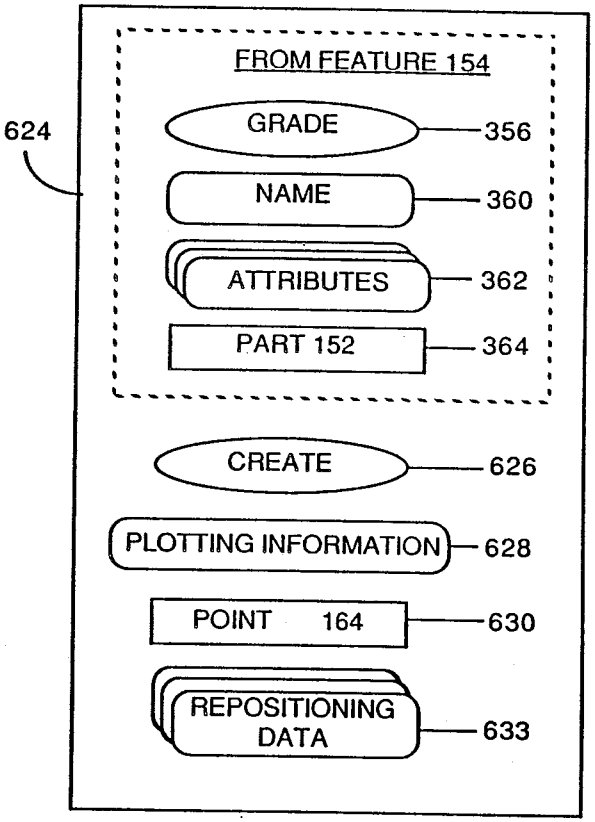

As illustrated in FIG. 13 and in Table 12 below, alignment guides may contain slots as shown; the text following Table 12 describes each of these slot as implemented in the preferred embodiment.

TABLE 12

| Slot | Slot Type | Comments |
|---|---|---|
| create 626 | method | executed by data conversion 104 |
| plotting information 628 | data | filled in by data conversion 104 |
| point 630 | pointer | filled in by data conversion 104 |
| repositioning data 633 | data | filled in by fitting preparation 116 |

Create slot 626 may contain a method to create alignment guide instances.

Plotting information slot 628 may contain information about how to print a particular alignment guide marking. This information may be used by a post processor 137 when preparing pattern parts for output.

Point slot 630 may contain a pointer to point instance 164 that is associated with a particular alignment guide.

Repositioning data slot 633 may contain information about an alignment guide's position prior to adjustment in fitting process 134. This information may be used by output preparation process 218 to reposition alignment guides after garments have been adjusted.

Part Template 634

In the preferred embodiment, part templates contain information to describe the various types of parts that can exist in pattern garments. Typically, each part instance 152 of a project corresponds to one part template object. Part template information may be used during classification process 112, annotation process 114 and fitting preparation process 116.

Figure 12:
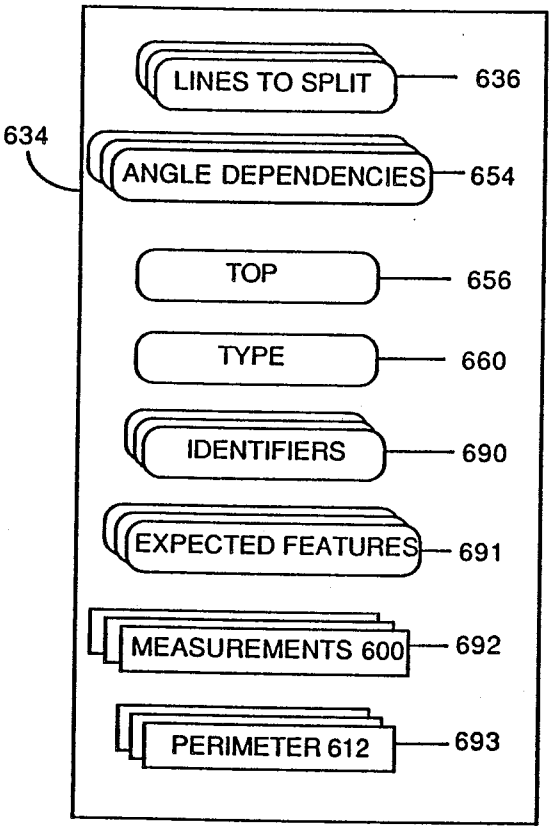

As illustrated in FIG. 12 and in Table 13 below, part templates may contain slots as shown; the text following Table 13 describes each of these slots as implemented in the preferred embodiment. Further information about the role that part templates play in the preferred system is in the discussion of classification process 112 under the heading of Templates.

TABLE 13

| Slot | Slot Type | Comments |
|---|---|---|
| lines to split 636 | data | used by fitting preparation process 116 |
| angle dependencies 654 | data | used by fitting preparation process 116 |
| top 656 | data | used by fitting preparation process 116 |
| type 660 | data | used by annotation process 114 |
| identifiers 690 | data | used by classification process 112 |
| expected features 691 | data | used by annotation process 114 |
| measurements 692 | data | used by classification process 112 |
| perimeter | data | used by annotation process 114 |

Lines to split slot 636 may contain a list of the lines that are typically split during fitting preparation process 116 by split lines method 638.

Angle dependencies slot 654 may contain a list of angle dependencies that typically pertain to a particular part, each angle dependency preferably comprising a line description and a value description. A line description typically contains the name of an independent line, the name of a dependent line that is expected to be connected to the independent line, and an angle. A value description may be used to describe an angle, and may either be a fixed value (e.g., 90 degrees) or calculated (e.g. indicated by the term "measure"). When calculated, the angle between the lines is preferably calculated for a base size of the corresponding project (as contained in a slot base size 312 of project 146), and the calculated value is used as the angle. The preferred structure of angle dependency slot 654 is further described in the section entitled Set Angle Dependencies which is described as part of fitting preparation process 116.

Top slot 656 may contain the name of a line that is typically at the top of a particular part. This data may be used by a rotate method 608 as part of a fitting preparation process 166, preferably when rotating parts so that a desired line is at the top.

Type slot 660 may contain a part name and a garment type. When garment type is included in a part's type slot 660, the part template typically applies only to parts of a particular garment. When there is not a garment type included, a part template typically applies to all parts of a specific type for all garment types. Further information about type slot 660 is in the discussion of classification process 112 under the heading Templates.

Identifiers slot 690 may contain a list of words and phrases that are typically associated with parts of a particular type. This information may be used by a part classification process 697 (FIG. 4).

Expected features slot 691 may contain a list of the features that are expected to be found in a particular part. This information is preferably used by feature identification method 513 during annotation process 114.

Measurements slot 692 may contain a list of pointers to measurement templates 600 that are important to fitting garments that include a particular part. The contents of this slot are preferably used by a template copying method 699 in classification process 112 to establish the contents of a measurements slot 316 in each garment instance 148 of a project.

Perimeter slot 612 may contain a list of pointers to the line templates 612 that normally comprise the perimeter of a particular part. This information may be used by feature identification method 513 in annotation process 114.

Style Template 685

In the preferred embodiment, style templates contain information to describe the various styles that can exist in pattern garments. Style template information is preferably used during classification process 112.

As illustrated in FIG. 19 and in Table 14 below, style templates may contain slots as shown; the text following Table 14 describes each of these slots as implemented in the preferred embodiment.

TABLE 14

| Slot | Slot Type | Comments |
|---|---|---|
| identifiers 686 | data | used by classification process 112 |
| expected features 687 | data | used by annotation process 114 |
| measurements 688 | pointer | used by classification process 112 |

Identifiers slot 686 may contain a list of words and phrases that are typically associated with a particular style. For example, a slot 686 could include identifiers such as full length, mid-calf length, flare, and gore. This information is preferably used by classification process 112 during style classification.

Expected features slot 687 may contain a list of features that are expected to be associated with a particular style. This information may be used by feature identification method 513 during annotation process 114.

Measurements slot 688 may contain a list of pointers to measurement templates 600 that are important to fitting garments that include a particular style. The contents of this slot are preferably used by a template copying method 699 in classification process 112 to establish the contents of measurements slot 316 in each garment instance 148 of a project.

Body Measurements 132

In the preferred embodiment, a body measurements instance 132 (FIG. 15) contains the body measurements of a person for whom garments may be altered. Alternatively, a body measurements instance 132 may contain a set of standard measurements representing an industry-standard garment size. Those skilled in the art will recognize that a wide variety of methods are possible for entry and/or retrieval of body measurement sets for different people. Nevertheless, a set of body measurements is necessary for prealtering a pattern or garment for any one individual, and the manner of entering and/or retrieving such data may depend on a variety of factors, including the particular product or industry segment in which the present system is commercialized. An example of such a method is described in U. S. Pat. No. 4,149,246 entitled "System for Specifying Custom Garments", where a magnetic card system is discussed.

As illustrated in FIG. 15 and in Table 15 below, body measurements 132 may contain slots as shown. The particular set of body measurements shown here is intended to be an illustrative example only; the actual set of measurements used and the methods for acquiring them from a person's body will depend on many factors, preferably including contents of determine-adjustment fetch demons 531 in various garment measurement instances 150. The text following Table 15 describes each of these slots as implemented in the preferred embodiment.

TABLE 15

| Slot | Slot Type | Comments |
|---|---|---|
| waist circumference 701 | data | used by adjustment process 212 |
| hip circumference 703 | data | used by adjustment process 212 |
| hip depth 705 | data | used by adjustment process 212 |
| crotch depth 707 | data | used by adjustment process 212 |
| crotch length 709 | data | used by adjustment process 212 |
| floor-to-waist left 711 | data | used by adjustment process 212 |
| floor-to-waist right 713 | data | used by adjustment process 212 |
| floor-to-waist front 715 | data | used by adjustment process 212 |
| floor-to-waist back 717 | data | used by adjustment process 212 |
| waist to knee 719 | data | used by adjustment process 212 |
| full bust circumference 721 | data | used by adjustment process 212 |
| chest circumference 723 | data | used by adjustment process 212 |
| shoulder width 725 | data | used by adjustment process 212 |
| shoulder to elbow 727 | data | used by adjustment process 212 |
| shoulder to wrist 729 | data | used by adjustment process 212 |
| ease preference 733 | data | used by adjustment process 212 |
| derivation descriptions 735 | data | used by adjustment process 212 |

Waist circumference 701 is typically the distance around the waist.

Hip circumference 703 is preferably the distance around the fullest part of the hip.

Hip depth 705 may be the distance along the side of the body from the waist to the fullest part of the hip.

Crotch depth 707 may be the difference between the average of a floor-to-waist left distance 711 and a floor-to-waist right distance 713, and the inseam or crotch-to-floor distance, which is not represented directly in this example.

Crotch length 709 may be the distance from front waist to back waist through the crotch.

Floor-to-waist left distance 711, floor-to-waist right distance 713, floor-to-waist front distance 715, and floor-to-waist back distance 717 are all preferably measured from a desired location of a waistband to the floor, along the body to the point of maximum protrusion, then straight to the floor.

Waist to knee distance 719 may be measured from a waistband position to the knee along one side of the body.

Full bust circumference 721 is preferably the distance around the body at the level of maximum bust circumference.

Chest circumference 723 is typically the circumference of the body below the armpits and above the bust.

Shoulder width 725 may be the distance across the back of the neck from one shoulder to the other.

Shoulder to elbow distance 725 and shoulder to wrist distance 727 may be the length of the upper arm and the length of the whole arm to the wrist.

Ease preference 733 is typically a statement of how tight a particular person wishes garments to fit. Typical values would be the symbols "tight", "normal", or "loose". These values may be used by determine-ease fetch demons 529 during adjustment process 212 in order to control relationships between garment measurements and body measurements.

Derivation descriptions 735 may be used to generate estimates for unavailable body measurements when other measurements are known. They may be algebraic formulas of the form m=f(m1, m2, . . . ), where m is the unknown measurement, and m1, m2, etc. are either known or can in turn be derived from known measurements.

Grade Set 775

In the preferred embodiment, grade sets contain information to describe the various standard sizes that a user might want to make a particular garment available in. Grade sets are typically used during preferred knowledge-based grading process 135 (FIG. 16).

As illustrated in FIG. 20 and in Table 17 below, grade sets may contain slots as shown; the text following Table 17 describes each of these slots as implemented in the preferred embodiment.

TABLE 17

| Slot | Slot Type | Comments |
|---|---|---|
| prefix 776 | data | used by knowledge-based grading 135 |
| base size 777 | data | used by knowledge-based grading 135 |
| sizes 778 | data | used by knowledge-based grading 135 |

A "name" of a grade set may be contained in a prefix slot 776, and the list of sizes may be placed in a sizes slot 778. For example, if a particular grade set were intended to describe a set of standard sizes (misses 6, misses 8, misses 10, misses 12, misses 14, misses 16, misses 18, and misses 20), the prefix could be "misses" and the sizes would be the list (6 8 10 12 14 16 18 20).

Base size slot 777 is typically the "normal" size for a particular grade set, and in the preferred embodiment is constrained to be one of the sizes listed in a sizes slot 778. It is typically either a size in which original patterns are normally supplied, or the "closest" size (in a grade set that does not include the size in which patterns are normally supplied) to the base size of the grade set that does include the original pattern size.

A special grade set, referred to as the "meta-set" in preferred knowledge-based grading process 135 (FIG. 16), may be used to describe the list of base sizes of all the other sets. Typically, in this set, a prefix 776 would be blank, a base size 777 would be the size in which patterns are normally supplied, and a sizes slot 778 would be a list of base sizes in other grade sets.

The present invention is to be limited only in accordance with the scope of the appended claims, since those skilled in the art may devise other embodiments and methods still within the limits of the claims. For example, the present system has been described to include many preferred process and knowledge subsystems; those skilled in the art will recognize that many alternative process and knowledge subsystems generally with the scope of the claims are possible.

We claim:

1. A computerized data storage structure physically encoded in a storage medium for specifying garment pattern data in machine-readable form for use in connection with a computerized system for manipulating the garment pattern data, comprising:

coordinate data storage means for specifying points and lines depicting parts of a garment; and garment description storage means for specifying a description of the garment, the garment description storage means comprising:

geometric constraint storage means for specifying constraint descriptions that define limits on relationships among the points and lines that depict the garment; and pattern measurement storage means for specifying one or more measurement constraints that map the physical dimensions of the garment onto the points and lines and specify relationships between the physical dimensions of the garment and standard or individual body measurements.

2. The data storage structure of claim 1 wherein the pattern measurement storage means comprises means for specifying total case values that relate to the amount by which a physical garment dimension should differ from the body measurements.

3. The data storage structure of claim 2 wherein the pattern measurement storage means further comprises:

means for specifying fit ease values related to the amount by which a physical garment dimension should differ from the body measurements in order to allow for comfort and wearability; and means for specifying design ease values related to the amount by which the total ease value differs from the fit ease value for a particular physical garment dimension.

4. The data storage structure of claim 1 wherein the pattern measurement storage means comprises means for specifying adjustment descriptions which describe how changes in the physical dimensions of the garment are derived from the body measurements.

5. The data storage structure of claim 1 wherein the pattern measurement storage means comprises means for specifying adjustment couplings which describe how changes in the physical dimensions of a garment are translated into changes to the points and lines depicting the parts of the garment.

6. The data storage structure of claim 1 wherein the geometric constraint storage means comprises means for specifying constraints that define limits on angles between lines in the coordinate data.

7. The data storage structure of claim 1 wherein the geometric constraint storage means comprises means for specifying constraints that define a fixed offset between two points in the coordinate data.

8. The data storage structure of claim 1 wherein the geometric constraint storage means comprises means for specifying conatraints that define, the manner in which a line may be reshaped.

9. The data storage structure of claim 1 wherein the geometric constraint storage means comprises means for specifying dart descriptions that describe geometric transformations required to close a dart.

10. The data storage structure of claim 1 wherein the garment description storage means further comprises means for specifying prepared pattern data comprising one or more garment descriptions, a garment description comprising a plurality of lines or points, one or more dependency relationships among the lines or points specifying when a change to an independent member of a relationship will cause a change to the dependent member, and an update list specifying an order in which the lines or points may be graphically modified such that an independent member of a relationship will be modified before the corresponding dependent member.

11. The data storage structure of claim 1 wherein the pattern measurement storage means comprises means for specifying constraints that relate the body measurements to physical dimensions of a garment taking into account user preference with regard to desired fit.

12. The data storage structure of claim 1 wherein the storage means further comprises respositioning storage means for specifying prepared pattern data comprising repositioning information related to a desired coordinate position of an alignment guide.

13. The data storage structure of claim 12 wherein the repositioning storage means comprises means for storing specifying respositioning information designating that the coordinate position of an alignment guide is to be on a line at a fixed distance from one of the points on the line.

14. The data storage structure of claim 12 wherein the repositioning storage means comprises means for storing repositioning information designating that the coordinate position of an alignment guide is to be on a line at a distance from one of the points on the line, the distance being related to a percentage of the line length.

15. The data storage structure of claim 12 wherein the repositioning storage means comprises means for specifying repositioning information designating that the coordinate position of an alignment guide is to be at a fixed distance and direction from a particular garment feature.

* * * * *

UNITED STATES PATENT AND TRADEMARK OFFICE

CERTIFICATE OF CORRECTION

PATENT NO. : 4,926,344

DATED : May 15, 1990

INVENTOR(S) : John E. Collins, et al.

It is certified that error appears in the above-identified patent and that said Letters Patent is hereby corrected as shown below:

Column 5, line 36, "illustrate" should be--illustrates--.

Column 8, line 21, "®" should be --TM--.
Column 12, line 1, delete "Table 19".
Column 12, between line 16 & 20, insert --Table 19-- after the line "Plotting Information".

Column 27, line 51, "ntil" should read --until--.

Column 30, line 67, "above" should be --about--.

Column 32, line 24, On # 3, 4th line, "n" should be --in--.

Column 35, line 45, "how" should be --How--.

Column 39, line 25, "((INSEAM))" should be --((INSEAM)--.

Column 52, line 15, "accomodate" should be --accommodate--.

Column 52, line 23, "closet" should be --closest--.

Column 56, line 30, "proportionally" should read --proportionality--.

Column 61, lines 45-46-47, "←" should be --⇐--.

Column 65, line 11, delete "(b)" after the word "or" and insert --b)
Body-Measurements: Ease-Preferance
.733 is "normal", the return current-
value
else
if Body-Measurements: Ease-Preference
733 is "tight" then--

UNITED STATES PATENT AND TRADEMARK OFFICE

CERTIFICATE OF CORRECTION

PATENT NO. : 4,926,344

DATED : May 15, 1990

INVENTOR(S) : John E. Collins, et al.

It is certified that error appears in the above-identified patent and that said Letters Patent is hereby corrected as shown below:

Column 66, line 23, delete ")" after the word --Knots--.

Column 66, line 24, ")" should read --))-- after the word "end".

Column 71, line 61, insert --:-- after the word "self-requested", should read --self:requested--.

Column 72, line 6, insert --© 1988 3M Company-- after the "record0]".

Column 76, line 35, "1/p" should read --$\frac{1}{p}$--.

Column 77, line 62, "paralle" should read --parallel--.

Column 78, line 1, "translation)" should read --translation))"--

Column 88, line20, "resons" should be --reasons--.

Column 89, line 18, "162" should read --164--.

Column 89, line 42, "112" should read --114--.

Column 95, line 6, "value" should read --values--.

Column 95, line 16, "informatinn" should read --information--.

Column 96, line 40, "value" should read --values--.

UNITED STATES PATENT AND TRADEMARK OFFICE

CERTIFICATE OF CORRECTION

PATENT NO. : 4,926,344

DATED : May 15, 1990

INVENTOR(S) : John E. Collins, et al.

It is certified that error appears in the above-identified patent and that said Letters Patent is hereby corrected as shown below:

Column 96, line 49, "Coupling" should be --Couplings--.

Column 99, line 44, "slot" should be --slots--.

Signed and Sealed this

Twenty-first Day of April, 1992

*Attest:*

HARRY F. MANBECK, JR.

*Attesting Officer*

*Commissioner of Patents and Trademarks*